US007922629B1

(12) United States Patent
Batca

(10) Patent No.: US 7,922,629 B1
(45) Date of Patent: Apr. 12, 2011

(54) MULTI-STATION EXERCISE GYM

(76) Inventor: Roger Batca, Durham, NC (US)

( * ) Notice: Subject to any disclaimer, the term of this patent is extended or adjusted under 35 U.S.C. 154(b) by 106 days.

(21) Appl. No.: 11/763,509

(22) Filed: Jun. 15, 2007

Related U.S. Application Data

(63) Continuation-in-part of application No. 11/584,327, filed on Oct. 20, 2006, now abandoned, and a continuation-in-part of application No. 11/384,958, filed on Mar. 20, 2006, now abandoned, and a continuation-in-part of application No. 11/346,528, filed on Feb. 2, 2006, now abandoned, and a continuation-in-part of application No. 11/254,576, filed on Oct. 20, 2005, now Pat. No. 7,476,184.

(60) Provisional application No. 60/814,008, filed on Jun. 15, 2006.

(51) Int. Cl.
*A63B 21/06* (2006.01)

(52) U.S. Cl. ..... 482/94; 482/92

(58) Field of Classification Search ..... 482/92–100, 482/51, 148, 142, 139, 133–138
See application file for complete search history.

(56) References Cited

U.S. PATENT DOCUMENTS

| | | | | |
|---|---|---|---|---|
| 4,603,855 | A | 8/1986 | Sebelle | |
| 4,721,303 | A | 1/1988 | Fitzpatrick | |
| 4,733,860 | A * | 3/1988 | Steffee | 482/136 |
| 4,898,381 | A | 2/1990 | Gordon | |
| 4,936,572 | A * | 6/1990 | Desiderio | 482/142 |
| 5,683,334 | A * | 11/1997 | Webber | 482/100 |
| 5,733,233 | A * | 3/1998 | Webber | 482/137 |
| 6,217,493 | B1 | 4/2001 | Spletzer | |
| 6,443,877 | B1 | 9/2002 | Hoecht et al. | |
| 6,447,430 | B1 | 9/2002 | Webb et al. | |
| 6,488,612 | B2 | 12/2002 | Sechrest et al. | |
| 7,322,906 | B2 * | 1/2008 | Webber | 482/100 |
| 2002/0193213 | A1 * | 12/2002 | Batca et al. | 482/92 |
| 2003/0027696 | A1 * | 2/2003 | Baumler et al. | 482/99 |
| 2004/0029688 | A1 * | 2/2004 | Webber et al. | 482/142 |
| 2006/0116249 | A1 * | 6/2006 | Dibble et al. | 482/72 |
| 2008/0045387 | A1 * | 2/2008 | Ish et al. | 482/94 |
| 2008/0214367 | A1 * | 9/2008 | Webber et al. | 482/95 |

* cited by examiner

*Primary Examiner* — Allana Lewin
(74) *Attorney, Agent, or Firm* — Coats & Bennett, P.L.L.C.

(57) ABSTRACT

A multi-station exercise gym comprises a frame, a sectored cable system that reduces the cable portion used during exercise, two high pulleys that are adjustable in width, two arm assemblies that can be selectively adjusted to alter the path of travel, two swiveling outer mid pulleys, two swiveling low pulleys, a centered mid pulley for exercises such as abdominal crunches, a leg extension-curl station, a pivoting seat assembly that provides proper pad support for all exercise movements, an adjustable hold down roller assembly for pull downs, a pair of adjustable arm pad assemblies for seated bicep curls and a low cost equally balanced, low friction incremental weight system.

32 Claims, 53 Drawing Sheets

MULTI-STATION EXERCISE GYM

RELATED APPLICATIONS

This application claims priority to Provisional Patent Application No. 60/814,008 filed Jun. 15, 2006 and is also being filed as a continuation-in-part (CIP) to U.S. patent application Ser. No. 11/584,327 filed Oct. 20, 2006, which is filed as a continuation-in-part (CIP) to U.S. patent application Ser. No. 11/384,958 filed Mar. 20, 2006, which is filed as a continuation-in-part (CIP) to U.S. application Ser. No. 11/346,528 filed Feb. 2, 2006, which is filed as a continuation-in-part (CIP) to U.S. patent application Ser. No. 11/254,576 filed Oct. 20, 2005, which is incorporated herein by reference.

FIELD OF THE INVENTION

The present invention is directed generally to exercise equipment and, more particularly, to a multi-station exercise gym.

BACKGROUND

Various types of exercise machines for strengthening and conditioning the body are known. One type of exercise machine, referred to herein as a multi-station gym, combines different exercise stations into one machine. These different exercise stations are designed to provide a variety of different exercises. In most prior multi-station gyms, the exercise stations are linked with cables to one form of resistance, typically a weight stack.

There are a number of drawbacks with conventional multi-station gyms. First, having numerous exercise stations linked to one resistance load will increase the length of cable between the exercise station and the load. Excessive cable length will take away the smoothness of some exercise movements because of cable stretching. By way of example, a chest press station that has excessive cable linking it to the resistance load will have a "bouncy and jerky" feel. Limiting the cable portion used during exercise movements would enhance the performance and smoothness and increase the safety of the user by decreasing cable stretch.

Second, the high pulley station on existing multi-station gyms typically have one pulley located in a fixed position over the user's head. Thus the user only has one up and down path of movement when performing pull down exercises. Some multi-station gyms have tried to address this limitation by putting two pulleys that swivel over the user's head. However, the two swiveling pulleys remain in a fixed position and still leave the user with limited paths of movement. Also, having extension arms which are pivotally attached near the top of a main support frame of a multi-station gym would create a lot of stress on the frame because of the added leverage when pulling on the extended arms. It would be desirable to have a multi-station gym that had two swiveling high pulleys that were adjustable in width that could be safely supported on a low cost main support frame that would not tilt during exercise. This would allow an increased variety of wide and narrow pull down exercises, therefore increasing muscle use.

Third, the exercise arms on existing multi-station gyms typically follow a fixed path. This only gives the user one choice of motion and limits the movements that can be performed. Some multi-station gyms have tried to address this limitation by making exercise arms that have secondary arms that are linked with one or more axes of rotation which allow the user to determine their own travel path while in the exercise motion. This gives the user more paths of motion; however, this type of movement is difficult for non-advanced users and seniors. Having exercise arms wherein several travel paths could be pre selected before use would be desirable and achievable for all users.

Fourth, on existing multi-station gyms, proper bottom seating and back pad support is not attainable for all exercise stations. For example, proper pad location for a chest press may put the user in an awkward position for shoulder press exercises. Some existing multi-station gyms have tried to address this problem by making the back pad pivotally adjustable to lean forward for shoulder press exercises; however, the bottom seat remains fixed, thus leaving the user's body in a "pinched" position. Thus, there is a need for a seat assembly that will support the user in a correct position for all exercise movements.

Fifth, the hold down rollers on existing multi-station gyms are typically located below, behind, or to the outsides of the back support pad. If the hold down rollers were in front of the back pad, they would get in the way on almost all other exercises. The hold down rollers are used to keep the user down in the seated position while doing pull down exercises using the high pulley. During exercise, the user faces towards the back pad, puts their legs underneath the hold down rollers, and pulls down on a bar or handle from the high pulley. On single station pull down machines there are no back pads, therefore the hold down rollers are typically closer together and closer to the user wherein the rollers are positioned above the users upper thighs. This allows the user to focus more on exercising the back and arm muscles rather than expend energy on trying to stay in the seated position. On multi-station gyms, because the hold down rollers have to share a location with a back pad, the user is forced to spread their legs wide to the outsides of the back pad to utilize the hold down rollers. Also, the closer the user wants the rollers towards their upper thighs, the further they have to slide towards the back pad and are forced to spread their legs even wider. Also, because the hold down rollers are behind or adjacent to the back pad, the hold down rollers will contact the user's tops of the lower thighs in order for the user to be properly lined up with the high pulley to do pull down exercises. This makes it difficult to stay in the seated position and is an uncomfortable position for doing high pull down exercises. Therefore, there is a need for a multi-station gym to have hold down rollers that can be positioned in front of the back pad during use and positioned out of the way of other exercises when not in use.

Sixth, very few existing multi-station gyms have two swiveling low pulleys positioned wherein a user could do seated bicep curls. Pad support is not available for the few that do. Having stationary pad support for seated bicep curls would interfere with other exercise movements such as chest presses, wherein the user's arms and elbows would break the plane of the bicep curl pads during use. Having arm and elbow support while doing bicep curls would allow the user to concentrate on the bicep muscles. It would be desirable to have a multi-station gym with two swiveling low pulleys wherein arm support pads could be positioned in the proper location while performing seated bicep curls, then repositioned to be stored out of the way of other exercise movements.

Also, the resistance load for a multi-station gym is typically a weight stack. The weight stack is usually adjustable in ten pound increments. For some stations, ten pound increments are too much of an increase in weight to notice short term improvements in strength. To address this problem, there are numerous types of incremental weights for weight stacks, however there are many drawbacks to them. First, most incremental weights are attached to one side of the weight stack wherein this will alter the balance and cause increased friction when in use. Second, some incremental weights follow a separate track during use wherein this will cause increased friction as well. Also, most incremental weights are attached to the frame of the exercise machine before being transferred or linked to the weight stack for use. The weight stacks on most multi-station gyms are positioned away from the framework and enclosed by weight stack shrouds. Building extra framework to be near a weight stack would be costly. This is why incremental weights are often a feature of single station gyms, which typically have a cage frame on two sides of the weight stack, but seldom a feature of multi-station gyms. Having incremental weights with a low cost attachment means that can be loaded with proper balance and that do not follow a separate track wherein friction would be minimized would be desirable.

Multi-station gyms are cost efficient to manufacture and space efficient because numerous stations can share the same framework and the same resistance load. Thus, there is a need for a multi-station gym that provides smooth exercise movements by minimizing cable stretch, increased adjustability by providing width adjustable high pulleys for pull downs and path adjustable exercise arms for pressing and pulling, proper back and bottom seating positioning on all exercise movements, hold down rollers that can be used in front of the back seat then stored out of the way when not in use, bicep curl arm pads that can be used on the outsides of the back seat then stored out of the way when not in use, and a low cost, properly balanced, and low friction incremental weight system.

SUMMARY

The present invention is directed to a multi-station gym that includes a sectored cable system that reduces the cable portion used during exercise, two high pulleys that are adjustable in width, two arm assemblies that can be selectively adjusted to alter the path of travel, two swiveling outer mid pulleys, two swiveling low pulleys, a centered mid pulley for exercises such as abdominal crunches, a leg extension-curl station, a pivoting seat assembly that provides proper pad support for all exercise movements, an adjustable hold down roller assembly for pull downs, a pair of adjustable arm pad assemblies for seated bicep curls, and a low cost, equally balanced, low friction incremental weight system.

The multi-station exercise gym comprises a frame, multiple exercise stations, and a resistance element. In one embodiment, the resistance element comprises a stack of weights.

In one aspect of the invention, multiple exercise stations are inter connected with the weight stack with a sectored cable and pulley system. A sectored cable and pulley system in a multi-station gym divides the cables and pulleys into separate sections within the gym. In one embodiment, this is achieved by attaching locking balls on the ends of certain cables. These locking balls brace against a frame member and allow a respective cable end to travel in only one direction. In one embodiment, this is also achieved by bracing a double pulley free floater against levelers that only allow movement of the double pulley free floater in one direction. This allows some exercise stations on the multi-station gym to have dedicated sections of cable and pulleys that directly connect with one main section of cable and pulleys that directly connect with the weight stack, thus providing resistance. The locking balls and braced double pulley free floater prevent the active sections from pulling cable in other sections, thus minimizing cable stretch. Minimizing cable stretch can help alleviate bouncing and jerking exercise movements which can cause injury. In one embodiment, there is one main sector and four sub-sectors. The main sector comprises two cables that are active during use of any station of the gym. The first cable directly connects to the weight stack. The second cable, which comprises a locking ball on each end, connects to the first cable as well as the four sub-sectors.

The first sub-sector has a cable that connects two width adjustable swiveling high pulley assemblies to the main sector. A specific locking ball and a braced double pulley free floater within the cable and pulley system prevent cable pull in the other sub-sectors. This keeps tension off of the cables in the other three sub-sectors and prevents excessive cable stretching and allows the two high pulleys in use to have smooth and safe movement.

The second sub-sector has a cable that connects two path adjustable exercise arms to the main sector. Specific locking balls within the cable and pulley system prevent cable pull in the other sub sectors. This keeps tension off of the cables in the other three sub-sectors and prevents excessive cable stretching and allows the two path adjustable exercise arms in use to have smooth and safe movement.

The third sub-sector has two cables that connects two swiveling outer mid pulleys and two swiveling low pulleys to the main sector. This third sub-sector does activate the second sub-sector; however specific locking balls within the cable and pulley system prevent cable pull in two other sub sectors. This keeps tension off of the cables in the other two sub-sectors and prevents excessive cable stretching and allows the two swiveling outer mid pulleys and two swiveling low pulleys in use to have smooth and safe movement.

The fourth sub-sector has a cable that connects a centered mid pulley and a leg extension and leg curl station to the main sector. A specific locking ball and a braced double pulley free floater within the cable and pulley system prevent cable pull in the other sub sectors. This keeps tension off of the cables in the other three sub-sectors and prevents excessive cable stretching and allows the centered mid pulley and a leg extension and leg curl station in use to have smooth and safe movement.

In another aspect of the invention, a width adjustable high pulley assembly is pivotally attached to the upper portion of the frame above the user's head for performing pull down exercises. Respective locking mechanisms allow the user to selectively position two swivel assemblies to the desired location. The user can choose between wide and narrow pull downs or any position in between.

In another aspect of the invention, two path adjustable exercise arms are pivotally attached to the frame for performing pressing and pulling exercises. Respective locking mechanisms allow the user to selectively position the arms for a neutral, converging, or diverging path. Guide pulley swivel assemblies keep the cable in alignment during path adjustments and during use. patent application Ser. Nos. 11/254,576 and 11/346,528 and 11/384,958 wherein Roger Batca is the inventor, explains this exercise station in greater detail.

In another aspect of the invention, a seat assembly is pivotally attached to the frame and is selectively positionable with one or more locking pins. By pivoting the seat assembly, the user is able to alter the orientation of the back seat in relation with the axes of exercise of the exercise arms. This allows the user to have proper pad support for exercises such as shoulder presses, incline presses, neutral presses, decline presses, and pulling mid row exercises. By pivoting the seat assembly, the user is also able to have variations in seating for other exercises movements as well. The seat assembly comprises a seat main frame, a seat sub frame, and an adjustment and locking mechanism. In one embodiment, the seat sub frame is slidingly adjustable into the seat main frame and selectively positionable with a locking pin. The seat sub frame comprises a pivotally attached bottom seat that is angularly adjustable and one or more fixedly attached back pads. In one embodiment, a hold down roller assembly is also pivotally attached to the seat sub frame and will be discussed further below. In one embodiment, a leg extension and leg curl assembly is pivotally attached to the seat main frame. By pivotally adjusting the seat assembly, the user can raise and lower the pivot point of the leg extension and leg curl assembly in order to align their knee with the pivot point for standing leg curl exercises. This allows different height users to properly perform the standing leg curl exercises. Also, in one embodiment, a pair of arm pad assemblies is pivotally attached to the seat main frame and will be discussed further below. The user is able to unlock the seat assembly and pivot it back and forth depending on the exercise chosen to perform and then relock it into position. For example, the seat assembly would be pivoted all the way forward for shoulder press exercises. In one embodiment, the locking mechanism comprises two adjustment tubes that are pivotally attached to the seat main frame. The adjustment tubes are also slidingly positionable inside of two sleeves that are pivotally attached to the frame of the gym. In use, the user unlocks the two locking pins on the sleeves, adjusts the seat assembly to the desired position, and relocks the two locking pins.

In another aspect of the invention, a hold down assembly is positionable in front of the back pad during use, and positionable to a storage position when not in use. The hold down assembly is for holding down a user into a seated position during high pulley pull down exercises. In one embodiment, the hold down assembly is pivotally attached to the seat sub frame of the seat assembly. A locking pin on the seat sub frame secures the hold down assembly in a use position or a storage position. A roller assembly, which is part of the hold down assembly, is adjustable up and down for different sized users during pull down exercises. The roller assembly is also adjustable to a downward position for storage out of the way of the user during all other exercises on the multi-station gym. In use, the user positions the hold down assembly in front of the back seat and adjusts it to the proper height to wherein the roller pads will fit over top of the users thighs. The user then performs high pull down exercises as the hold down assembly secures them in a seated position. After use, the hold down assembly is positioned into a storage position so it will not interfere with other exercise stations or exercise movements.

In another aspect of the invention, an adjustable bicep curl pad assembly comprises a pair of adjustable arm pad assemblies that are positionable to the outsides of the back pad during use, and positionable to a storage position when not in use. The arm pads are for supporting a user's arms while performing seated bicep curls. In one embodiment, each respective arm pad assembly is pivotally attached to the seat main frame of the seat assembly. A respective locking pin secures the arm pad assemblies to the seat main frame in a use position or a storage position. In use, the user adjusts the arm pad assemblies to the outer position, sits on the seat assembly facing forward, grasps the handles connected to the two swiveling low pulley assemblies, positions the backs of the arms and elbows against the respective bicep curl pads, and performs seated bicep curls. When not in use, the user positions the arm pad assemblies to the storage position so they will not interfere with other exercise stations or other exercise movements.

In another aspect of the invention, the resistance load, a weight stack, is enhanced with an incremental weight system. In one embodiment, the incremental weight system comprises a bracket that has a respective weight storage pin on opposite sides of the weight stack. An equal amount of auxiliary weights are held on these storage pins. The incremental weight system also comprises a weight stack mounting assembly that is attached to the top plate of the weight stack. The weight stack mounting assembly comprises two weight mounting pins attached on opposite sides. In the rest position, each weight storage pin lines up with a respective weight mounting pin wherein the user can slide an auxiliary weight from the weight storage pin to the weight mounting pin. The user can transfer equal amounts of auxiliary weights on both sides of the weight stack in order to balance the load. For example, if the auxiliary weights were one pound each, the user could add two pounds to the weight stack by transferring one auxiliary weight on each side of the weight stack from the weight storage pin to the weight mounting pin. During use, because the load is balanced and that there is not an additional tracking system, the friction on the weight stack movement is minimized. To save on manufacturing costs, the bracket with the weight storage pins can be mounted directly to one or both of the weight stack shrouds.

DETAILED DESCRIPTION

Figure 1:
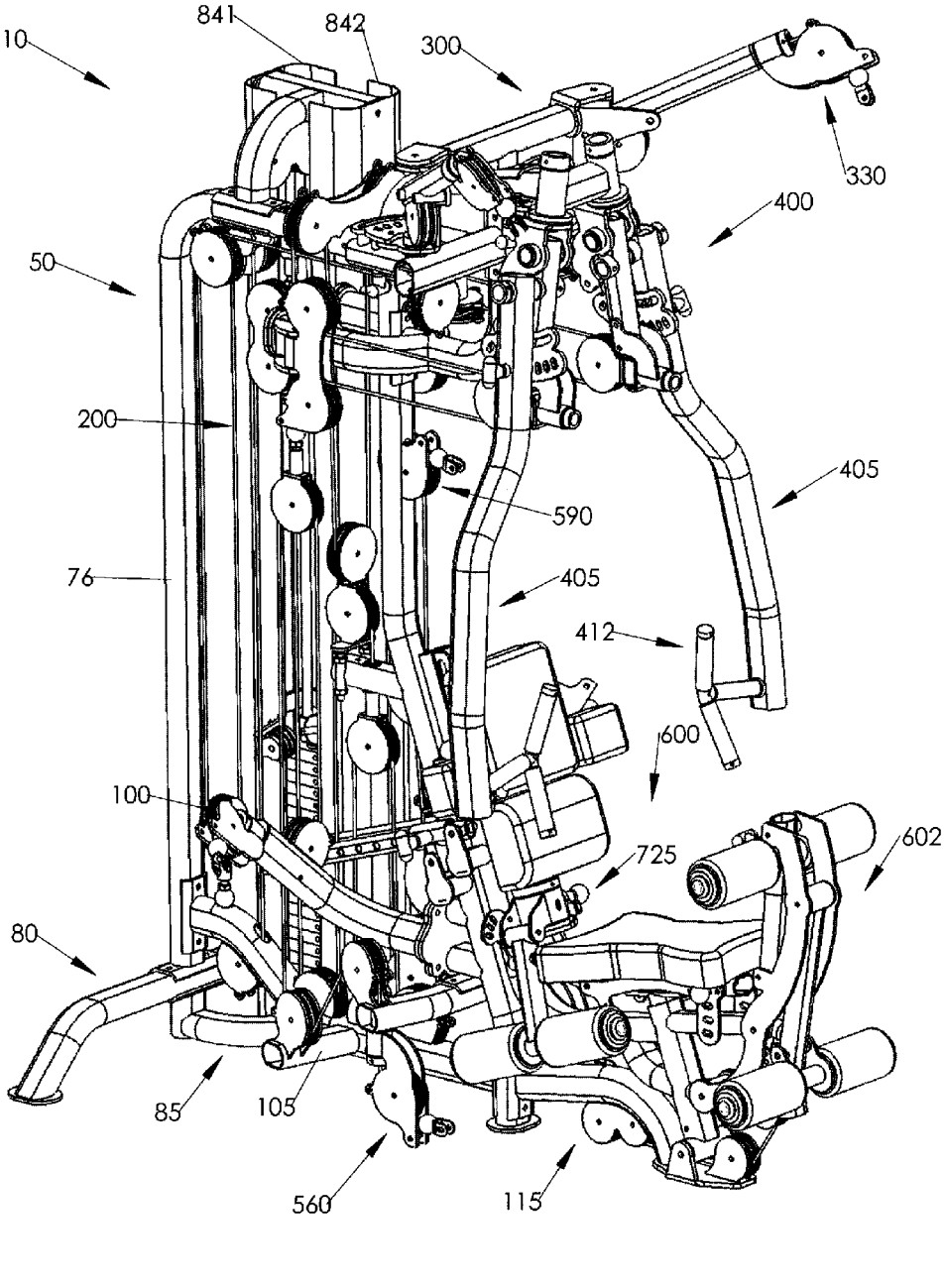
FIG. 1 is a perspective view illustrating an embodiment of the multi-station exercise gym according to the present invention from the front right side.
Figure 2:
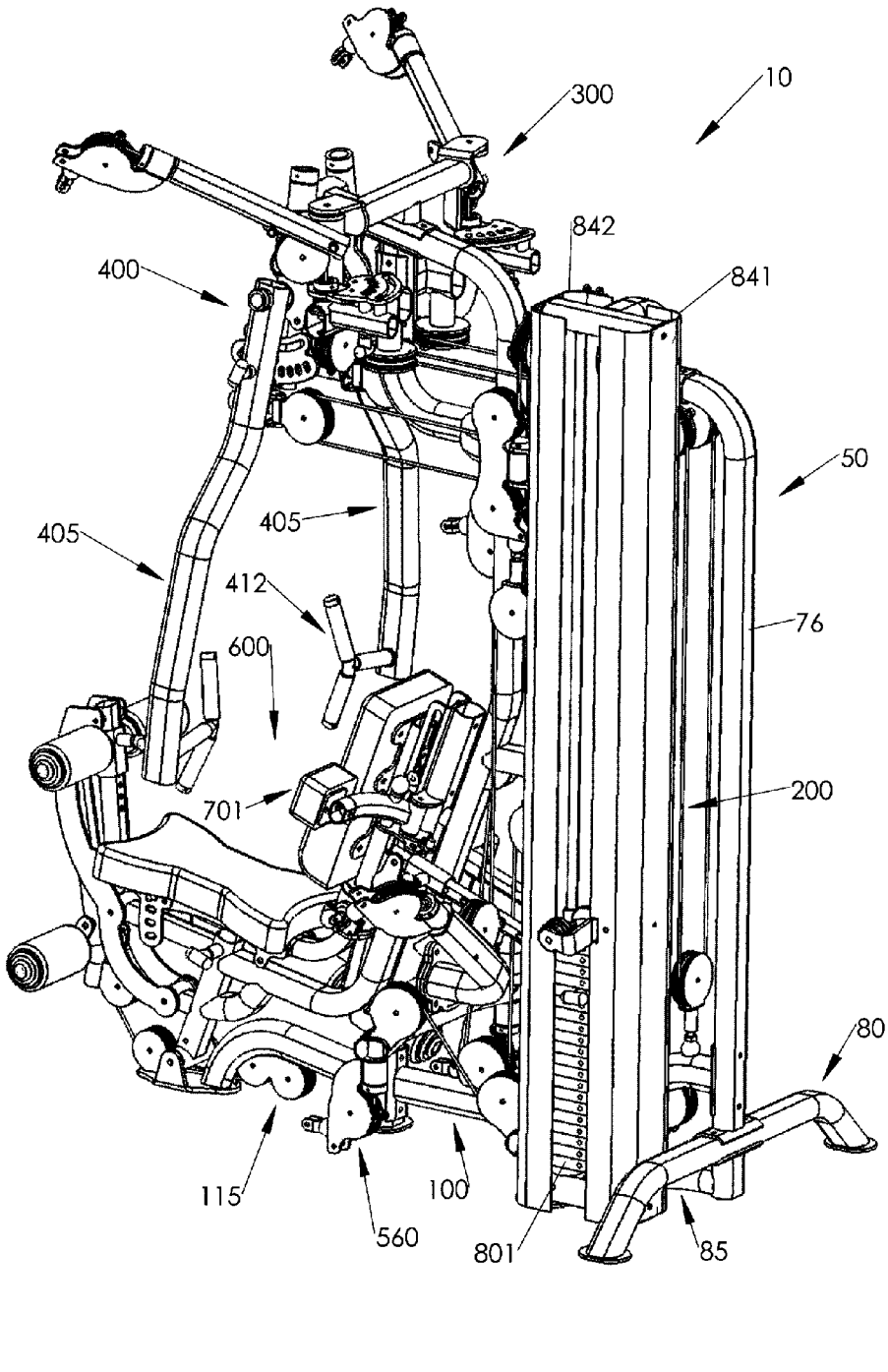
FIG. 2 is a perspective view illustrating an embodiment of the multi-station exercise gym according to the present invention from the back left side.
Figure 3:
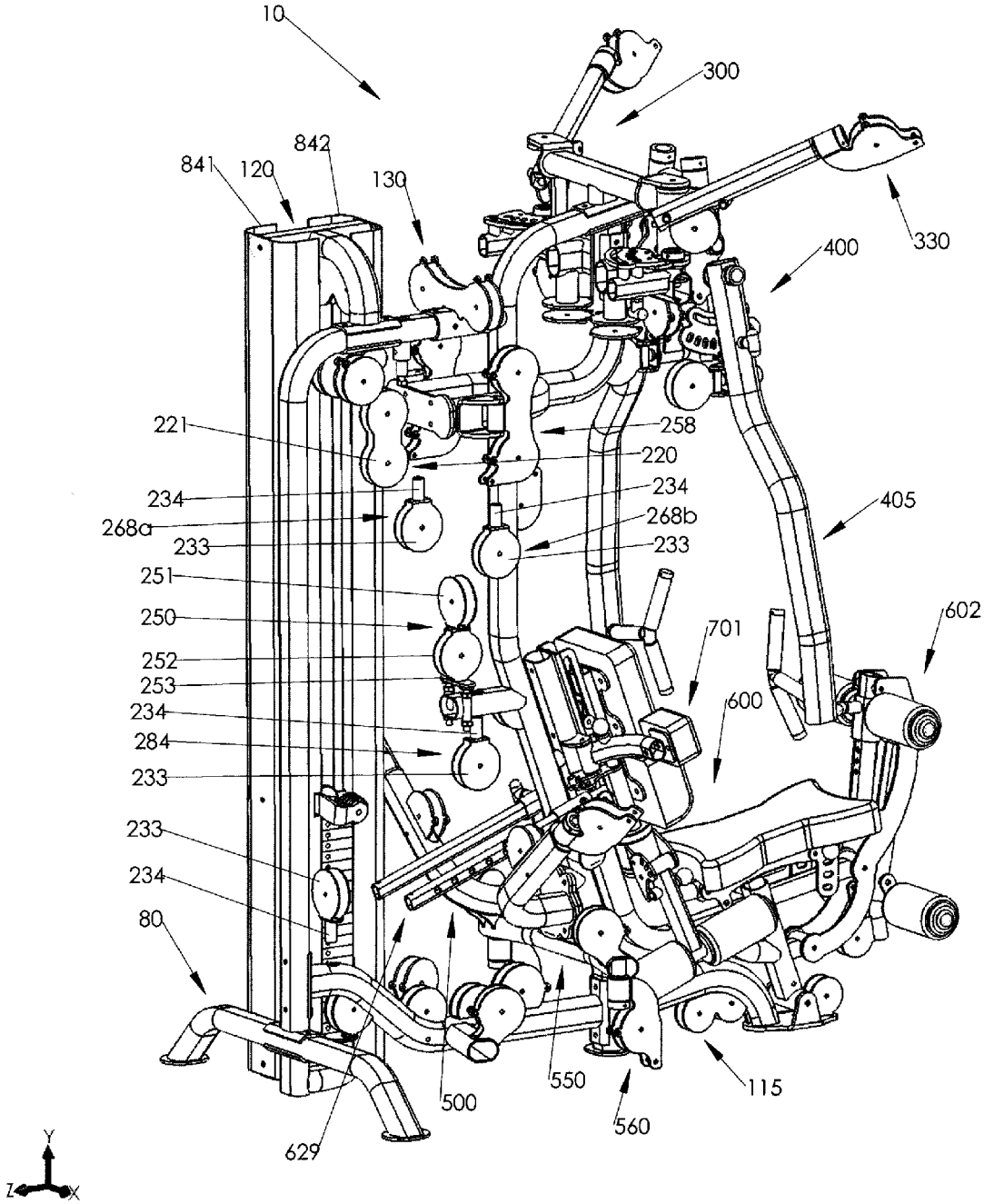
FIG. 3 is a perspective view illustrating an embodiment of the multi-station exercise gym from the back left side without the cables and pulleys.

Referring now to the drawings, a multi-station exercise gym according to the present invention is shown therein and indicated generally by the numeral 10. As shown in FIGS. 1-3, the multi-station exercise gym generally includes a frame 50 for supporting the gym, a width adjustable high pulley assembly 300 for various pull down exercises, a path adjustable arm assembly 400 for various pressing and pulling exercises, a mid pulley assembly 500 with swiveling outer pulleys for various pressing and pulling exercises, a low pulley assembly 550 with two swiveling low pulleys for pressing and pulling exercises, a centered mid pulley station 590 for various pressing and pulling exercises, a multi-positionable seat assembly 600 for supporting the user during various exercises, a leg extension and leg curl assembly 602, an adjustable hold down assembly 725 for retaining the user in the seated position during high pull down exercises, a bicep curl pad assembly 700 for supporting the user's arms during seated bicep curl exercises, a weight stack 800 or other resistance device for providing resistance for the exercises, an incremental weight system 820 for supplementing the resistance element 800, and a sectored cable system 200 interconnecting the exercise stations with the resistance element 800.

Figure 4:
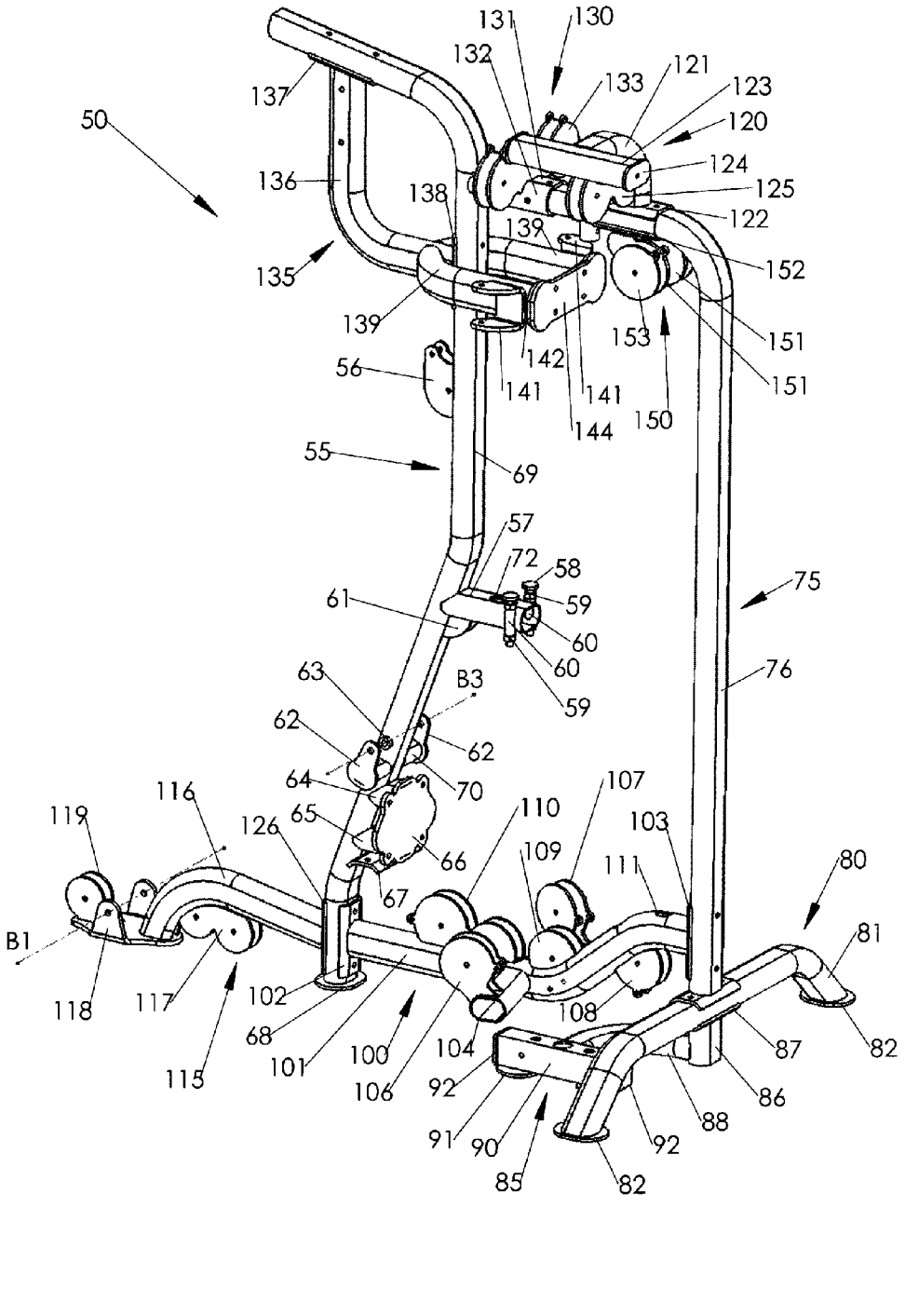
FIG. 4 is a perspective view illustrating the frame of the multi-station exercise gym from the back left side.
Figure 5:
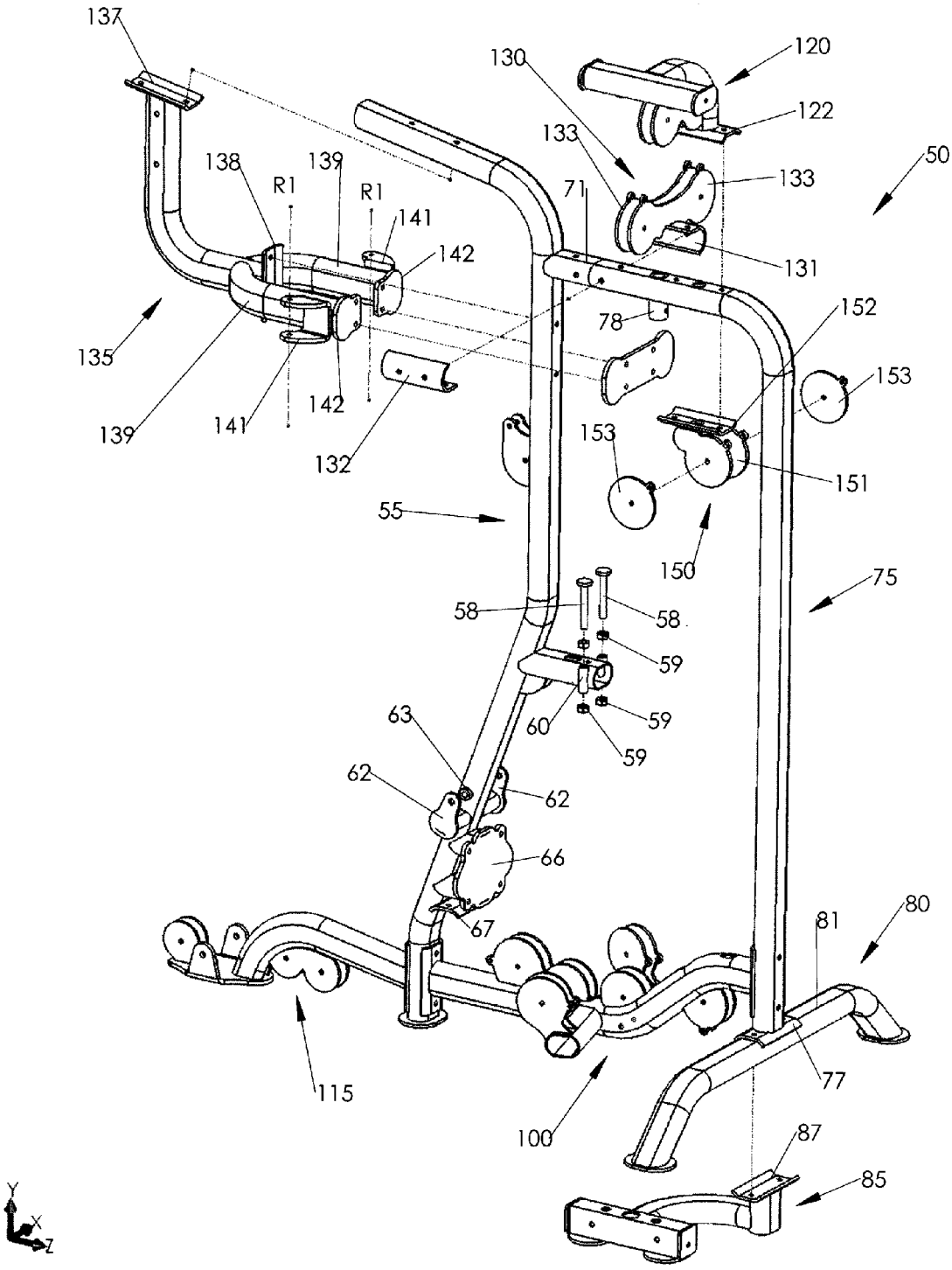
FIG. 5 is an exploded perspective view illustrating the frame of the multi-station exercise gym from the back left side.

The frame 50 provides structural support and stability to the multi-station exercise gym 10, connection points for pulleys and cable ends within the cable system 200, and connection points for mounting different exercise stations. The frame 50 may have a variety of configurations depending upon the specific application. In one embodiment, as shown in FIGS. 4 and 5, the frame 50 includes a bottom back support base 80 which comprises back base tube 81 and floor plates 82 attached on each bottom end.

The frame 50 further includes a back post assembly 75 which comprises a back post tube 76, a connection plate 77, and a cable adjustment housing 78. The back post assembly 75 extends upwardly and is located at the back of the multi-station exercise gym 10. The connection plate 77 is attached at the bottom end of back post tube 76 and connects to the bottom back support base 80. The cable adjustment housing 78 is attached at the top and near the other end of back post assembly 75 and provides a cable tension adjusting attachment point for part of the cable system 200.

The frame 50 further includes the weight stack bottom assembly 85 which is connected to the back support base 80 via a connection plate 87. Straight extension tube 86 is connected to connection plate 87 and extends downward, wherein bent extension tube 88 is connected to the front side and is generally parallel with the floor. Connection plate 89, (shown in FIG. 52), is connected to the other end of the bent extension tube 88 and is connected to stack bottom tube 90. A respective shroud connection plate 92 is attached to each end of stack bottom tube 90. Two floor plates 91 are attached to the bottom of stack bottom 90 near each outer end. The weight stack bottom assembly 85 provides a resting point for the weight stack assembly 800 (shown in FIG. 52).

The frame 50 further includes bottom middle base assembly 100, which comprises a bottom middle base tube 101 with a connection plate 102 attached at the front end and a connection plate 103 attached at the back end. Pulley tube 104, wherein pulley plates 106 are attached on top, is attached to the left side of bottom middle base tube 101. Pulley tube 105, (shown in FIG. 1), wherein pulley plates 107 are attached on top, is attached to the right side of bottom middle base tube 101. Pulley plates 108 are attached to the bottom middle base tube 101 underneath and near the back. Pulley plates 109 and pulley plates 110 are attached to the top of bottom middle base tube 101. Connection plate 103 attaches the bottom middle base assembly 100 to the back post assembly 75.

The frame 50 further includes the front pole assembly 55 which extends upwardly and is connected to the bottom middle base assembly 100 at connection plate 102. The front pole assembly 55 comprises front pole tube 69 wherein floor plate 68 is attached on the bottom end. Connection tube 71 is attached on the back side and near the top of front pole 69 and serves as a joining point with back post assembly 75. Pulley plates 56 are attached to the front side of front pole tube 69 approximately two thirds of the way up. Lock out tube 57 and braces 61 are attached to the back side of front pole 69 approximately in the middle. The lock out tube 57 comprises levelers 58, leveler nuts 59, and leveler housings 60 and provides two locking points within the cable system 200 and will be discussed in more detail later. Attached approximately one quarter of the way up front pole 69 is sleeve 63, which is labeled with an axis of rotation B3, extension tubes 70, and hinge plates 62 which provide a pivot point for the seat assembly adjustment mechanism 629, and will be discussed in more detail later. Attached near the bottom of front pole 69 is extension tube 64, extension tube 65, connection plate 66, and connection plate 67 which provides connection points for the mid pulley assembly 500 and the low pulley assembly 550 which will be discussed in more detail later.

The frame 50 further includes a bottom front base assembly 115, which comprises a bottom front base tube 116 wherein a connection plate 126 is attached on one end. The other end of bottom front base tube 116 is attached to the top of front base plate 118. Pulley plates 119 are attached on top of front base plate 118. Front base plate 118 provides a pivot point with an axis or rotation labeled B1 for seat assembly 600 which is discussed in more detail later. Pulley plates 117 are attached on the bottom side of bottom front base tube 116. The bottom front base assembly 115 is connected to the front pole assembly 55 at connection plate 126.

Figure 52:
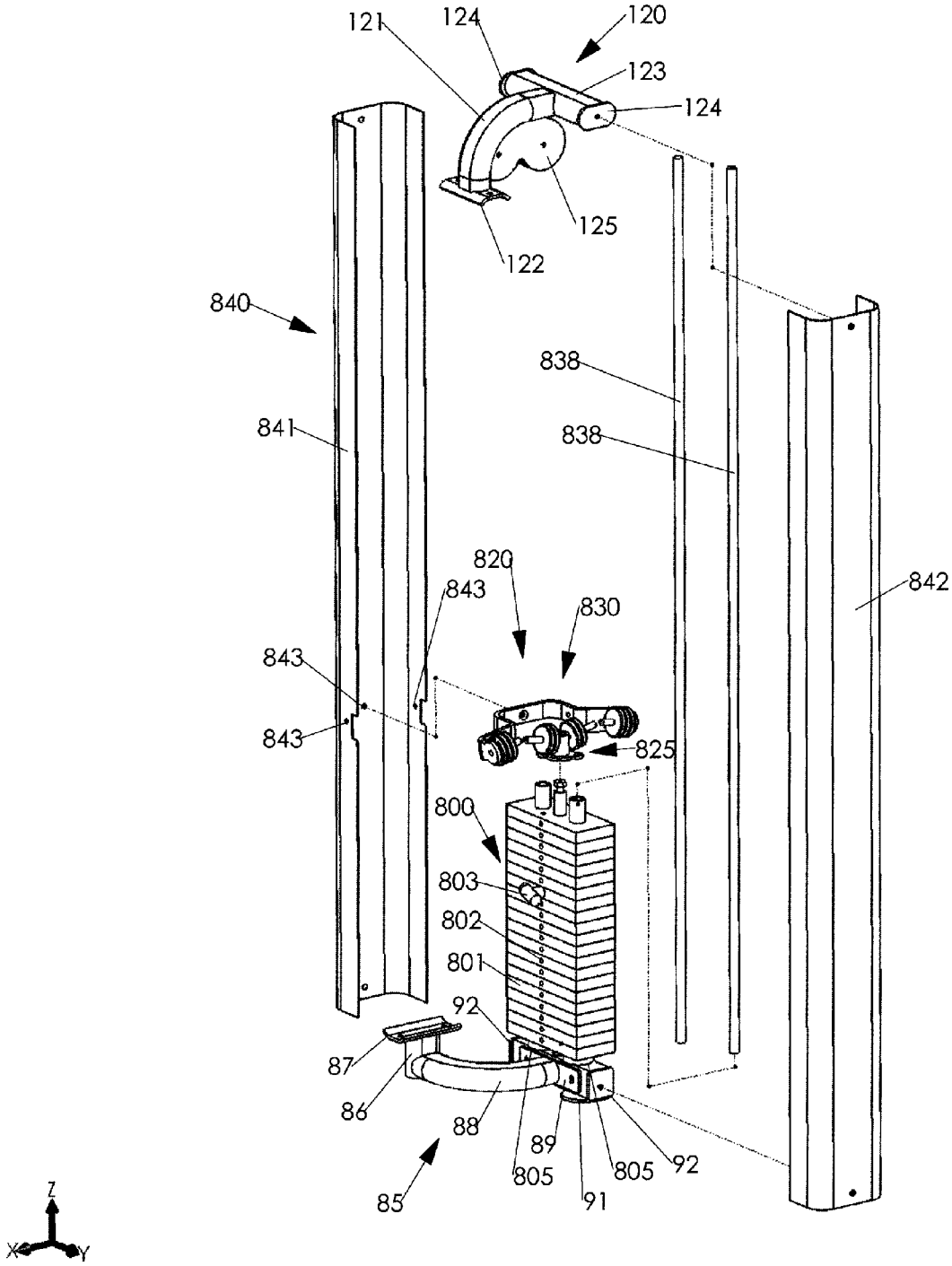
FIG. 52 is an exploded perspective view illustrating a portion of the frame, the weight stack shrouds, the weight stack, the guide rods, and one embodiment of the incremental weight system.

The frame 50 further includes a guide rod top assembly 120 which is attached to the top of back support post 75 and provides an upper attachment point for the weight stack assembly 800 (shown in FIG. 52). The guide rod top assembly 120 comprises a bent support tube 121 wherein a connection plate 122 is attached on one end and a guide rod tube 123 is attached to the other end. Shroud connection plates 124 are attached to the outer ends of guide rod tube 123. Pulley plates 125 are attached underneath the bent support tube 121.

The frame 50 further includes a connection bracket assembly 130 which comprises connection bracket 131, connection bracket 132, and pulley plates 133 and connects the front pole assembly 55 with the back post assembly 75.

The frame further includes a guide pulley assembly 150 that guides a cable towards the width adjustable high pulley assembly 300. The guide pulley assembly 150 comprises pulley plates 151 which are attached to connection plate 152, which is connected to the back support post 75 underneath the guide rod top assembly 120. Pulley cover plates 153 are attached to the outsides of two pulleys (not shown) on the outsides of guide pulley assembly 150.

The frame further includes a front pole support assembly 135 which is connected to the front pole assembly 55. The front pole support assembly 135 comprises a front support tube 136 wherein a connection plate 137 is attached at the upper end, and a connection plate 138 is attached at the other end. A guide pulley support tube 139 is attached on the left and right side of the front support tube 136. A respective guide pulley swivel bracket 141 is attached at an outer end of a respective guide pulley support tube 139. An end plate 142 is attached to the end of each guide pulley support tube 139. Backing plate 144 connects the outer ends of the guide pulley support tubes 139.

Figure 6:
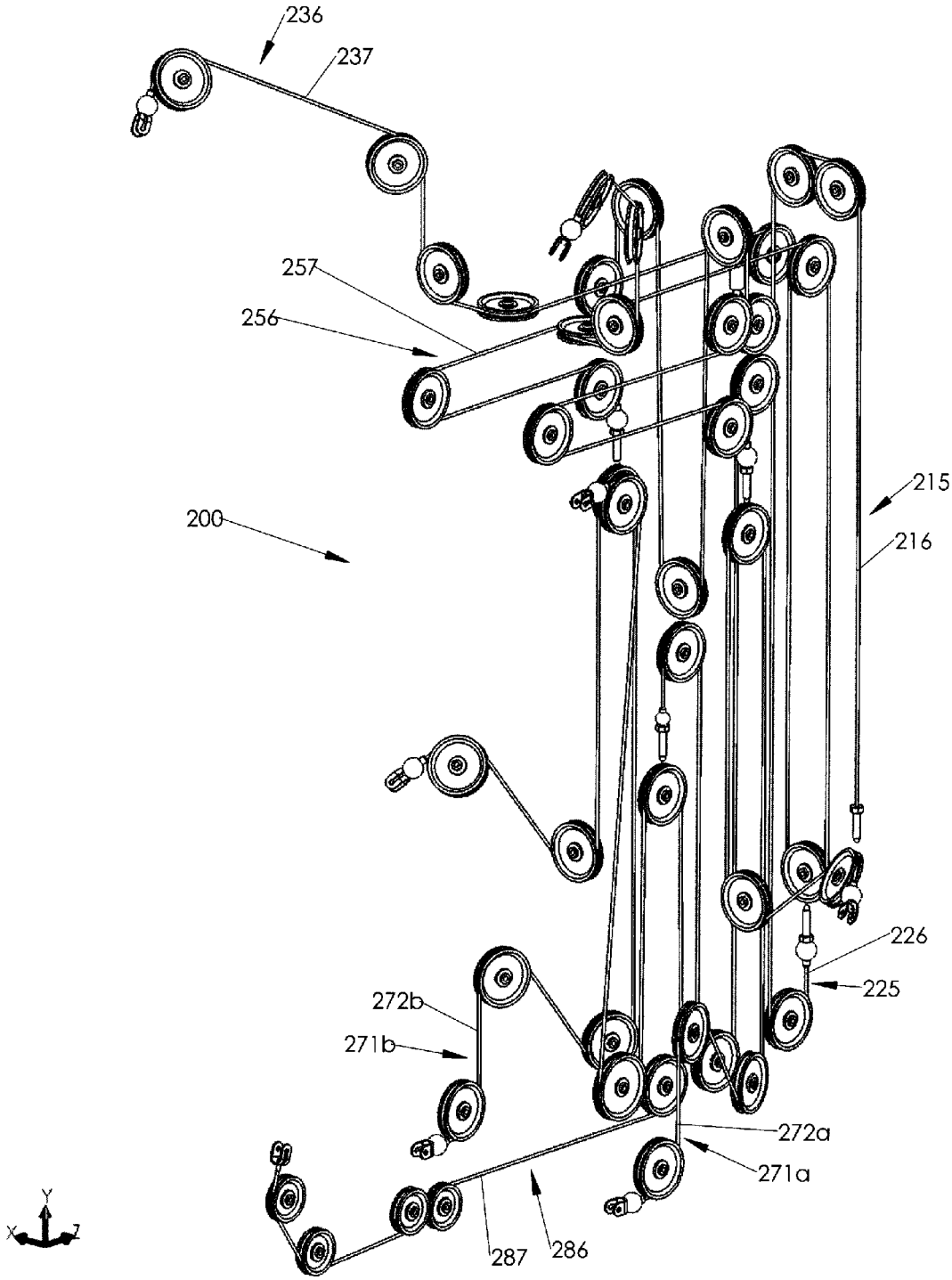
FIG. 6 is a perspective view illustrating an embodiment of the cable and pulley system of the multi-station exercise gym from the front left side.
Figure 7:
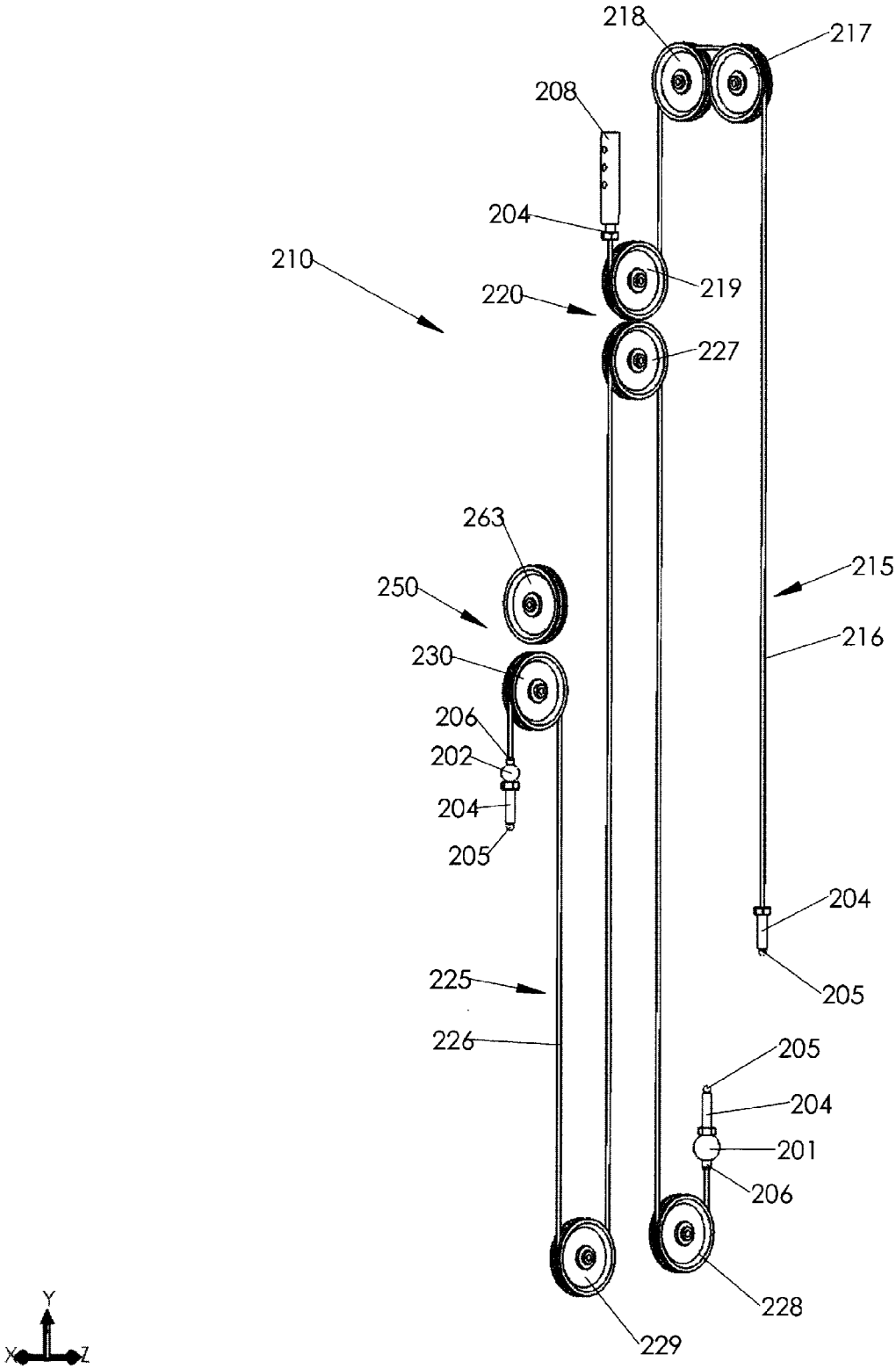
FIG. 7 is a perspective view illustrating an embodiment of the main sector of the cable system from the front right side.

A sectored cable and pulley system 200 is illustrated in FIG. 6. The sectored cable system 200 reduces the cable portion used during exercises thus minimizing cable stretch. In one embodiment, there is one main sector and four sub-sectors. In one embodiment, as illustrated in FIG. 7, the main sector 210 comprises cable assembly 215 and cable assembly 225. Cable assembly 215 comprises cable 216 which includes adjustment bolt 204, which threads into the weight stack assembly 800 (shown in FIG. 52), and locking shank ball 205 on one end, and adjustment bolt 204, locking shank ball 205 (not shown), and adjustment rod 208 on the other end which is secured into the adjustment cable housing 78 on the frame 50. Cable 216 passes around fixed pulleys 217 and 218 and around free floating pulley 219 in double free floater 220. Cable assembly 225 comprises cable 226 which includes adjustment bolt 204, locking shank ball 205, locking ball 201, and ball stop 206 on one end, and adjustment bolt 204, locking shank ball 205, locking ball 202, and ball stop 206 on the other end. Cable 226 passes around fixed pulley 228, free floating pulley 227, fixed pulley 229, and free floating pulley 230. One end of cable assembly 225 passes through hole 111 (shown in FIG. 4) of the bottom middle support base 100 on frame 50, wherein locking ball 201 only allows upward travel of this end of the cable 226. The other end of cable 226 passes through hole 72 (shown in FIG. 4) of the front pole assembly 55, wherein locking ball 202 only allows downward travel of this end of the cable 226.

The main sector 210 is active during the use of any exercise station on the multi-station exercise gym 10. To activate the main sector 210, cable assembly 225 must be pulled in one of three directions. First, the end of cable assembly 225 which has locking ball 201 must be pulled in an upward direction. The locking ball 201 rests against the bottom middle support base 100 on frame 50 and can only travel in an upward direction. Second, the end of cable assembly 225 which has locking ball 202 must be pulled in a downward direction. The locking ball 202 rests against lock out tube 57 on front pole assembly 55 and can only travel in a downward direction. Third, pulley 230, which is part of double free floater 250, must be pulled in an upward direction. Double free floater 250 rests against levelers 58 on front pole assembly 55 and can only travel in an upward direction. When cable assembly 225 is pulled in one of these three directions, double free floater 220 is pulled in a downward direction wherein cable assembly 215 will raise the weight stack, thus providing resistance to the user.

Figure 8:
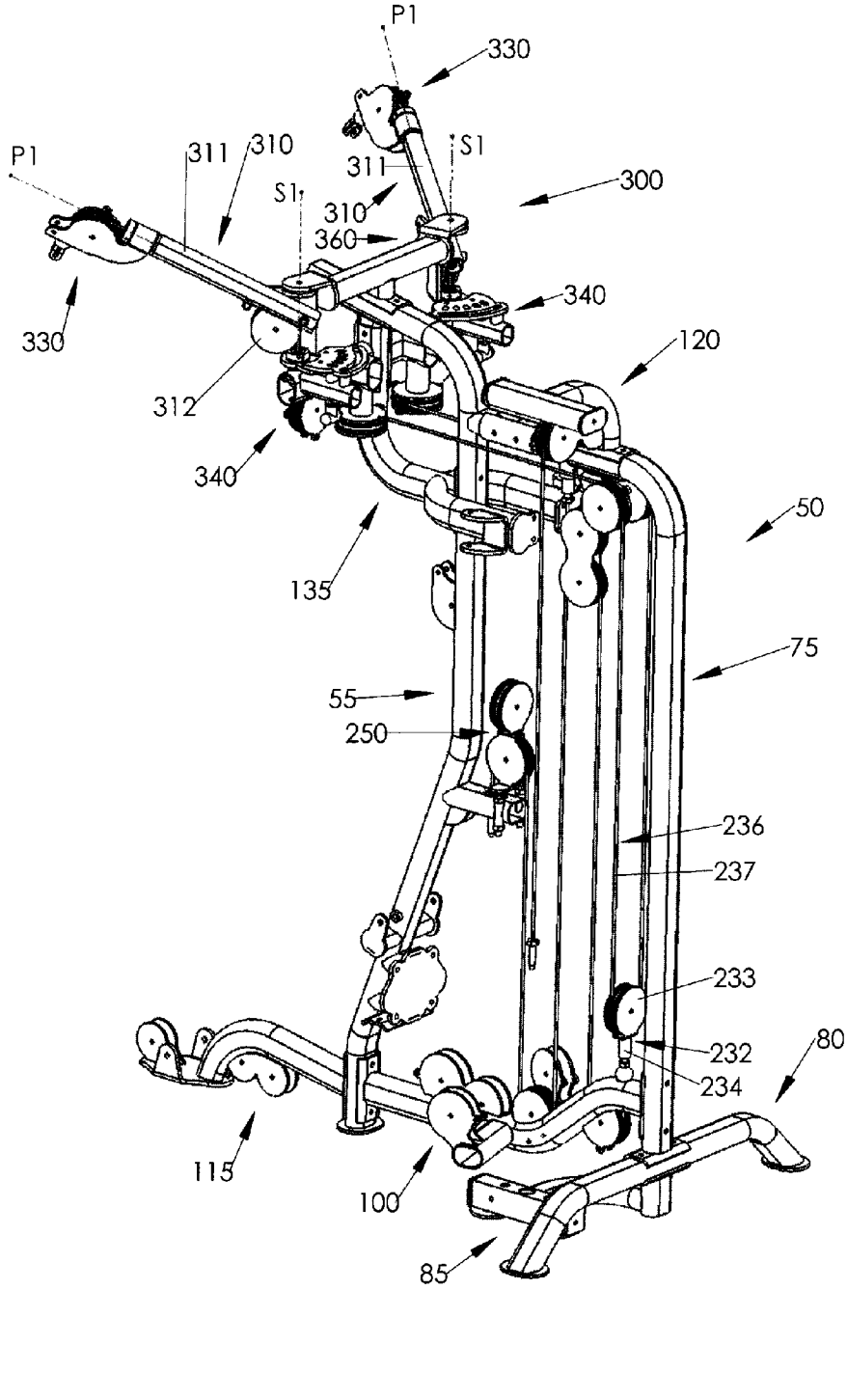
FIG. 8 is a perspective view illustrating the frame, a width adjustable high pulley assembly, the main cable sector, and the first sub-sector of the cable system.
Figure 9:
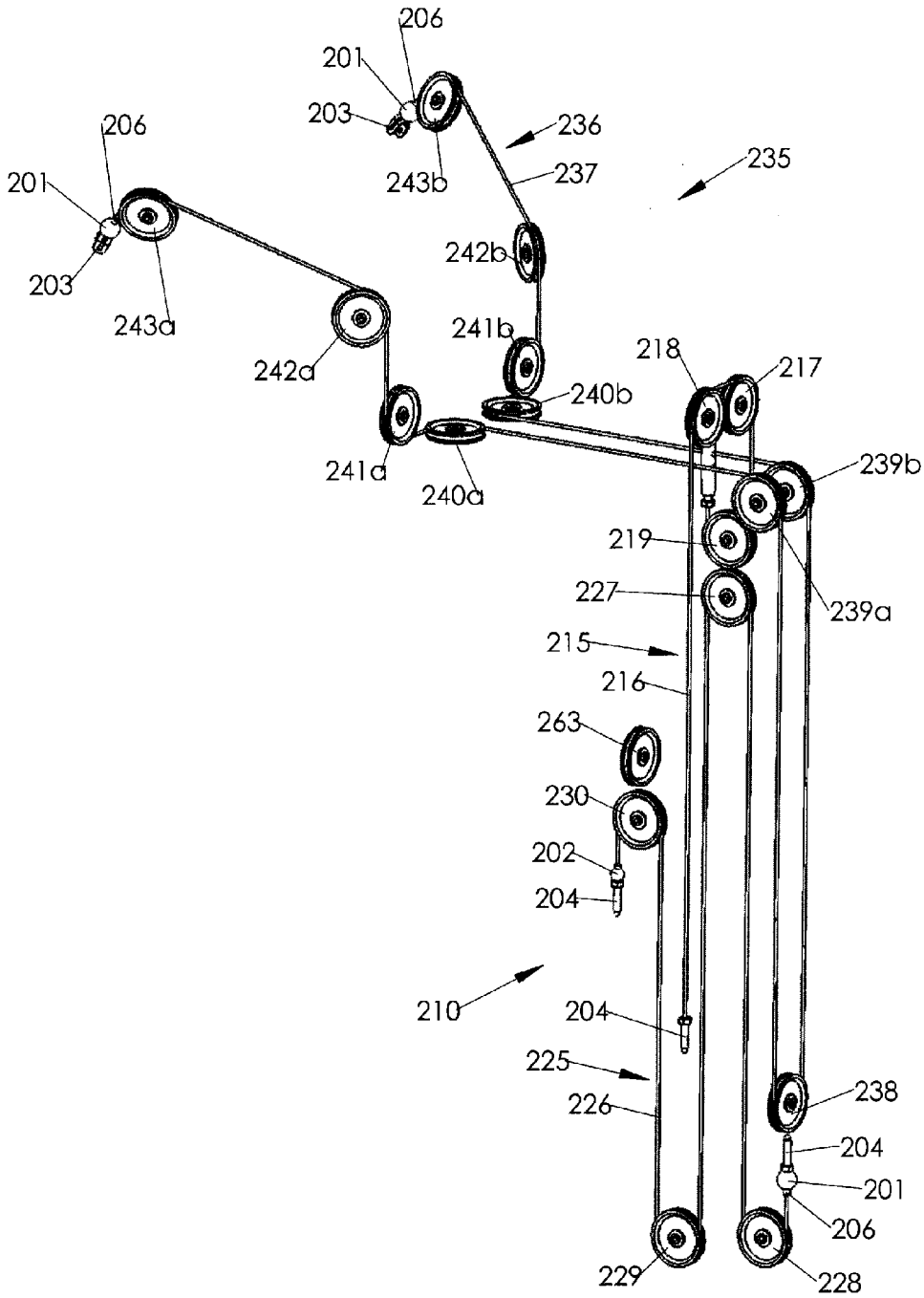
FIG. 9 is a perspective view illustrating the main cable sector and the first sub-sector of the cable system.
Figure 10:
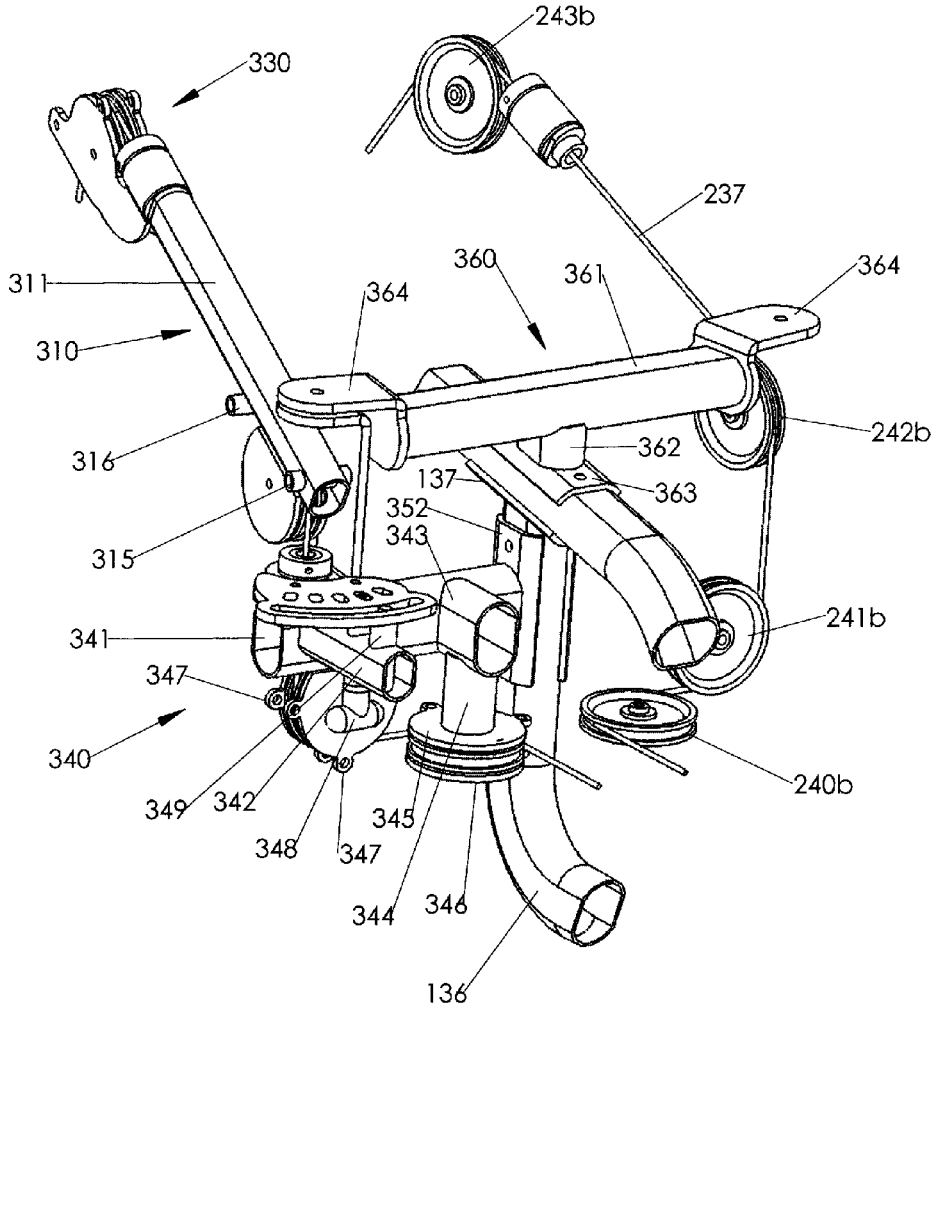
FIG. 10 is a perspective view illustrating a portion of the width adjustable high pulley assembly and a portion of the first sub-sector of the cable system.
Figure 11:
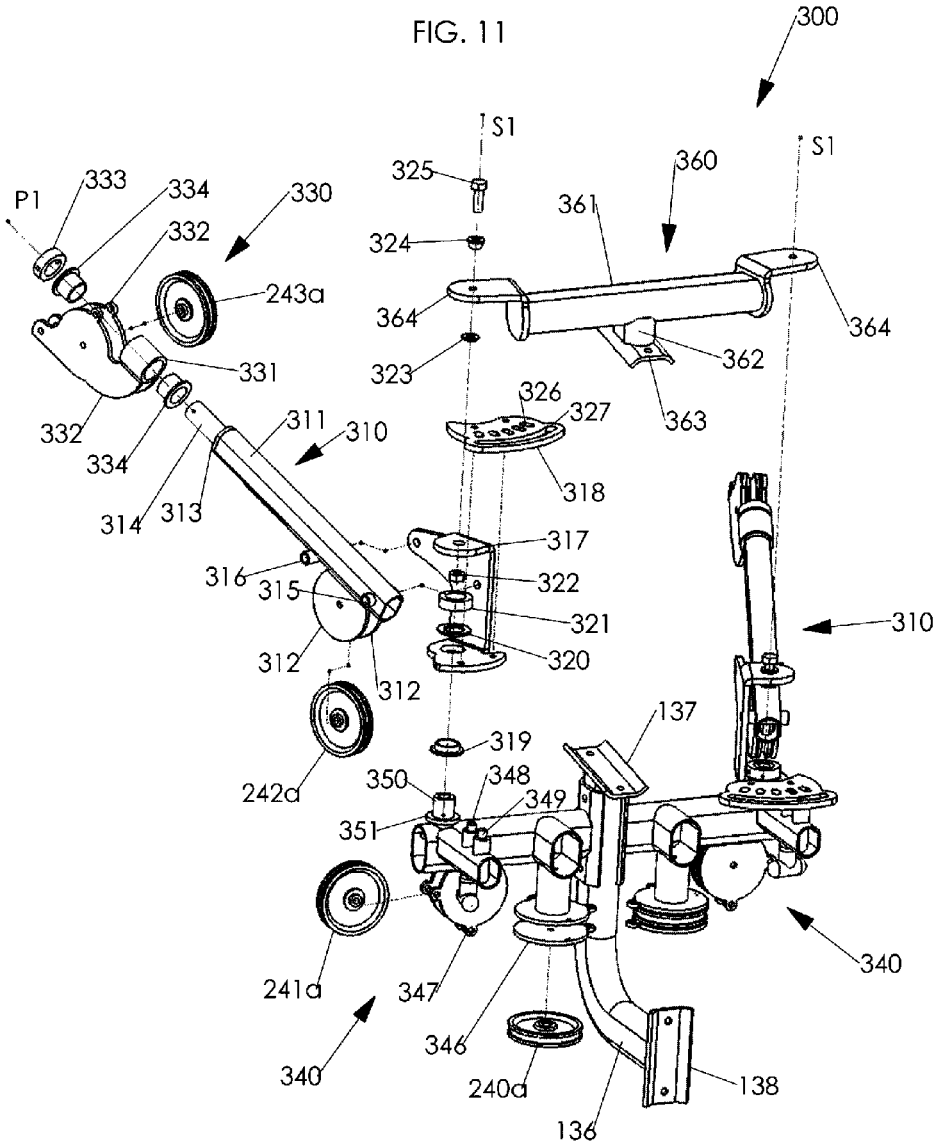
FIG. 11 is an exploded perspective view illustrating the width adjustable high pulley assembly.

FIGS. 8 and 9 illustrates the first sub-sector 235 in cable system 200, which comprises cable assembly 236. Cable assembly 236 interconnects a width adjustable high pulley assembly 300 with the main cable sector 210, therefore, connecting it to resistance. Since the first sub-sector 235 interconnects the width adjustable high pulley assembly 300 with the resistance element 800, the two will be discussed together.

Illustrated in FIGS. 8-11, the width adjustable high pulley assembly 300 provides a variety of wide to narrow high pull down exercises, wherein the width adjustments are made prior to use by the user. In one embodiment, the width adjustable high pulley assembly 300 comprises left and right sides wherein a respective side includes a pivot base assembly 340, a swivel boom assembly 310, and a swivel pulley assembly 330.

The pivot base assembly 340 provides a pivot base for the swivel boom assembly 310, attachment means for two guide pulleys, and attachment means for a locking pin and a slot restrictor pin and is now described in more detail. The left pivot base assembly 340 comprises an extension tube 341 which is attached to connection plate 352 which is connected to the front support tube 136 of the front pole support assembly 135. Pulley plate 345, which aligns pulley 240*a* and pulley cover plate 346, is attached to extension tube 344 which is attached to extension tube 343 which is attached to extension tube 341. Pulley plates 347, which align pulley 241*a*, are attached to extension tube 341. Locking pin 348, which is received by apertures 326 in high pull selector plate 318, and restricting slot pin 349, which is received by slot 327 in high pull selector plate 318, are attached to extension tube 342 which is attached to extension tube 341. Hollow axle 350 and bushing base 351 are also attached to extension tube 341. Hollow axle 350 provides a bottom pivot point, with an axis of rotation labeled S1, for the swivel boom assembly 310 as well as a path through the hollow center for cable 237 of cable assembly 236.

The swivel boom assembly 310 is pivotally adjustable over the user's head and provides an attachment means for a guide pulley and a swivel pulley assembly 330 and is now described in more detail. The swivel boom assembly 310 comprises a swivel bracket 317, which is fitted with bushing 319 and sleeve bushing 320, that is pivotally attached to the pivot base assembly 340 and is rotatable about axis S1. The swivel bracket 317 is secured with axle collar 321. High pull selector plate 318 has a plurality of holes 326 and a slot 327 formed therein and is attached to swivel bracket 317.

The swivel boom assembly 310 further includes boom tube 311 wherein pulley plates 312 are attached on one end and axle plate 313 and hollow axle 314 are attached on the other end. Hollow axle 314 provides a pivot point, with an axis of rotation labeled P1, for swivel pulley assembly 330. The pulley plates 312 align pulley 242*a*. Sleeves 315 and 316 are attached to boom tube 311 and provide attachment points for the boom tube 311 with the swivel bracket 317.

The swivel pulley assembly 330 provides a pulley that maintains cable alignment in any direction the user pulls during exercise as well as any width position the swivel boom assembly 310 is adjusted to and is now described in more detail. The swivel pulley assembly 330 comprises a sleeve 331, with two pulley plates 332 attached, which is fitted with bushings 334 and is secured to swivel boom assembly 310 by collar 333. Pulley 243*a* fits between pulley plates 332. The swivel pulley assembly 330 is rotatable about axis P1.

The width adjustable high pulley assembly 300 further includes a high pulley straight brace assembly 360 which pivotally secures the upper portion of the swivel boom assemblies 310 with bolts 325, bushings 324, sleeve bushings 323, and nuts 322. The high pulley straight brace assembly 360 comprises brackets 364 which are attached at opposite ends of horizontal tube 361. Connection plate 363 is attached to vertical tube 362 which is attached to horizontal tube 361. The high pulley straight brace assembly 360 attaches to the front pole assembly 55 opposite to where the front pole support assembly 135 is connected.

Free floater 232, which comprises pulley bracket 233 and adjustment rod 234, is where the first sub-sector 235 ties into the main sector 210 at one end of cable assembly 225. Cable 237 passes around pulley 238 in free floater 232, then around fixed pulleys 239*a* and 239*b* on guide pulley assembly 150, then around fixed pulleys 240*a*, 240*b*, 241*a*, and 241*b* on the pivot base assemblies 340. The cable 237 then goes up through hollow axles 350 and therefore is collinear with axes S1. This allows the cable tension to remain constant when the swivel boom assemblies 310 are adjusted. The cable 237 then goes around swiveling pulleys 242*a* and 242*b* on the swivel boom assemblies 310, then around swiveling pulleys 243*a* and 243*b* on the swivel pulley assemblies 330. The ends of cable 237 may comprise locking balls 201, ball stops 206, locking shank balls 205 (not shown), and straps 203.

To exercise with the width adjustable high pulley assembly 300, the user unlocks locking pins 348, adjusts the swivel boom assemblies to the desired width, and relocks locking pins 348 into the desired apertures 326. The user then makes the desired adjustments to the seat assembly 600 and the hold down assembly 725 which will be discussed in more detail later. The desired resistance is selected from the resistance element 800 and the incremental weight system 820, which will be discussed in more detail later. The user than pulls down on the handles (not shown) attached to the straps 203 on the ends of cable 237. This causes cable assembly 236 to pull one end of cable assembly 225 of the main cable sector 210 upward, which raises the weight stack and gives resistance. No other sub-sector in the cable system 200 is activated because locking ball 202 of cable assembly 225 and double free floater 250 being braced against levelers 58 prevent the transfer of cable pull.

Figure 12:
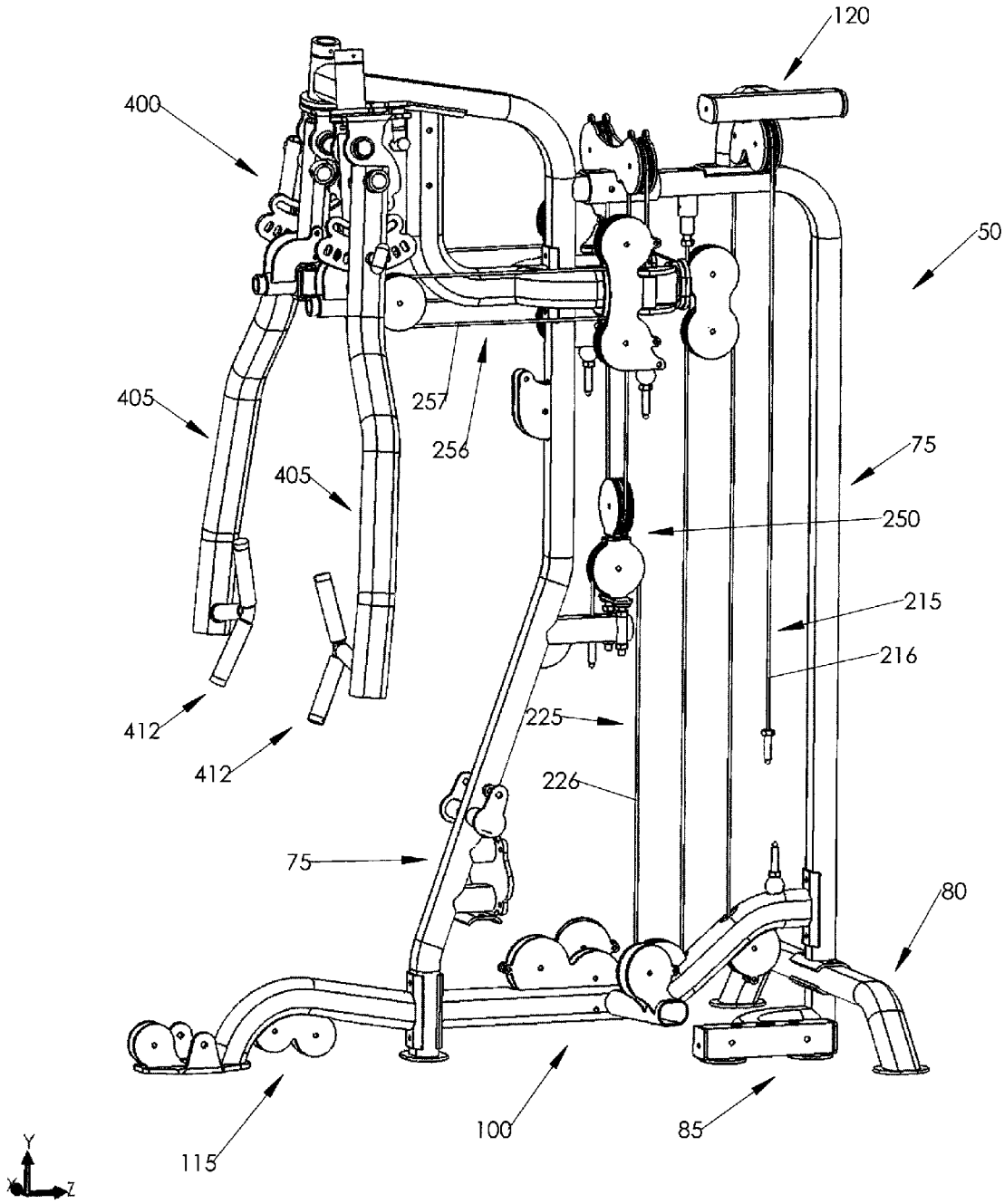
FIG. 12 is a perspective view illustrating the frame, a path adjustable arm assembly, the main cable sector, and the second sub-sector of the cable system.
Figure 13:
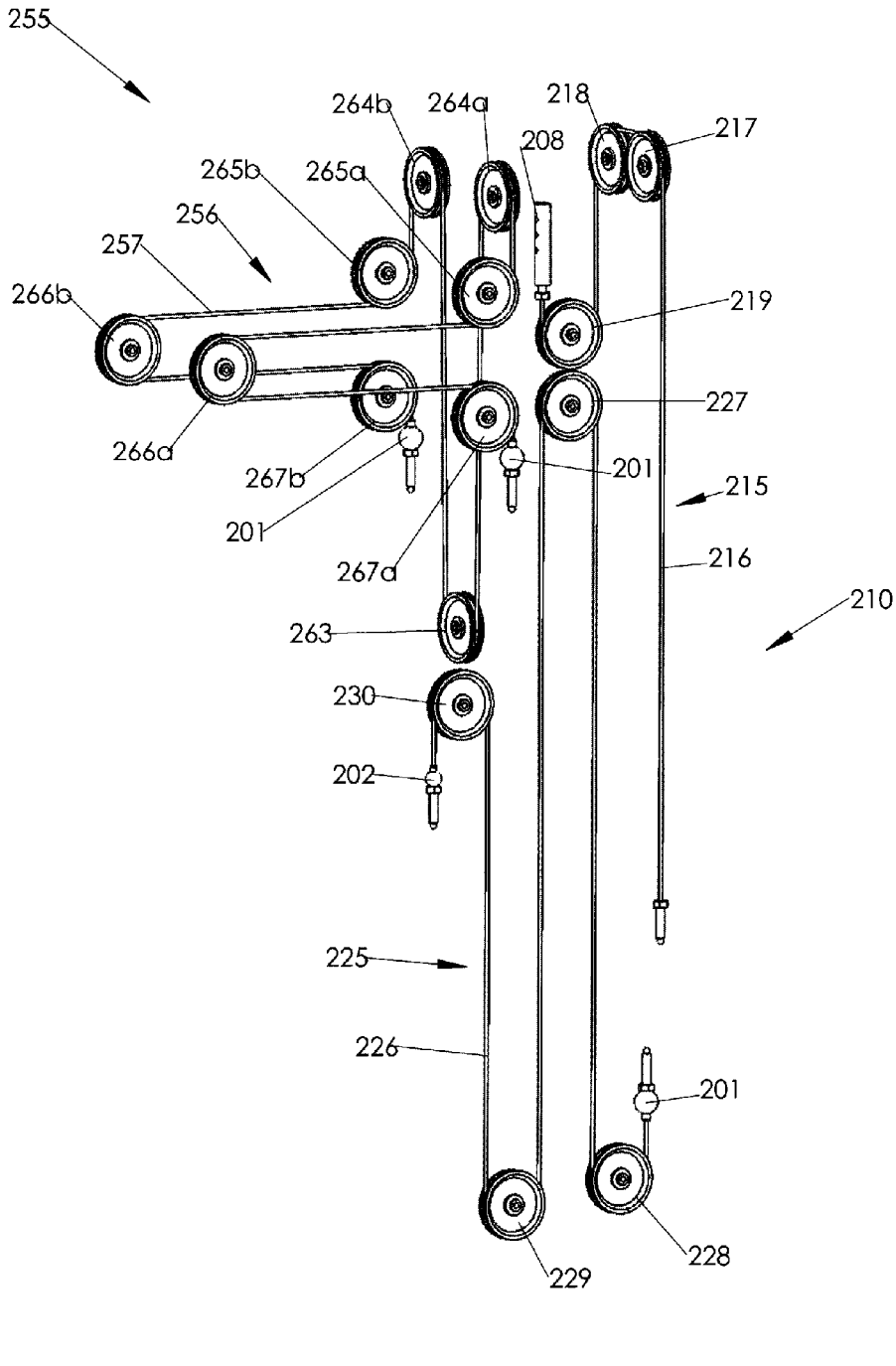
FIG. 13 is a perspective view illustrating the main cable sector and the second sub-sector of the cable system.
Figure 14:
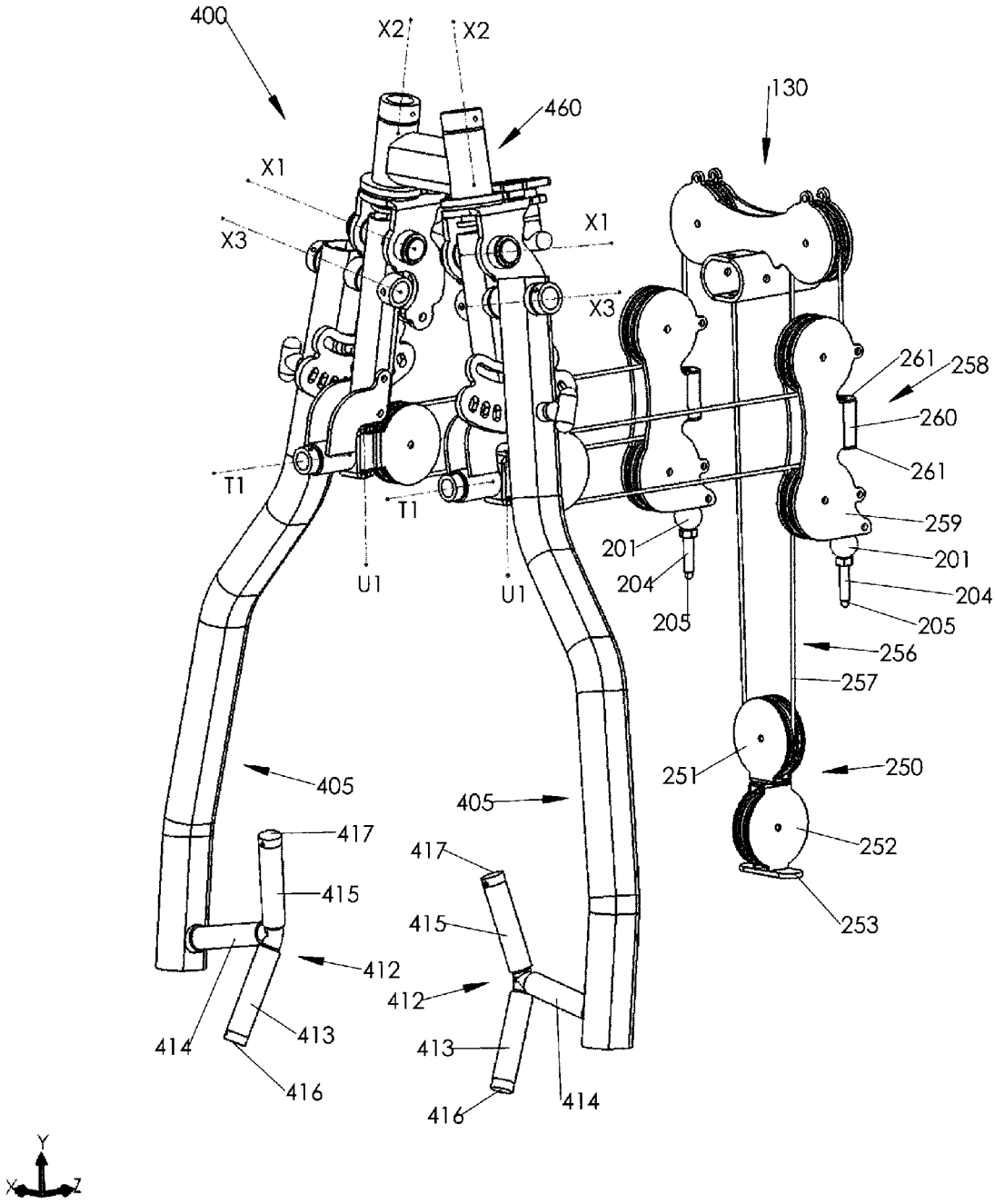
FIG. 14 is a perspective view illustrating the path adjustable arm assembly, a pair of guide pulley swivel assemblies, and the second sub-sector of the cable system.
Figure 15:
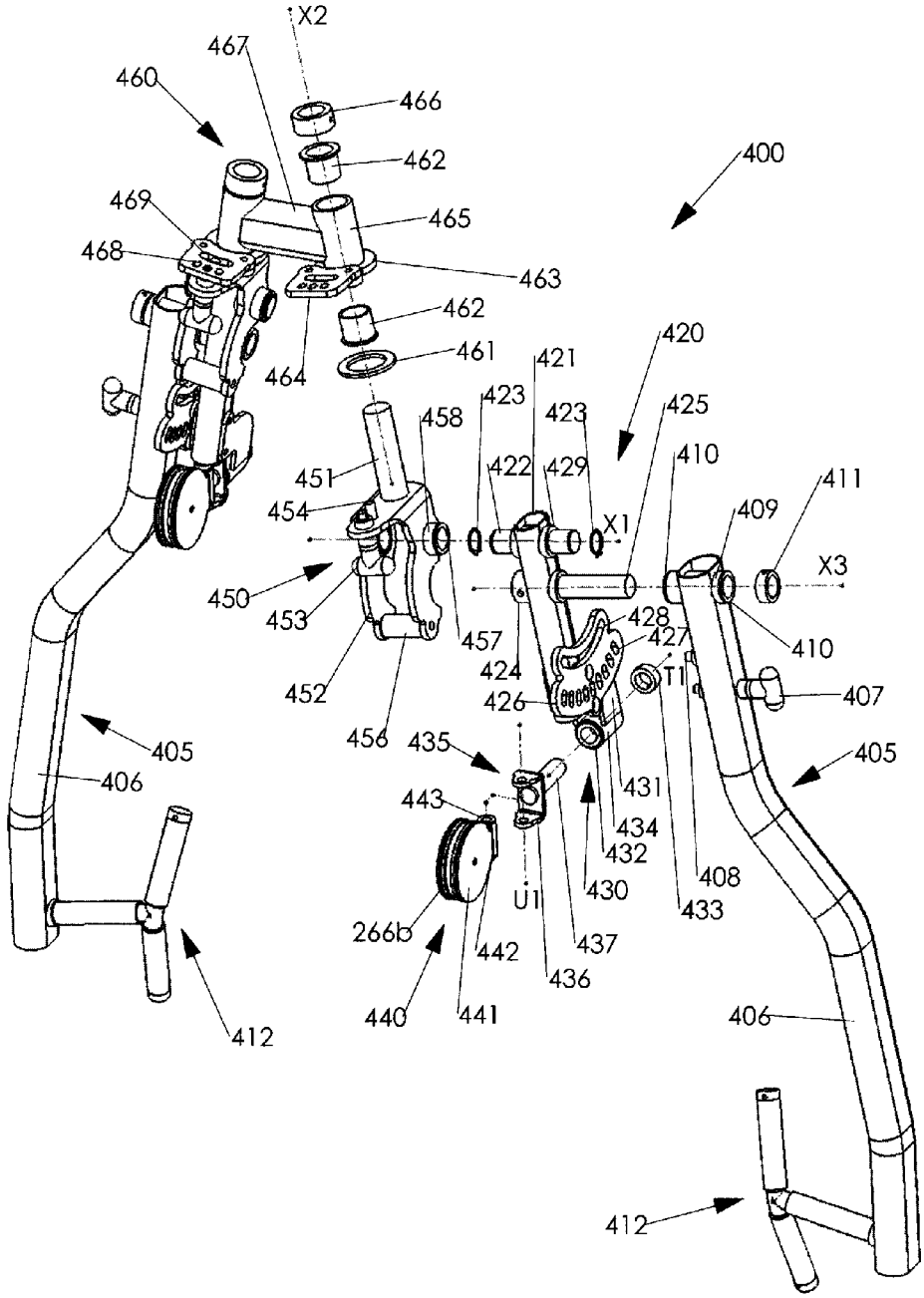
FIG. 15 is an exploded perspective view illustrating the path adjustable arm assembly.

FIGS. 12 and 13 illustrates the second sub-sector 255 in cable system 200, which comprises cable assembly 256. Cable assembly 256 interconnects a path adjustable arm assembly 400 with the main cable sector 210, therefore, connecting it to resistance. Since the second sub-sector 255 interconnects the path adjustable arm assembly 400 with the resistance element 800, the two will be discussed together.

Illustrated in FIGS. 12-15, the path adjustable arm assembly 400 provides a variety of pressing and pulling exercise movements for the user. Also, the arm assemblies 405 may be adjusted to follow alternate paths such as neutral, converging, and diverging. These adjustments are made prior to use by the user. In one embodiment, the path adjustable arm assembly 400 comprises left and right sides wherein a respective side includes a lever arm assembly 405, a main arm assembly 420, and a swivel assembly 450. The path adjustable arm assembly 400 also includes an arm top assembly 460.

The lever arm assembly 405 provides a lever arm that is angularly adjustable for pressing and pulling exercises and is now described in more detail. The right lever arm assembly 405 comprises a lever arm 406 wherein a handle assembly 412 is attached at one end for grasping by the user during exercise. The handle assembly 412 comprises grips 413, 414, and 415 and collars 416 and 417 to retain the grips. Attached at the other end of lever arm 406 is sleeve 409 which is fitted with bushings 410. Also attached at this end is locking pin 407 and slot restrictor pin 408.

The main arm assembly 420 provides the pivot axis during exercise, the pivot axis and a selector plate for adjusting the angle of the lever arm 406, and connects with resistance via a sleeve assembly that retains a swivel pulley and swivel mount, and is now described in more detail. The main arm assembly 420 comprises an arm tube 421 wherein sleeves 429 and 424 are attached at one end. Shaft 422 fits into sleeve 429 and is labeled with and axis of rotation X1. Shaft 425 fits into sleeve 424 and is labeled with an axis of rotation X3. Attached to the other end of the adjustable arm assembly 420 is a sleeve assembly 430 which comprises a sleeve 434, which is fitted with bushings 432, and attached to mounting plates 431. Swivel mount 435 comprises a shaft 437, with an axis of rotation labeled T1, and a bracket 436, which has apertures with an axis of rotation labeled U1. Swivel mount 435 slides into sleeve assembly 430, is secured by collar 433, and is rotable about axis T1. The swivel pulley assembly 440 comprises a sleeve 442, which is fitted with bushings 443, and attached to pulley bracket 441 which retains pulley 266*b*. The swivel pulley assembly 440 is pivotally attached to the swivel mount 435 and rotatable about axis U1. Also attached to the main arm assembly 420 is an arm selector plate 426 which has a plurality of apertures 427 and a slot 428 formed therein.

The lever arm assembly 405 is pivotally attached to the main arm assembly 420 and rotatable about axis X3. The user can adjust the angle of the lever arm assembly 405 by unlocking locking pin 407, pivoting the lever arm assembly 405 to the desired angle, and relocking locking pin 407 into one of the apertures 427 in arm selector plate 426. Slot restrictor pin 408 is received by slot 428 in arm selector plate 426 and limits the range of adjustment of the lever arm assembly 405.

The swivel assembly 450 provides means for the rotational adjustment of the main arm assembly 420 and the lever arm assembly 405, thus changing the path of exercise, and is now described in more detail. The swivel assembly 450 comprises a shaft 451 with an axis of rotation labeled X2. A bracket 452 which includes locking pin 453 and slot restrictor pin 454 is attached to one end of shaft 451. Sleeves 458 are attached on opposite sides of bracket 452 and are fitted with bushings 457. The main arm assembly 420 is pivotally attached in bushings 457 and is rotatable about axis X1. Snap rings 423 retain main arm assembly 420 into the swivel assembly 450. Bumper 456 is attached at the bottom of bracket 452 and provides a rest position for main arm assembly 420.

The path adjustable arm assembly 400 also includes an arm top assembly 460 that provides attachment points for the swivel assemblies 450, and is now described in more detail. The arm top assembly comprises cross member 467 which provides an attachment point to the front pole assembly 55 of the frame 50. Sleeves 465, which are fitted with bushings 462, are attached to the outsides of cross member 467. Bottom plates 463 are attached to the bottom of sleeves 465 and provide attachment points for top selector plates 464. A respective sleeve bushing 461 is positioned below a respective bottom plate 463. Each respective swivel assembly 450 is pivotally attached to a respective sleeve 463, is rotatable about a respective axis X2, and is secured by a respective collar 466. The user can adjust the path setting of the swivel assembly 450 by unlocking locking pin 453, pivoting the swivel assembly 450 to the desired setting, and relocking locking pin 453 into one of the apertures 468 in top selector plate 464. Slot restrictor pin 454 is received by slot 469 in top selector plate 464 and limits the range of adjustment of the swivel assembly 450.

Double free floater 250, which comprises pulley brackets 251, 252, and leveler plate 253, is where the second sub-sector 255 ties into the main sector 210. Cable 257 passes around pulley 263 of double free floater 250, then around fixed pulleys 264*a* and 264*b* on connection bracket assembly 130. Cable 257 then passes around swiveling pulleys 265*a* and 265*b* which are attached to a respective guide pulley swivel assembly 258. Each respective guide pulley swivel assembly 258 comprises a sleeve 260, which is fitted with bushings 261, and is pivotally attached to a respective guide pulley swivel bracket 141 on frame 50 and is rotatable about a respective axis labeled R1. Cable 257 then passes around swiveling pulleys 266*a* and 266*b* which are attached to a respective swivel pulley assembly 440. Cable 257 then passes around swiveling pulleys 267*a* and 267*b* which are attached to a respective guide pulley swivel assembly 258. The ends of cable 257 may comprise locking balls 201, ball stops 206, locking shank balls 205, and adjustment bolts 204.

To exercise with the path adjustable arm assembly 400, the user adjusts the lever arm assemblies 405 to the desired angle as previously mentioned and then adjusts the swivel assemblies 450 to the desired arm path travel as previously mentioned. The user then makes the desired adjustments to the seat assembly 600 which will be discussed in more detail later. The desired resistance is selected from the resistance element 800 and the incremental weight system 820, which will be discussed in more detail later. The user then presses or pulls the lever arm assemblies 405. This causes cable assembly 256 to pull pulley 230 of the main cable sector 210 upward, which raises the weight stack and gives resistance. No other sub-sector in the cable system 200 is activated because the two locking balls 201 of cable assembly 256 and locking balls 202 and 201 of cable assembly 225 prevent the transfer of cable pull. Also, in order for the cable assembly 256 to maintain alignment during the pre-selected path adjustment and during alternate paths of exercise for the arm assemblies 405, the guide pulley swivel assemblies 258 rotate about axes R1, the swivel pulley assemblies 440 rotate about axes U1, and the swivel mounts 435 rotate about axes T1 to align with one another.

Figure 16:
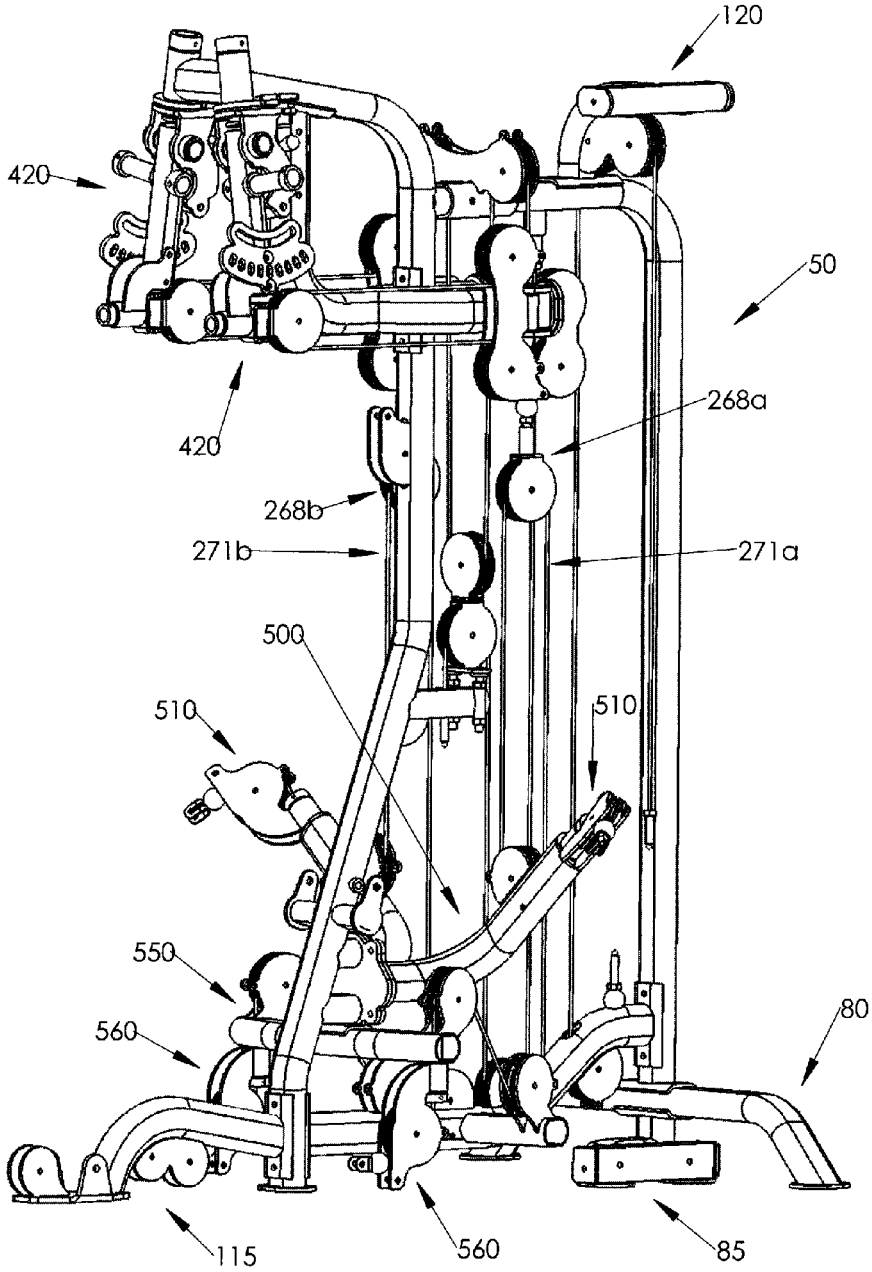
FIG. 16 is a perspective view illustrating the frame, a portion of the path adjustable arm assembly, a mid pulley assembly with swiveling outer pulleys, a low pulley assembly with swiveling low pulleys, the main cable sector, the second sub-sector of the cable system, and the third sub-sector of the cable system.
Figure 16:
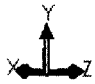
Figure 17:
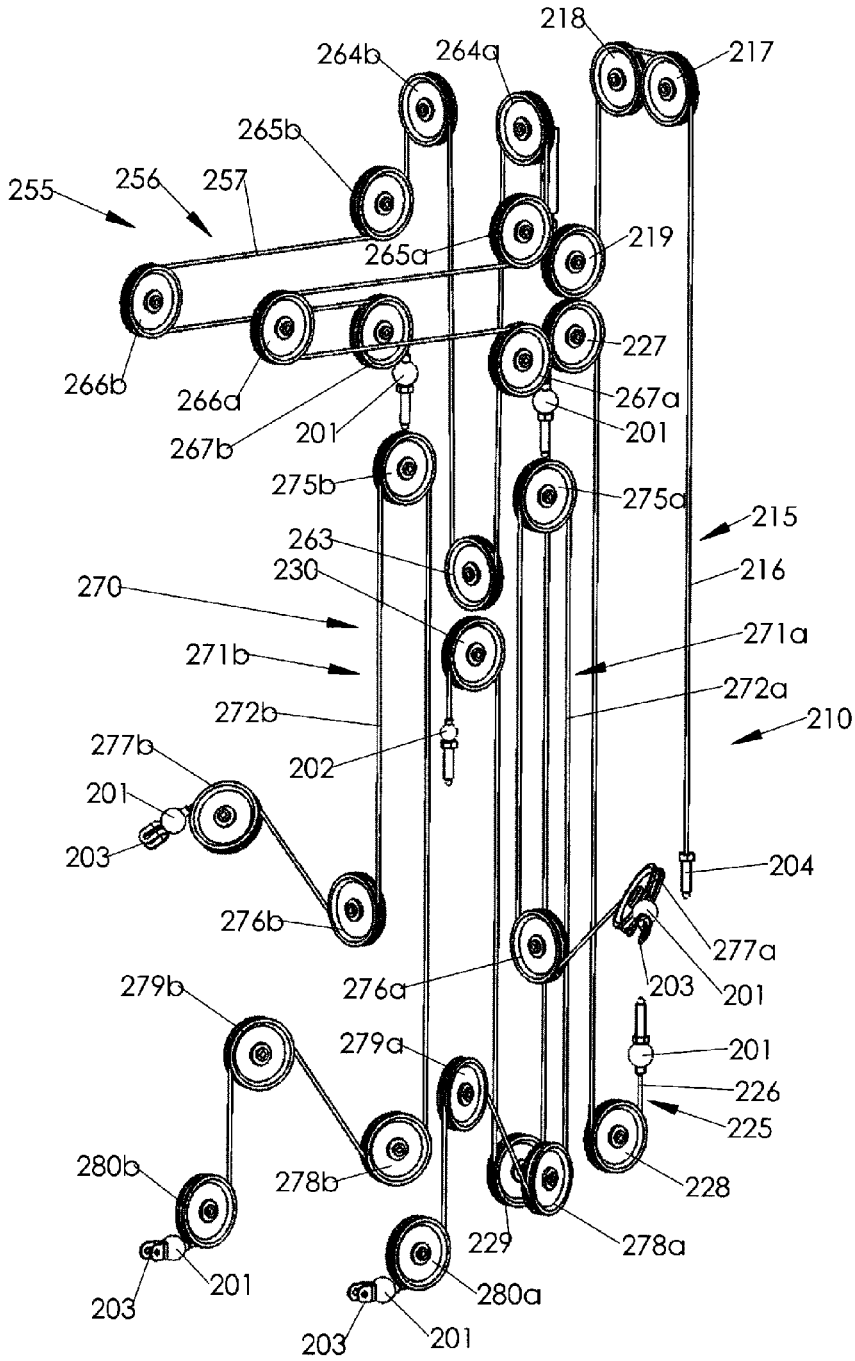
FIG. 17 is a perspective view illustrating the main cable sector, the second sub-sector of the cable system, and the third sub-sector of the cable system.
Figure 17:
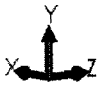

FIGS. 16 and 17 illustrates the third sub-sector 270 in cable system 200, which comprises two cable assemblies, 271*a* and 271*b*. Cable assemblies 271*a* and 271*b* interconnects mid pulley assembly 500 and low pulley assembly 550 with the second sub-sector 255 of the cable system 200, which as previously described, is connected to the main cable sector 210, therefore, connecting the third sub-sector 270 to resistance. Since the third sub-sector 270 interconnects the mid pulley assembly 500 and the low pulley assembly 550 with the resistance element 800, the three will be discussed together.

Figure 18:
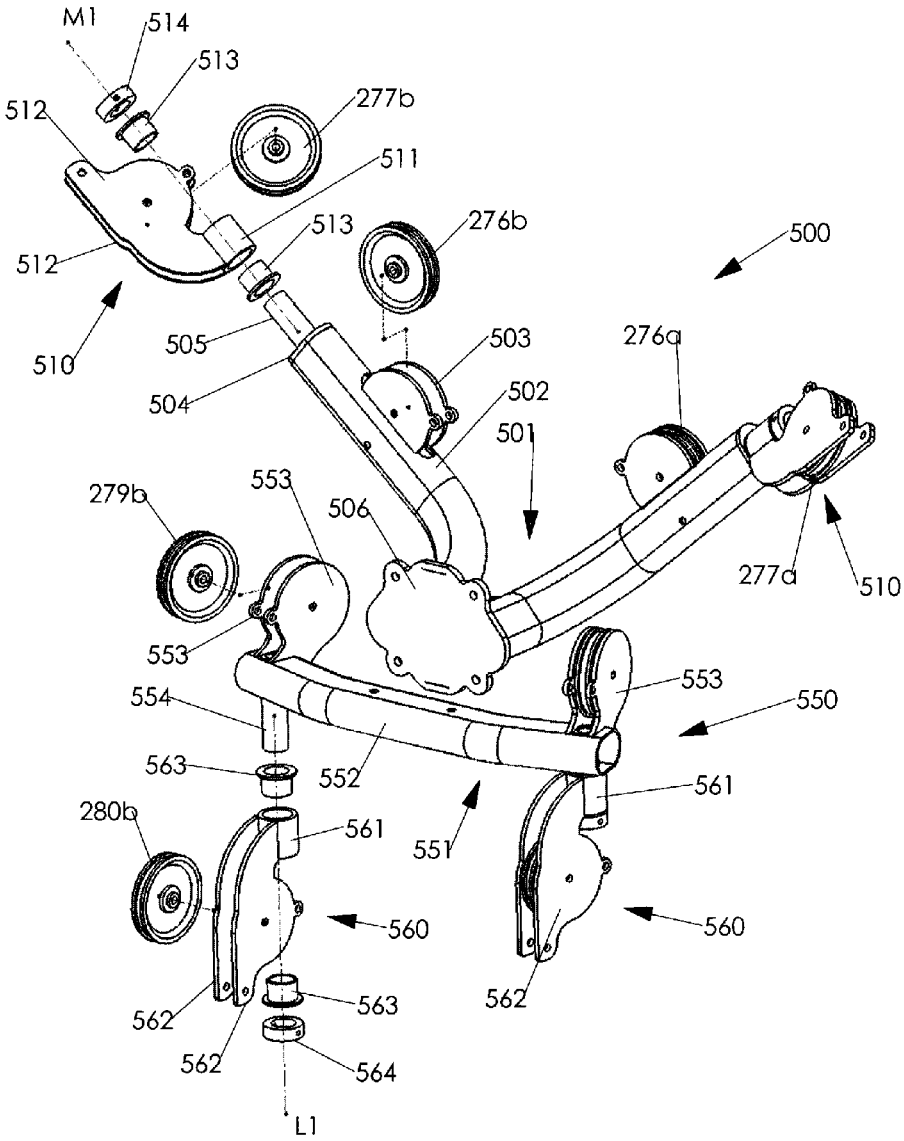
FIG. 18 is an exploded perspective view illustrating the mid pulley assembly with swiveling outer pulleys and the low pulley assembly with swiveling low pulleys.
Figure 18:
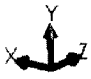

Illustrated in FIGS. 16-18, the mid pulley assembly 500 provides a variety of pressing and pulling exercise movements for the user. The mid pulley assembly 500 comprises a mid pulley frame assembly 501 and two swivel pulley assemblies 510.

The mid pulley frame assembly 501 provides attachment means for two swivel pulley assemblies 510 as well as two guide pulleys and is now described in more detail. The mid pulley frame assembly 501 comprises bent arm tubes 502 which are attached to connection plate 506. Respective pulley plates 503 are attached to respective bent arm tubes 502. Pulleys 276*a* and 276*b* are attached to respective pulley plates 503. Respective axle plates 504 and respective hollow axles 505 are attached at one end of respective bent arm tubes 502. A respective hollow axle 504 provides a pivot point, with an axis of rotation labeled M1, for a respective swivel pulley assembly 510, as well as a path through the hollow center for a respective cable 272 of the third sub-sector of cable system 200. The mid pulley frame assembly 501 attaches to connection plate 66 of the front pole assembly 55.

Each respective swivel pulley assembly 510 provides a pulley that maintains cable alignment in any direction the user presses or pulls during exercise and is now described in more detail. The swivel pulley assembly 510 comprises sleeve 511, with two pulley plates 512 attached, which is fitted with bushings 513 and is secured to the mid pulley frame assembly 501 by collar 514. Pulley 277*b* fits between pulley plates 512. The swivel pulley assembly 510 is rotatable about axis M1.

Illustrated in FIGS. 16-18, the low pulley assembly 550 provides a variety of pressing and pulling exercise movements for the user. The low pulley assembly 550 comprises a low pulley frame assembly 551 and two swivel pulley assemblies 560.

The low pulley frame assembly 551 provides attachment means for two swivel pulley assemblies 560 as well as two guide pulleys and is now described in more detail. The low pulley frame assembly 551 comprises bent support tube 552 wherein respective pulley plates 553 and respective hollow axles 554 are attached at the outer ends. Pulleys 279*a* and 279*b* are attached to respective pulley plates 553. A respective hollow axle 554 provides a pivot point, with an axis of rotation labeled L1, for a respective swivel pulley assembly 560, as well as a path through the hollow center for a respective cable 272 of the third sub-sector of cable system 200. The low pulley frame assembly 550 attaches to connection plate 67 of the front pole assembly 55.

Each respective swivel pulley assembly 560 provides a pulley that maintains cable alignment in any direction the user presses or pulls during exercise and is now described in more detail. The swivel pulley assembly 560 comprises sleeve 561, with two pulley plates 562 attached, which is fitted with bushings 563 and is secured to the low pulley frame assembly 551 by collar 564. Pulley 280*b* fits between pulley plates 562. The swivel pulley assembly 560 is rotatable about axis L1.

Free floaters 268*a* and 268*b*, which each comprise a respective pulley bracket 233 and a respective adjustment rod 234, is where the third sub-sector 270 ties into the second sub-sector 255 at the ends of cable assembly 256. The third sub-sector 270 of the cable system 200 has a left and a right version of cable assembly 271. One version will be described, as the other version is the same. Cable 272*b* of cable assembly 271*b* passes around pulley 275*b* in free floater 268*b*, then around fixed pulley 276*b* on the mid pulley assembly 500. The cable 272*b* then goes through hollow axle 505, then around swiveling pulley 277*b* of the swivel pulley assembly 510. This end of the cable 272*b* may comprise a locking ball 201, ball stop 206, locking shank ball 205 (not shown), and a strap 203. The other end of cable 272*b* passes around fixed pulley 278*b* on the bottom middle base assembly 100, then around fixed pulley 279*b* on the low pulley frame assembly 551. Cable 272*b* then passes through hollow axle 554, then around swiveling pulley 280*b* of the swivel pulley assembly 560. This end of the cable may comprise a locking ball 201, ball stop 206, locking shank ball 205 (not shown), and a strap 203.

To exercise with the mid pulley assembly 500 and the low pulley assembly 550, the user makes the desired adjustments to the seat assembly 600 and the bicep curl pad assembly 700 which will be discussed in more detail later. The desired resistance is selected from the resistance element 800 and the incremental weight system 820, which will be discussed in more detail later. The user then presses or pulls, depending on the exercise chosen, on one or more handles (not shown) attached to the straps 203 on the ends of cables 272*a* and 272*b*. The ends of the left version and right versions of cable assembly 271 can be pressed or pulled at the same time, or independently one at a time. When one or more ends of cable assembly 271*a* or cable assembly 271*b* is pressed or pulled, one or both ends of cable assembly 256 in the second sub-sector 255 is pulled downward, thus pulling pulley 230 of the main cable sector 210 upward, which raises the weight stack and gives resistance. Only the second sub-sector 255, the third sub-sector 270, and the main cable sector 210 are activated because locking balls 202 and 201 of cable assembly 225 prevent the transfer of cable pull.

Figure 19:
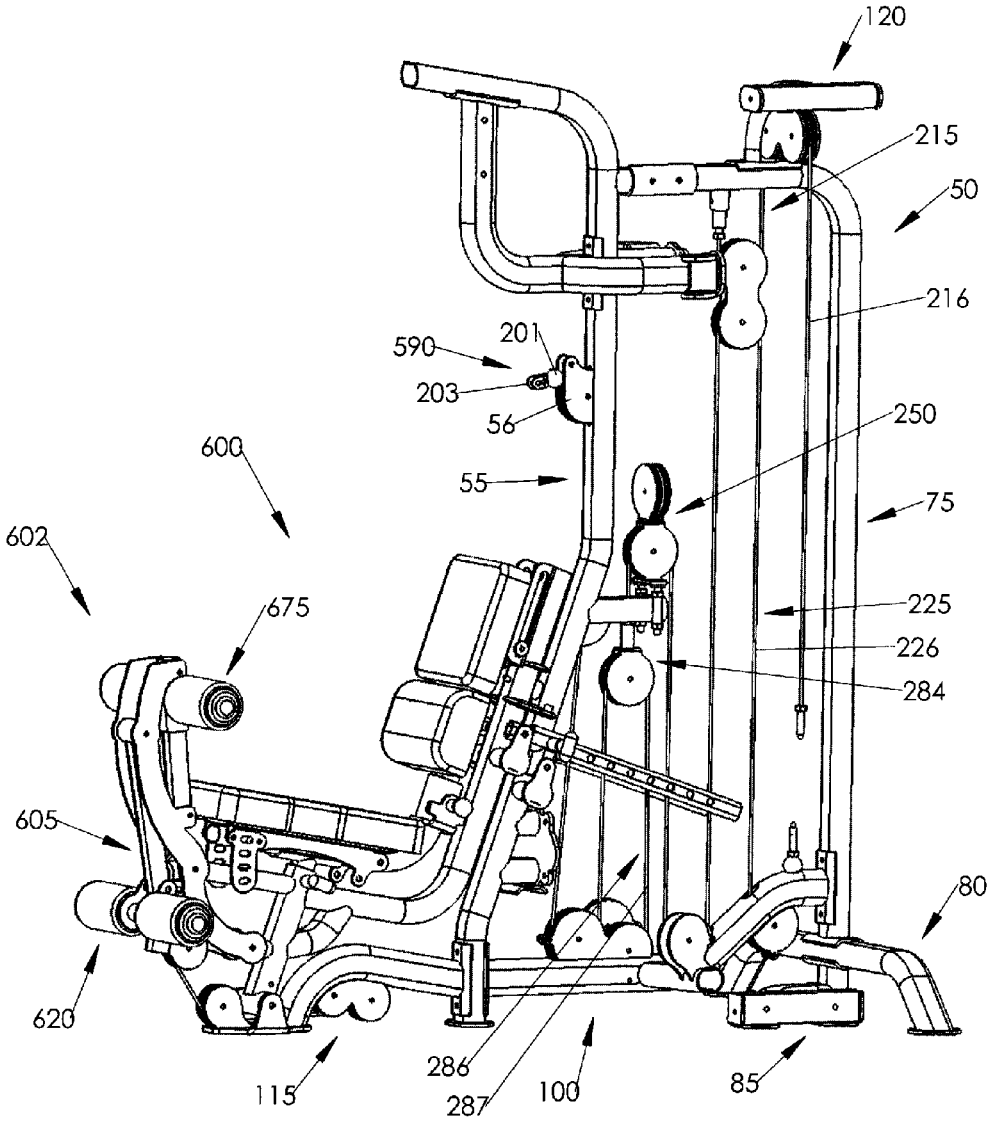
FIG. 19 is a perspective view illustrating the frame, a seat assembly, a leg extension leg curl assembly, the main cable sector, and the fourth sub-sector of the cable system.
Figure 19:
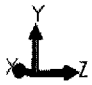
Figure 20:
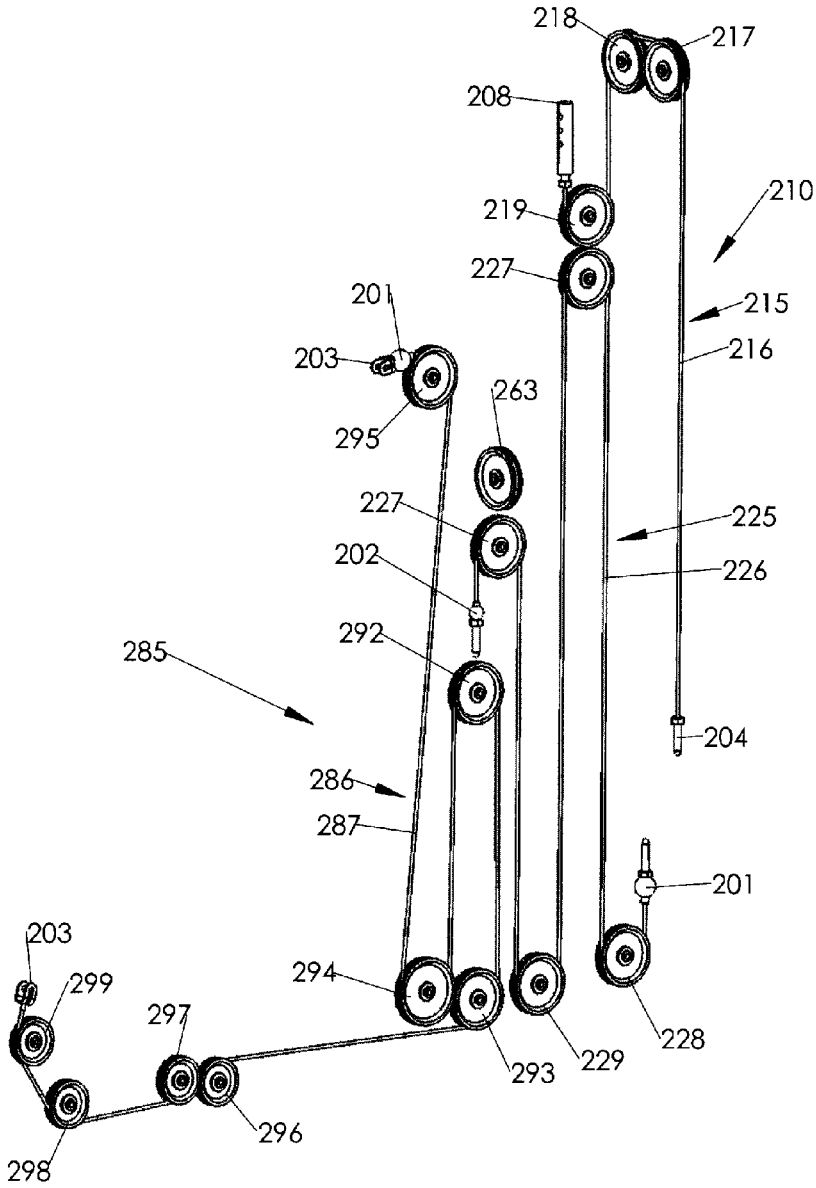
FIG. 20 is a perspective view illustrating the main cable sector and the fourth sub-sector of the cable system.
Figure 20:
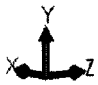
Figure 21:
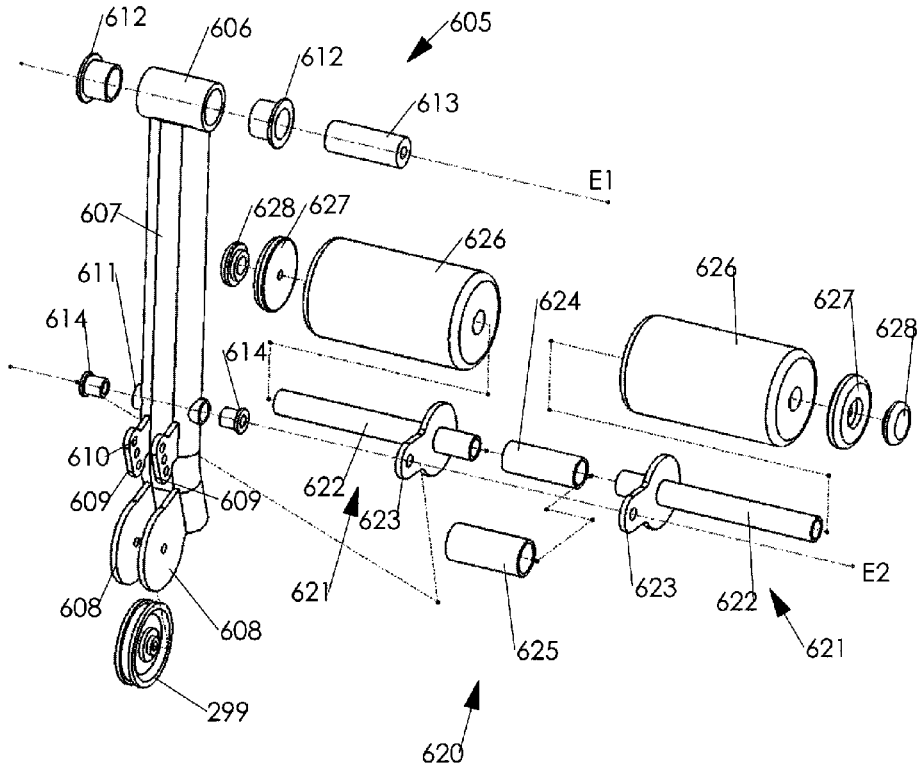
FIG. 21 is an exploded perspective view illustrating the leg extension assembly.
Figure 21:
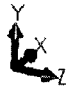
Figure 22:
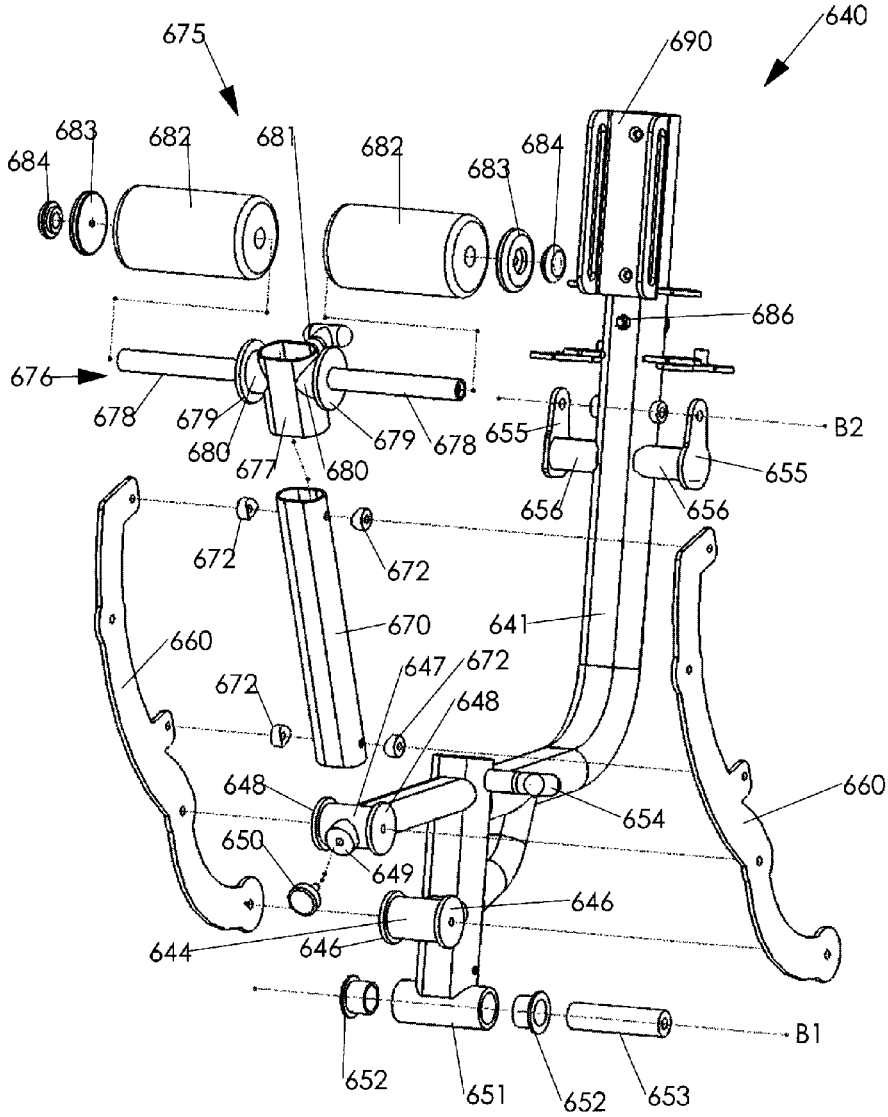
FIG. 22 is an exploded perspective view illustrating the seat main frame, the leg extension leg curl plates and bumper, and the upper roller assembly from the front left side.

FIGS. 19 and 20 illustrates the fourth sub-sector 285 in cable system 200, which comprises cable assembly 286. Cable assembly 286 interconnects a centered mid pulley station 590 and a leg extension and leg curl assembly 602 with the main cable sector 210, therefore, connecting it to resistance. Since the fourth sub-sector 285 interconnects the centered mid pulley station 590 and a leg extension and leg curl assembly 602 with the resistance element 800, the three will be discussed together.

Illustrated in FIG. 19, the centered mid pulley station 590 provides a variety of pressing and pulling exercise movements for the user such as over head triceps presses and abdominal crunches. The centered mid pulley station 590 comprises fixed pulley 295, which is attached between pulley plates 56, which are attached to the front pole assembly 55 at approximately two thirds of the way up front pole 69.

Illustrated in FIGS. 19-22, the leg extension and leg curl assembly 602 provides means for performing leg extension exercises and leg curl exercises. The leg extension and leg curl assembly 602 comprises frame plates 660, an arm assembly 605, a lower roller assembly 620, and an upper roller assembly 675.

The frame plates 660 provides attachment means for the arm assembly 605 and the upper roller assembly 675 and is now described in more detail. The frame plates 660 are attached to seat main frame 640 which will be described in more detail later. The upper roller assembly 675 is attached in between the frame plates 660 at two attachment points. One attachment point is approximately in the center of the frame plates 660 and the other attachment point is at the top end of the frame plates 660. The frame plates 660 also provide a pivot point for the arm assembly 605.

The arm assembly 605 provides attachment means for the lower roller assembly 620 and attachment means for cable assembly 286 and is now described in more detail. The arm assembly 605 comprises bent arm tube 607, wherein at one end, sleeve 606 is attached. Sleeve 606 is fitted with bushings 612, axle 613, and is pivotally attached to frame plates 660 with an axis of rotation labeled E1. Pulley plates 608, cable tie in plates 609, and sleeve 611 are attached to the bent arm tube 607 on the other end. Pulley 299 fits between pulley plates 608. Sleeve 611 is fitted with bushings 614, provides a pivot point for lower roller assembly 620, and is labeled with an axis of rotation E2. Cable tie in plates 609 provides attachment means for one end of cable assembly 286 of the fourth sub-sector 285. Strap 203 can be bolted between cable tie in plates 609 with cable tension adjusting apertures 610. Cable 287 wraps around pulley 299 as leg extensions and leg curls are being performed. When in a rest position, arm assembly 605 rests on bumper 650 of seat main frame 640 which will be described in more detail later.

The lower roller assembly 620 provides lower leg pad support to the user during leg extension and leg curl exercises and is now described in more detail. The lower roller assembly 620 includes left and right versions of lower roller frame 621. A respective lower roller frame 621 comprises pivot plate 623 which is pivotally attached to arm assembly 605 and rotatable about axis E2. Pad tube 622 is attached to pivot plate 623 and is journaled by roller pad 626. Flange cap 627 and end cap 628 secures roller pad 626 onto lower roller frame 621. Connection tube 624 slides over both pad tubes 622 and joins both lower roller frames 621 in the center when bolted onto arm assembly 605. Round bumper 625 slides over connection tube 624 and provides the lower roller assembly 620 a rest position against arm assembly 605. The lower roller assembly is rotatable about axis E2 to accommodate different leg lengths of users while performing leg extensions and leg curls.

Figure 25:
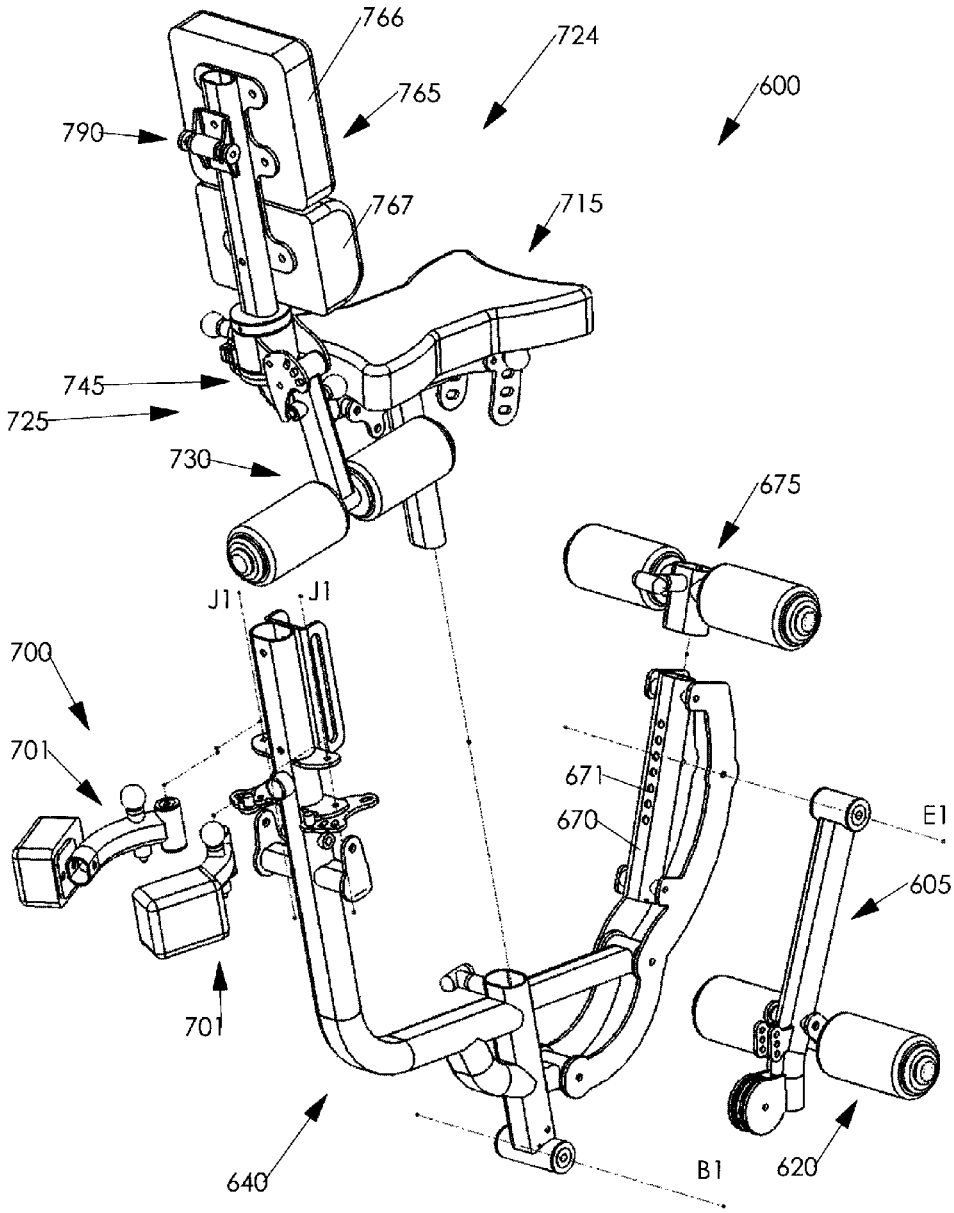
FIG. 25 is an exploded perspective view illustrating the seat main frame, the seat sub frame with the hold down assembly and the roller brace assembly, the arm pad assemblies, the leg extension leg curl assembly, and the upper roller assembly from the back right side.

The upper roller assembly 675 provides leg pad support to the user during leg extension and leg curl exercises and is now described in more detail. The upper roller assembly 675 comprises sliding pad assembly 676 which includes sleeve 677, which has two extension tubes 680 attached to opposite sides. A respective pad washer 679 and a respective pad tube 678 is attached to a respective extension tube 680. A respective roller pad 682 slides onto a respective pad tube 678 and is secured with a respective flange cap 683 and a respective end cap 684. A locking pin 681 is attached to sleeve 677. The upper roller assembly 675 also comprises an adjustment tube 670, which has a plurality of apertures 671 (shown in FIG. 25) formed therein, and tube spacers 672 which fit between adjustment tube 670 and frame plates 660.

Free floater 284, which comprises pulley bracket 233 and adjustment rod 234, is where the fourth sub-sector 285 ties into the main sector 210 at one end of cable assembly 225. Cable 287 passes around pulley 292 in free floater 284, then around fixed pulley 294 on bottom middle base assembly 100, then around fixed pulley 295 of the centered mid pulley station 590 on front pole assembly 55. This end of the cable 287 may comprise a locking ball 201, ball stop 206, locking shank ball 205 (not shown), and a strap 203 wherein a variety of straps or handles can be attached to perform various exercises, such as abdominal crunches. The other end of the cable 287 passes around fixed pulley 293 on the bottom middle base assembly 100, then around fixed pulleys 296, 297, and 298 on the bottom front base assembly 115. The cable then passes around pivot pulley 299 on the arm assembly 605. This end of the cable 287 may comprise a locking shank ball 205 (partially shown), and a strap 203 which ties into the cable tie in plates 609 of the arm assembly 605.

To exercise with the centered mid pulley station 590, the user attaches the desired strap or handle attachment (not shown) onto strap 203 on the end of cable 287 that passes around fixed pulley 295. The user then makes the desired adjustments to the seat assembly 600 which will be discussed in more detail later. The desired resistance is selected from the resistance element 800 and the incremental weight system 820, which will be discussed in more detail later. The user then pushes or pulls the previously selected strap or handle attachment which will cause cable assembly 286 to pull down free floater 284, which is attached to one end of cable assembly 225 of the main cable sector 210, and will raise the weight stack and give resistance. No other sub-sector in the cable system 200 is activated because locking ball 201 of cable assembly 225 and double free floater 250 being braced against levelers 58 prevent the transfer of cable pull.

The leg extension and leg curl assembly 602 provides means for performing leg extension exercises and leg curl exercises. To perform leg extensions, the user first selects the desired resistance amount from the resistance element 800 and the incremental weight system 820, which will be discussed in more detail later. The user then makes the desired adjustments to the seat assembly 600 which will be discussed in more detail later. The user adjusts the upper roller assembly 675 up or down by positioning locking pin 681 into the appropriate aperture 671 in the adjustment tube 670 to wherein their legs fit over the roller pads 682 and their knees line up with axis E1. The user then fits their lower legs under the lower roller assembly 620 and then extends their lower legs upward and downward for the desired number of repetitions. To perform leg curls, the user makes the above mentioned adjustments, however the upper roller assembly 675 is positioned above axis E1 and above the user's knees. Leg curls are performed one leg at a time. The user faces towards the gym, braces one leg above the knee against the upper roller assembly 675, aligns their knee with axis E1, positions the lower leg behind the lower roller assembly 620, and then curls their legs upward and downward for the desired number of repetitions. When leg extension or leg curl exercises are performed, arm assembly 605 will pivot about axis E1 and pull cable assembly 286, which will pull down free floater 284, which is attached to one end of cable assembly 225 of the main cable sector 210, and will raise the weight stack and give resistance. No other sub-sector in the cable system 200 is activated because locking ball 201 of cable 226 and double free floater 250 being braced against levelers 58 prevent the transfer of cable pull.

A seat assembly 600 is illustrated in FIGS. 23-27. The seat assembly 600 is a multi-positionable seat assembly that provides numerous pad supports that can be adjusted to accommodate different exercises. The seat assembly 600 is pivotally attached to frame 50 of multi-station exercise gym 10; therefore allowing the user to alter the orientation of the pad supports to best suit the exercise chosen to perform. The seat assembly 600 provides seating and proper pad support for the previously discussed exercise stations; the width adjustable high pulley assembly 300, the path adjustable arm assembly 400, the mid pulley assembly 500, the low pulley assembly 550, the centered mid pulley station 590, and the leg extension-curl station 602. The seat assembly 600 also provides attachment means for the leg extension and leg curl station 602. The seat assembly 600 comprises a leg extension-curl assembly 602 which has been previously discussed, a seat main frame 640, a seat assembly adjustment mechanism 629, a bicep curl pad assembly 700, and a seat sub frame 724 (shown in FIGS. 25 and 32) that includes a seat frame assembly 770, a telescoping assembly 760, a roller brace assembly 790, a back seat assembly 765, a bottom seat assembly 715, and a hold down roller assembly 725.

Figure 28:
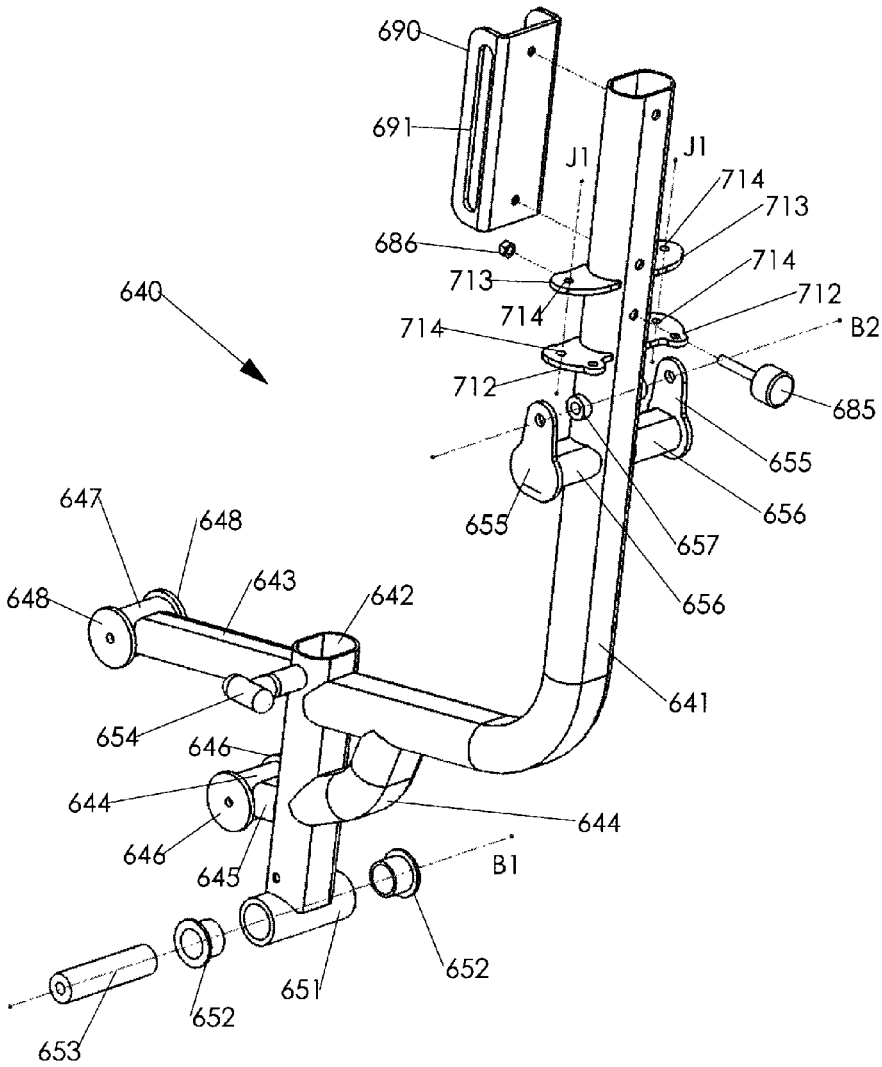
FIG. 28 is an exploded perspective view illustrating the seat main frame from the back left side.

A seat main frame 640 is illustrated in FIG. 28. The seat main frame 640 provides structural support and stability to the seat assembly 600. The seat main frame also provides telescoping attachment means for the seat sub frame 724, attachment means for one end of the seat assembly adjustment mechanism 629, attachment means for the bicep curl pad assembly 700, attachment means for the leg extension-curl assembly 602, and attachment means for a roller receiver bracket 690 and is now described in more detail. The seat main frame 640 comprises back support tube 641 which has the back side of sleeve tube 642 attached on one end. Tube brace 644 supports the connection of back support tube 641 and sleeve tube 642. Near the other end of back support tube 641, roller receiver bracket 690 is attached, which provides a base for the seat sub frame 724 to brace back against as it is stationary, as well as when it is telescopically adjusted up and down. Attached below the roller receiver bracket 690 on opposite sides are upper hinge plates 713 and lower hinge plates 712, which have apertures 714 formed therein which provide pivoting attachment points for the bicep curl pad assembly 700. Apertures 714 also have an axis of rotation labeled J1. Attached below the lower hinge plates 712 is sleeve 657 which provides a pivoting attachment point for one end of the seat assembly adjustment mechanism 629, and is labeled with an axis of rotation B2. Also attached on opposite sides of the back support tube 641 are extension tubes 656 which have hinge plates 655 attached on the outer ends. Extension tube 643 and extension tube 645 are attached to the front side of sleeve tube 642. Horizontal extension tube 647, which has connection plates 648 attached on both ends, is attached to extension tube 643. Horizontal extension tube 644, which has connection plates 646 attached on both ends, is attached to extension tube 645. Connection plates 648 and 646 provide connection points for the leg extension-curl assembly 602. Locking pin 654 is attached to the sleeve tube 642 towards the upper end and secures the seat sub frame 724 after being telescopically adjusted to the desired position. Sleeve 651, which is fitted with bushings 652 and axle 653, is attached to the bottom of sleeve 642 and is labeled with an axis of rotation B1. The seat main frame 640 is pivotally attached to the bottom front base assembly 115 and is rotatable about axis B1. Bumper 685 is attached to back support tube 641, is secured with nut 686, and provides a rest position when seat main frame 640 is pivoted all the way back against the front pole assembly 55. A pivoting seat frame 640 allows for the alternate positioning of various seat and pad supports and will be discussed in more detail after all the components of the seat assembly 600 is described.

Figure 26:
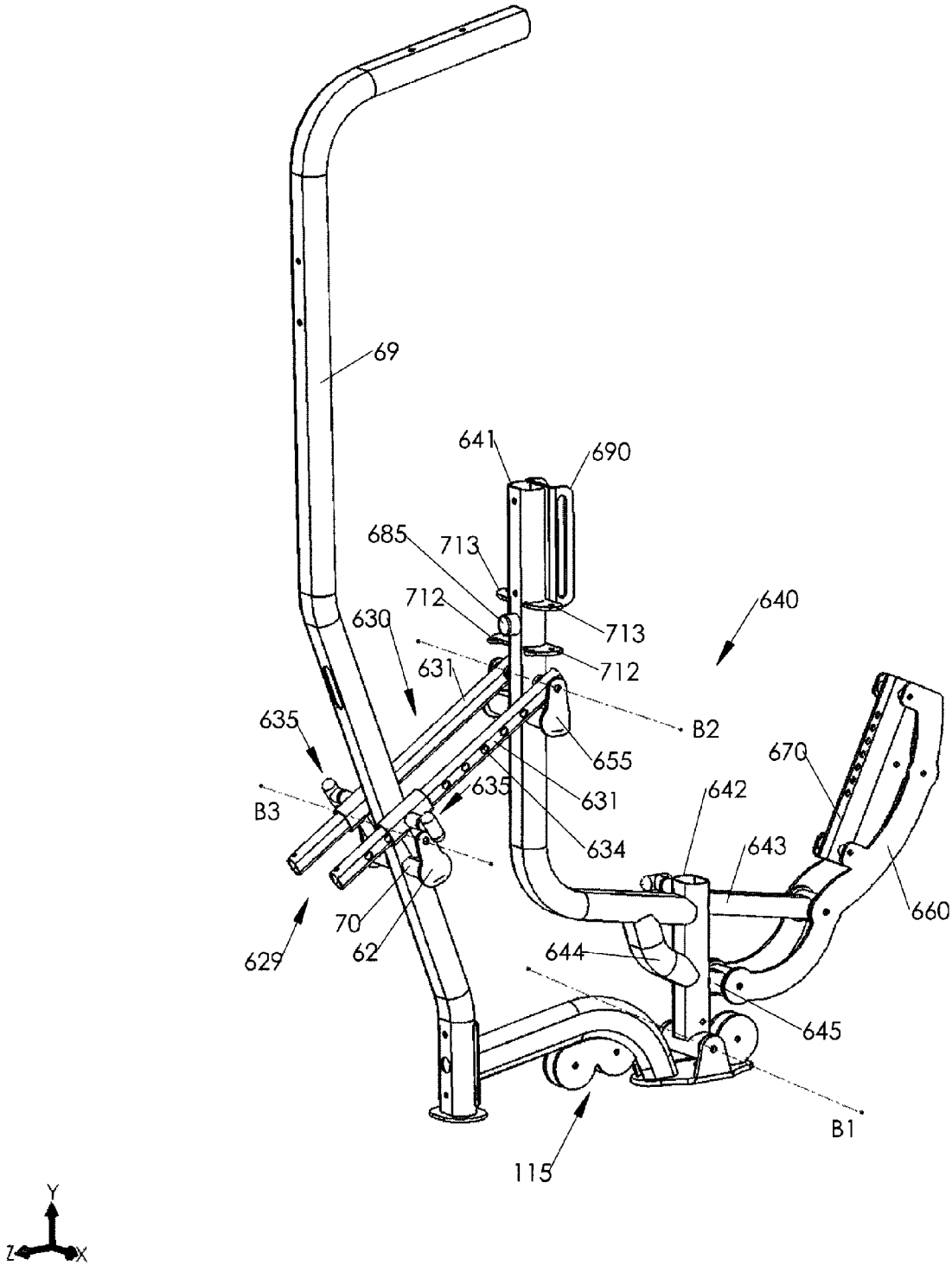
FIG. 26 is a perspective view illustrating a portion of the frame, a portion of the seat assembly, and a seat assembly adjustment and locking mechanism from the back right side.
Figure 27:
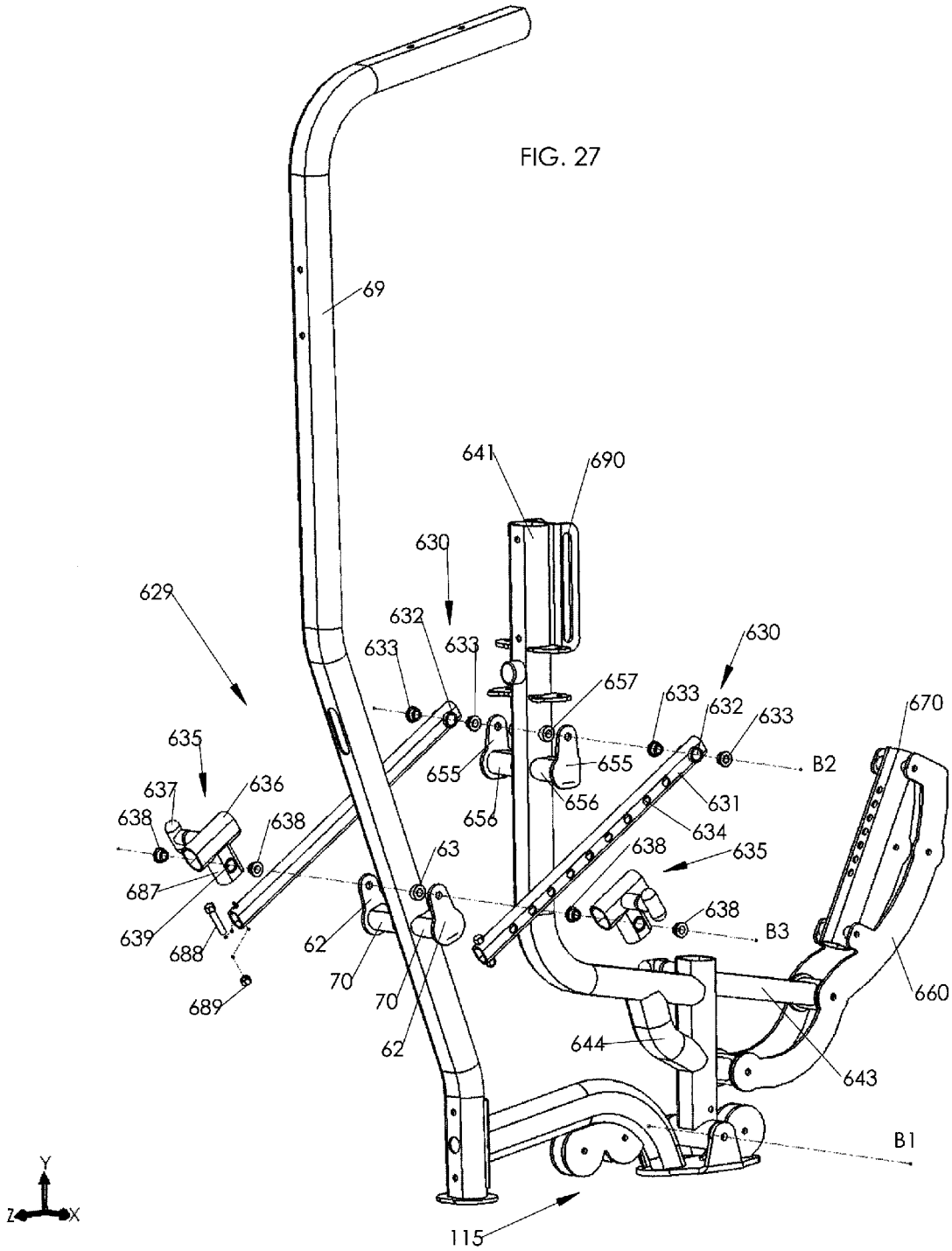
FIG. 27 is an exploded perspective view illustrating a portion of the frame, a portion of the seat assembly, and a seat assembly adjustment and locking mechanism from the back right side.

The seat assembly adjustment mechanism 629 is illustrated in FIGS. 26 and 27. The seat assembly adjustment mechanism 629 provides a plurality of adjustment positions as well as locking means for the seat assembly 600 as it is rotated about axis B1 to accommodate alternate exercises within the multi-station exercise gym 10 and is now described in more detail. In one embodiment, the seat assembly adjustment mechanism 629 comprises a pair of telescoping tube assemblies 630 that are each pivotally attached at one end to the seat main frame 640 and rotatable about axis B2. Each telescoping tube assembly 630 comprises telescoping tube 631, which has a plurality of apertures 634 formed therein, and which has a sleeve 632 attached at one end. Bushings 633 are fitted in sleeve 632 which is pivotally attached to the seat main frame 640 and is rotatable about axis B2. Each respective telescoping tube assembly 630 is pivotally attached in between sleeve 657 and a respective hinge plate 655 of the seat main frame 640. The seat assembly adjustment mechanism 629 further includes a pair of sleeve assemblies 635 that are each pivotally attached in between sleeve 63 and a respective hinge plate 62 on the front pole assembly 55 and are rotatable about an axis labeled B3. Each respective sleeve assembly 635 comprises a sleeve 636. Extension tube 687 is attached to one side of sleeve 636 and contains sleeve 639 which is fitted with bushings 638. Locking pin 637 is attached to one side of sleeve 636. One end of each respective telescoping tube assembly 630 slides into a respective sleeve assembly 635. To adjust the seat assembly 600, the user unlocks the locking pins 637, pivots the seat assembly 600 to the desired location to accommodate a specific exercise, then relocks each respective locking pin 637 into one of the apertures 634 on the telescoping tube assembly 630. A respective restrictor bolt 688, secured by a respective nut 689, is attached at one end of each respective telescoping tube 631 to prevent the respective telescoping tube assembly 630 from sliding out of a respective sleeve assembly 635.

A seat sub frame 724 is illustrated in FIGS. 29-32. The seat sub frame 724 provides bottom and back seating support for the user and is telescopically adjustable with the seat main frame 640. The seat sub frame 724 comprises seat frame assembly 770, telescoping assembly 760, roller brace assembly 790, back seat assembly 765, bottom seat assembly 715, and hold down assembly 725.

Figure 32:
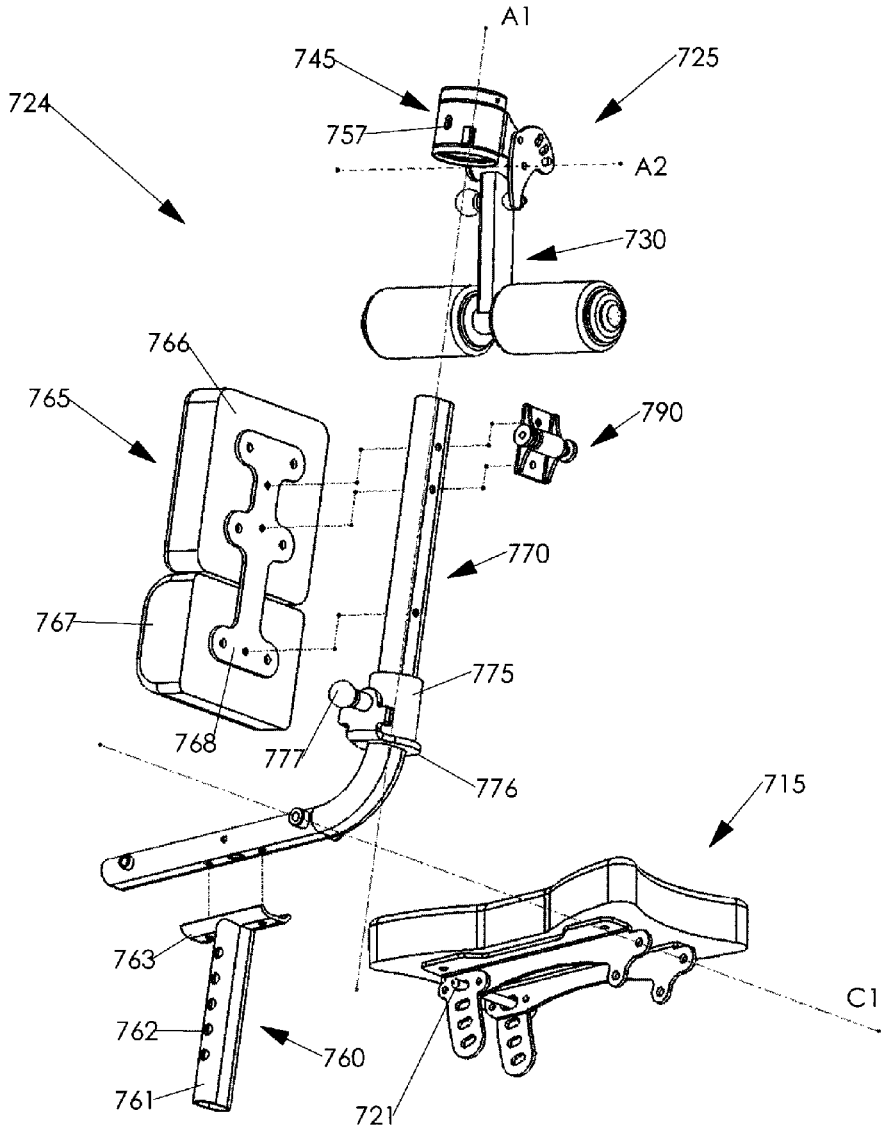
FIG. 32 is an exploded perspective view illustrating the seat sub frame from the back left side.
Figure 32:
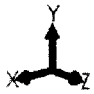
Figure 33:
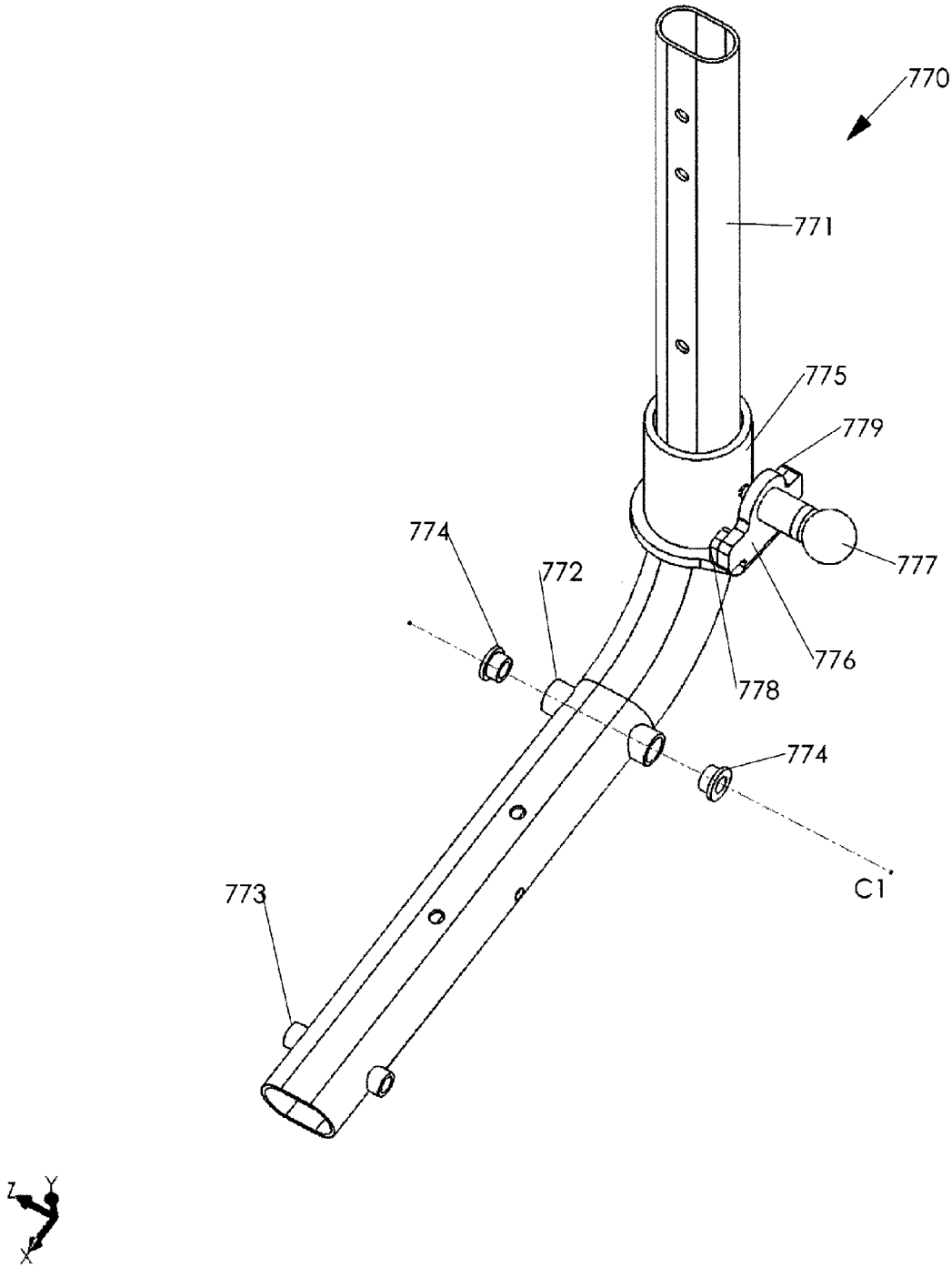
FIG. 33 is an exploded perspective view illustrating the seat frame of the seat sub frame from the front left side.

A seat frame assembly 770 is illustrated in FIGS. 32 and 33. The seat frame assembly 770 provides structural support and stability to the seat sub frame 724. In one embodiment, the seat frame assembly 770 also provides attachment means for the hold down assembly 725, and also provides attachment points for the telescoping assembly 760, roller brace assembly 790, back seat assembly 765, and bottom seat assembly 715 and is now described in more detail. The seat frame assembly 770 comprises a bent seat tube 771. A sleeve 772, with an axis of rotation labeled C1, is attached on the bottom portion near the bend of bent seat tube 771. Sleeve 772 is fitted with bushings 774 and provides a pivoting attachment point for bottom seat assembly 715. Sleeve 773 is attached on the bottom portion near the end of bent seat tube 771 and provides an opening and rest position for adjusting pin 721. Sleeve 775, which has an axis of rotation labeled A1, is attached on top of L-bracket 776, which is attached to the bent seat tube 771 on the top portion near the bend and provides a base for hold down assembly 725 to rest on. A locking pin 777 is attached to the upper portion of L-bracket 776 and is received by apertures 757 of the hold down assembly 725.

Bumpers 778 and 779 are attached to the top portion of L-bracket 776 and limit the rotation of the hold down assembly 725 which is pivotally attached to the seat frame assembly 770 and rotatable about axis A1 and will also be discussed in more detail later.

Figure 34:
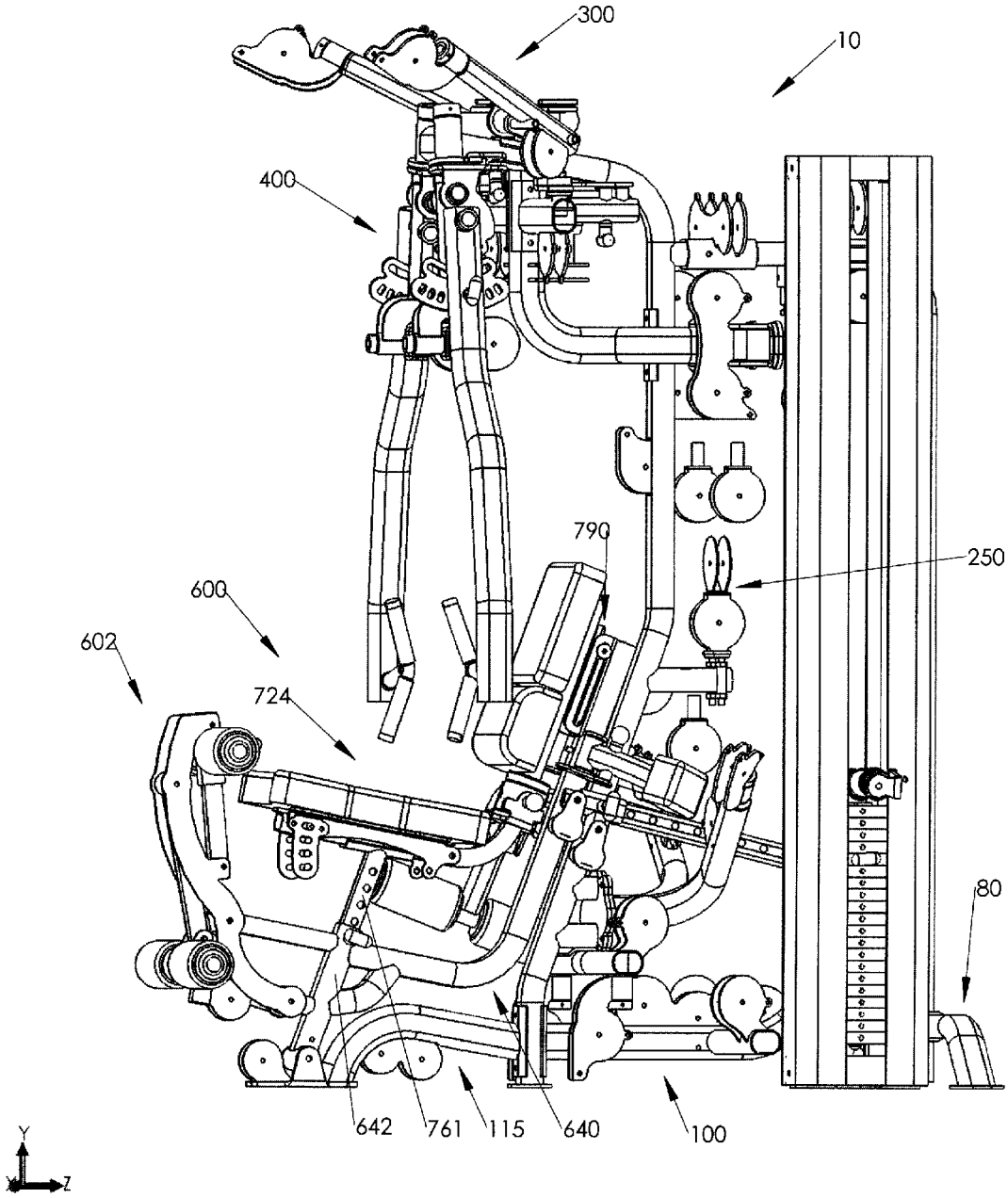
FIG. 34 is a perspective view illustrating the multi-station exercise gym from the front left side without the cables and pulleys wherein the seat sub frame is adjusted to a higher position for shorter users.

A telescoping assembly 760 is illustrated in FIG. 32. The telescoping assembly 760 attaches to the seat frame assembly 770, previously discussed, underneath on the bottom portion. The telescoping assembly 760 comprises telescoping tube 761 which has a connection plate 763 attached at the upper end. Apertures 762 are formed within telescoping tube 761 and are received by locking pin 654 of the previously discussed seat main frame 640. FIG. 34 illustrates a multi-station exercise gym 10 wherein telescoping tube 761 of the seat sub frame 724 is inserted into sleeve 642 of the seat main frame 640 and is telescopically adjusted upward to provide a high seating position for the user on the seat sub frame 724.

Figure 23:
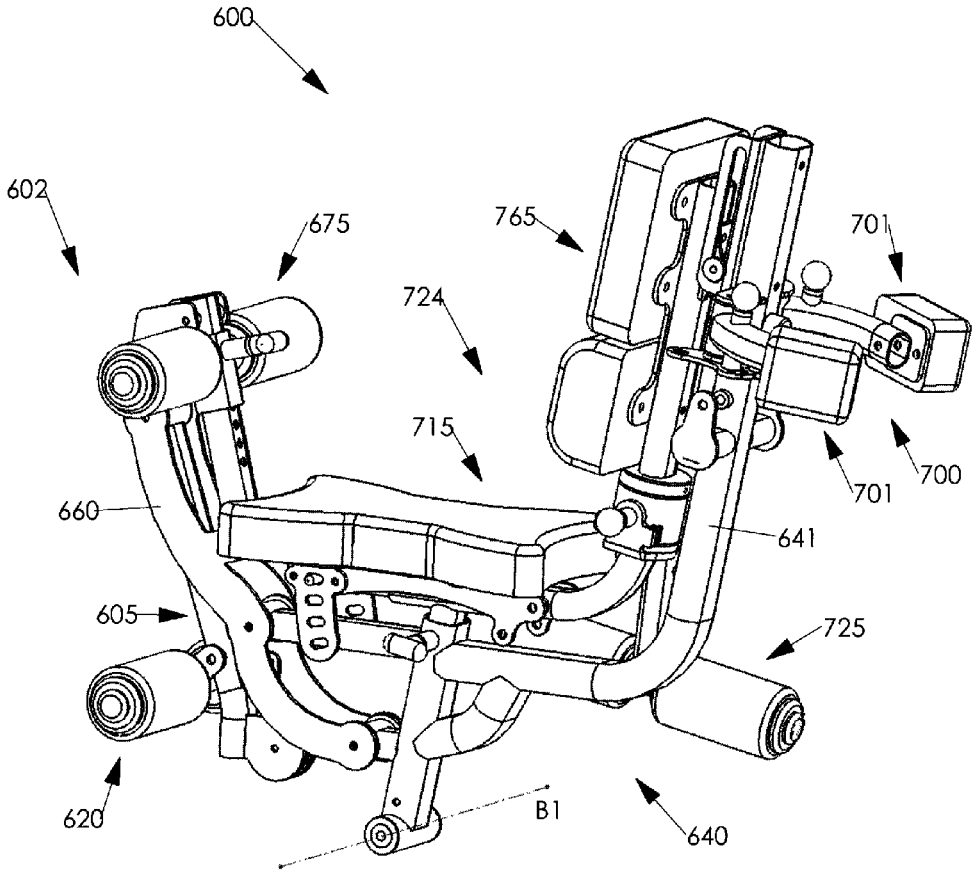
FIG. 23 is a perspective view illustrating an embodiment of the seat assembly from the back left side.
Figure 23:
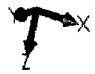
Figure 24:
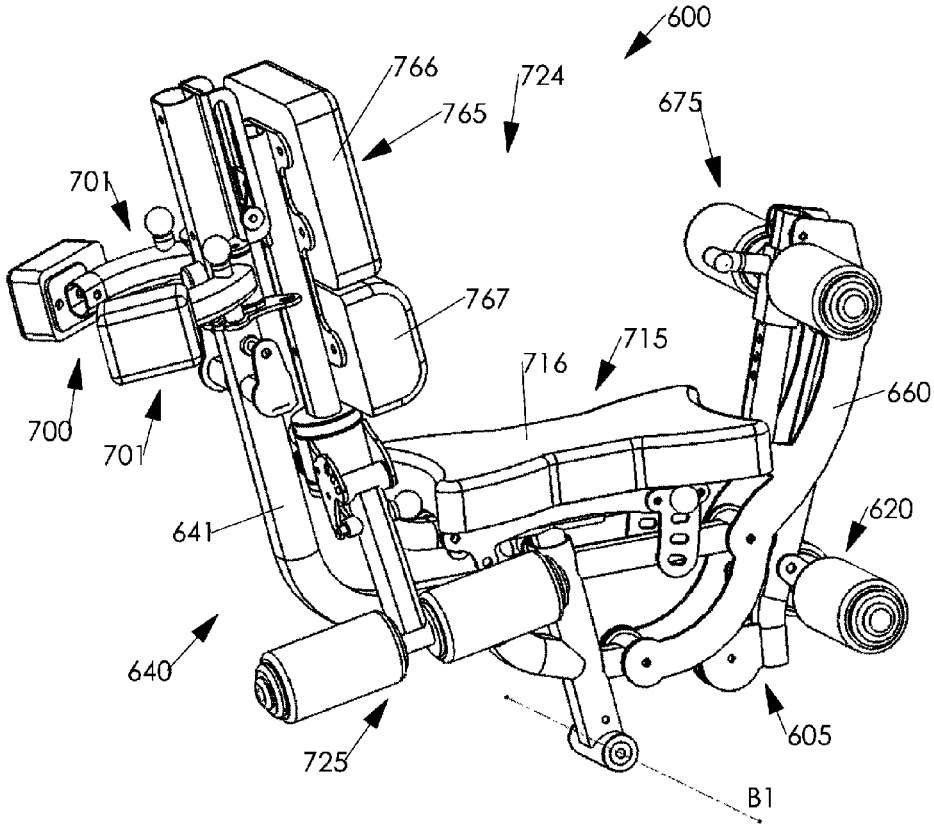
FIG. 24 is a perspective view illustrating an embodiment of the seat assembly from the back right side.
Figure 24:
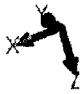
Figure 35:
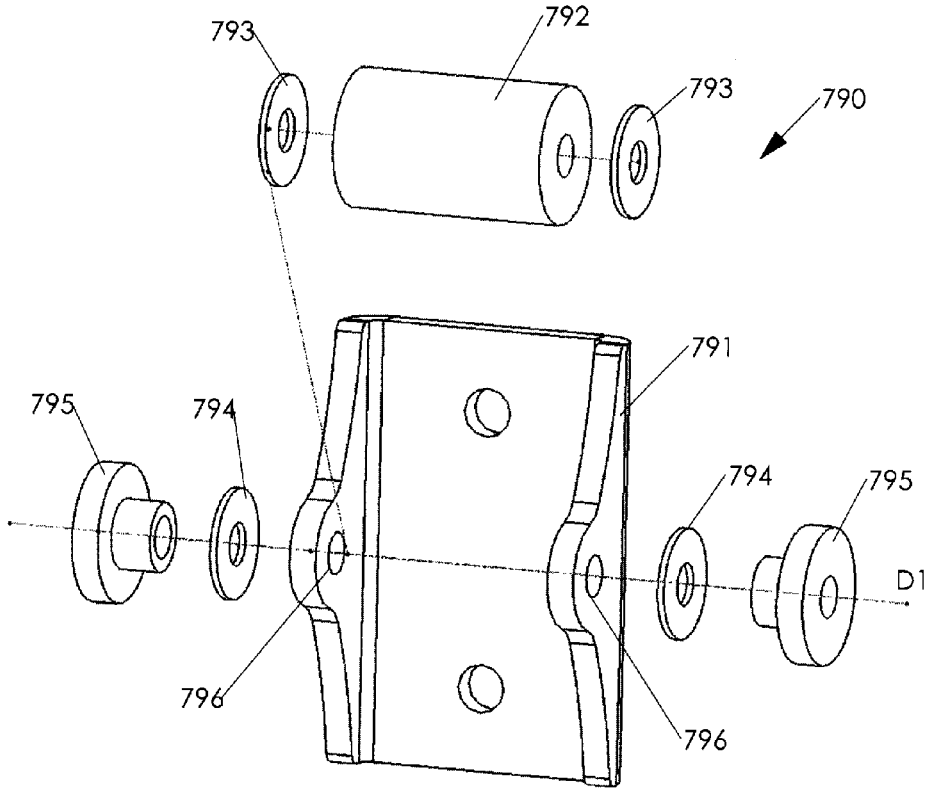
FIG. 35 is an exploded perspective view illustrating a roller brace assembly.
Figure 35:
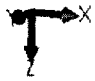

A roller brace assembly 790 is illustrated in FIG. 35. The roller brace assembly 790 attaches to the back upper portion of seat sub frame 720 as best illustrated in FIG. 32. The roller brace assembly 790 comprises roller bracket 791 which has two sides wherein holes 796 are formed therein and are labeled with an axis of rotation D1. Roller 792 is pivotally attached in between the two sides of the roller bracket 791 at holes 796 and is rotatable about axis D1. Washers 793 are fitted to the outsides of roller 792 and prevent roller 792 from rubbing roller bracket 791. Washers 794 and flange bushings 795 fit on the outsides of roller bracket 791. In use, the roller brace assembly 790 is braced against and positioned inside of roller receiver bracket 690 of the seat main frame 640. As best illustrated in FIGS. 23 and 24, flange bushings 795 fit through a respective slot 691 and retain roller brace assembly 790 into roller receiver bracket 690. Bushings 794 prevent the outsides of roller bracket 791 from rubbing the insides of roller receiver bracket 690. This provides a rolling brace for seat sub frame 724 against seat main frame 640 as it is telescopically adjusted up and down. Those skilled in the art would appreciate that other brace assemblies could be used such as a shaft mounted on the seat main frame 640 and a sleeve mounted on the seat sub frame 724 wherein the sleeve would brace and slide up and down along with the seat sub frame 724 as it is telescopically adjusted up and down.

A back seat assembly 765 is illustrated in FIG. 32. In one embodiment two pads, a lower pad 767, and an upper pad 766, along with back plate 768 are attached to the front upper portion of the seat frame assembly 770 which is part of the seat sub frame 724. The back seat assembly 765 provides back and frontal support to the user during pressing and pulling exercises.

Figure 36:
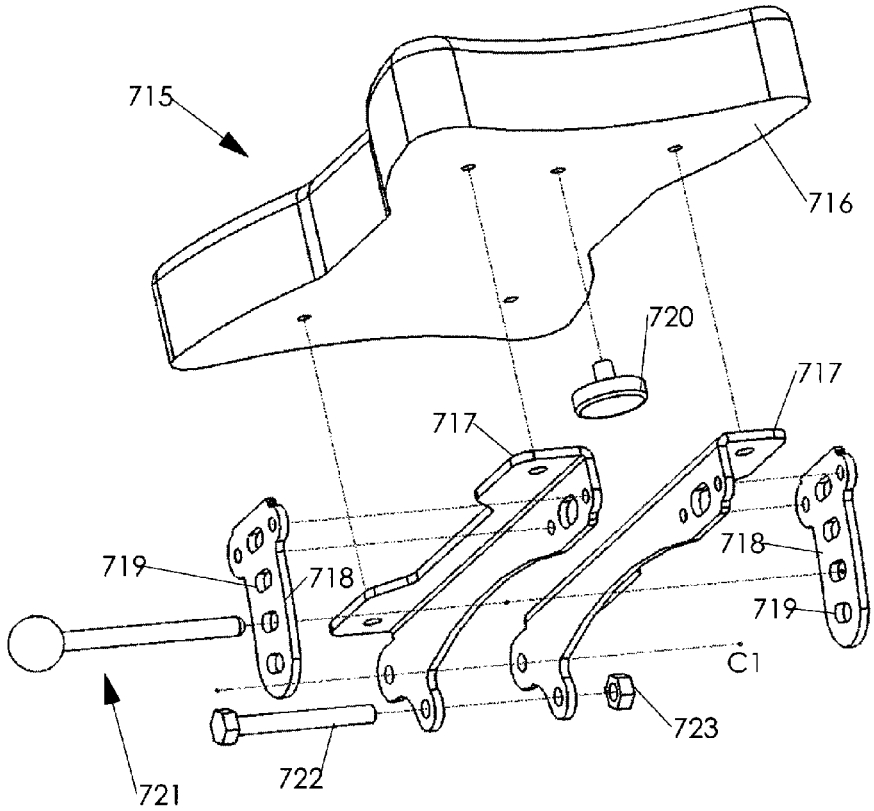
FIG. 36 is an exploded perspective view illustrating the bottom seat of the seat assembly from the front left side.
Figure 36:
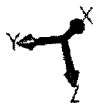
Figure 37:
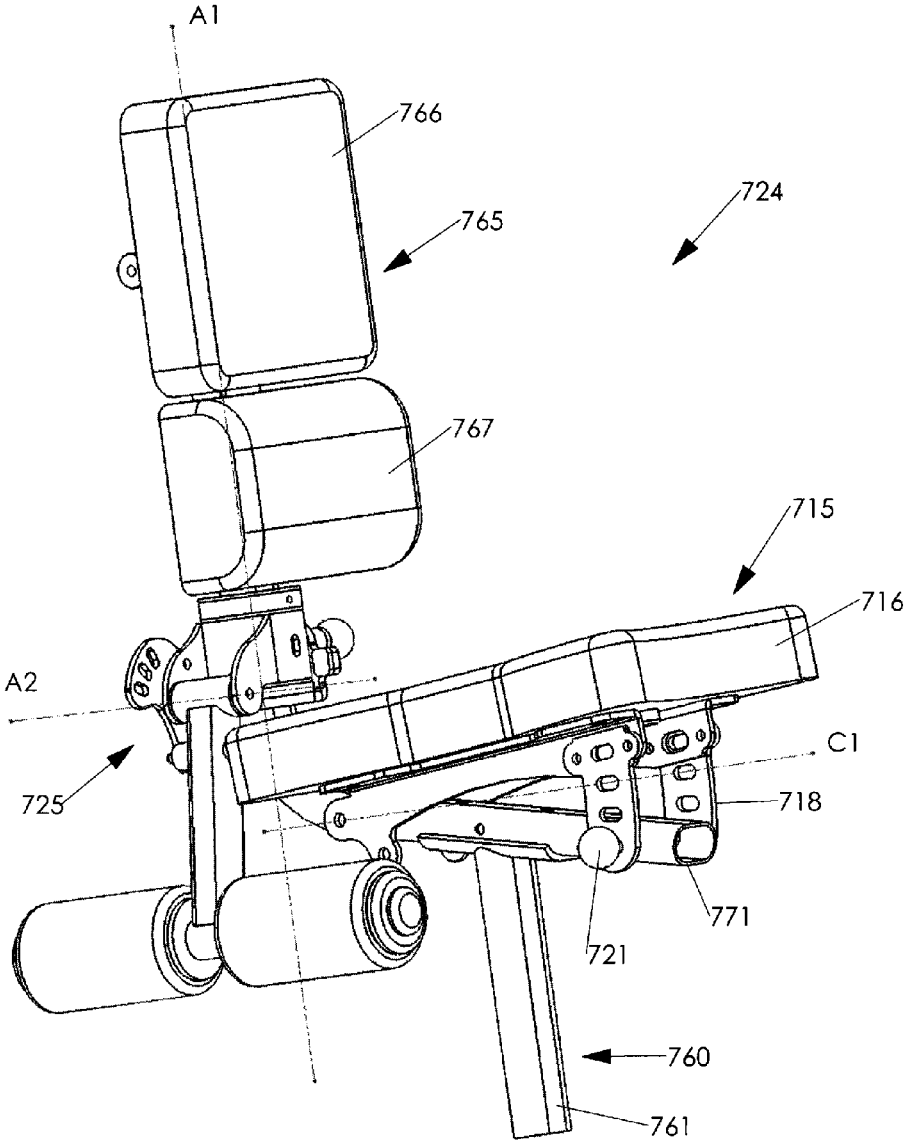
FIG. 37 is a perspective view illustrating the seat sub frame with the bottom seat angularly adjusted upward and with the hold down assembly in the storage position from the front left side.
Figure 37:
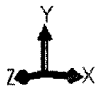
Figure 38:
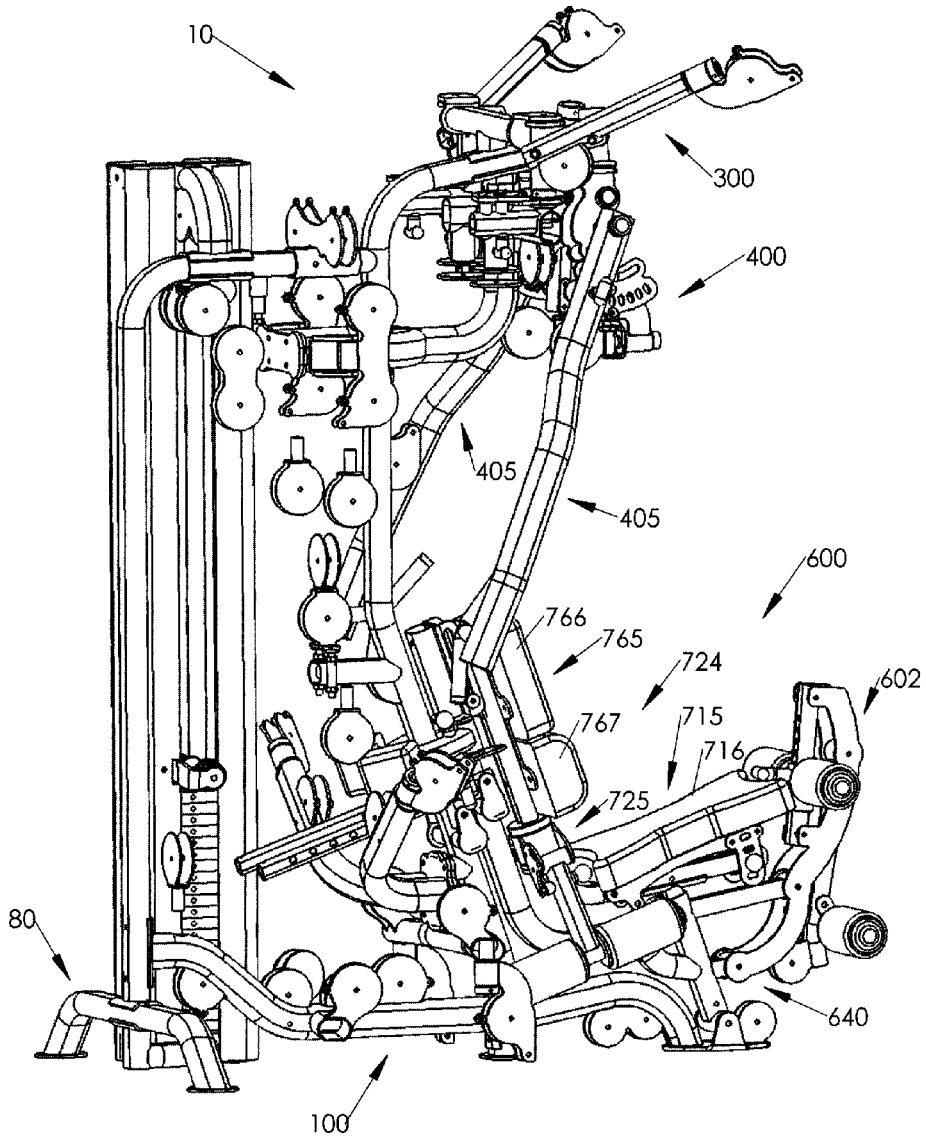
FIG. 38 is a perspective view illustrating the multi-station exercise gym from the back right side without the cables and pulleys wherein the bottom seat on the seat sub frame is angled upward and the upper roller is positioned for a leg extension exercise.
Figure 38:
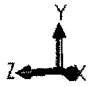

A bottom seat assembly 715 is illustrated in FIGS. 32 and 36. In one embodiment, the bottom seat assembly 715 is pivotally attached to the seat frame assembly 770 and is rotatable about axis C1. The bottom seat assembly 715 provides bottom seating support for the user and is adjustable upwards and downwards as the seat sub frame 724 telescopes as previously described, as well as angularly adjustable with the seat frame assembly 770. This provides alternate angles of seating for the user. For example, FIG. 37 illustrates a bottom seat assembly 715 angularly adjusted to an upper position on the seat sub frame 724. FIG. 38 illustrates a multi-station exercise gym 10 wherein the bottom seat assembly 715 is angularly adjusted to an upper position for performing leg extension exercises. A bottom seat assembly 715 angled in this position allows for more isolation of the thigh muscles during leg extensions. A bottom seat assembly 715 comprises a seat pad 716 for sitting on by the user during exercise. Seat brackets 717 are attached underneath seat pad 716 and provide support as well as attachment means to the seat frame assembly 770 wherein the bottom seat assembly 715 is rotatable about axis C1. Adjustment plates 718 are attached to the front end of the seat brackets 717 wherein adjustment pin 721 can be slid through a desired aperture 719 on a first adjustment plate 718, then through sleeve 773 on the seat frame assembly 770, and then through the respective aperture 719 on the other adjustment plate 718 which will secure the bottom seat assembly 715 into the desired angular position. Bolt 722, which is secured by nut 723 in the back lower end of the seat brackets 717, prevents the bottom seat assembly 715 from over extending upward. Bumper 720 is attached to the front bottom end of seat pad 716 and bumpers against the seat frame assembly 770 when the bottom seat assembly 715 is in the lowest angular position.

Figure 42:
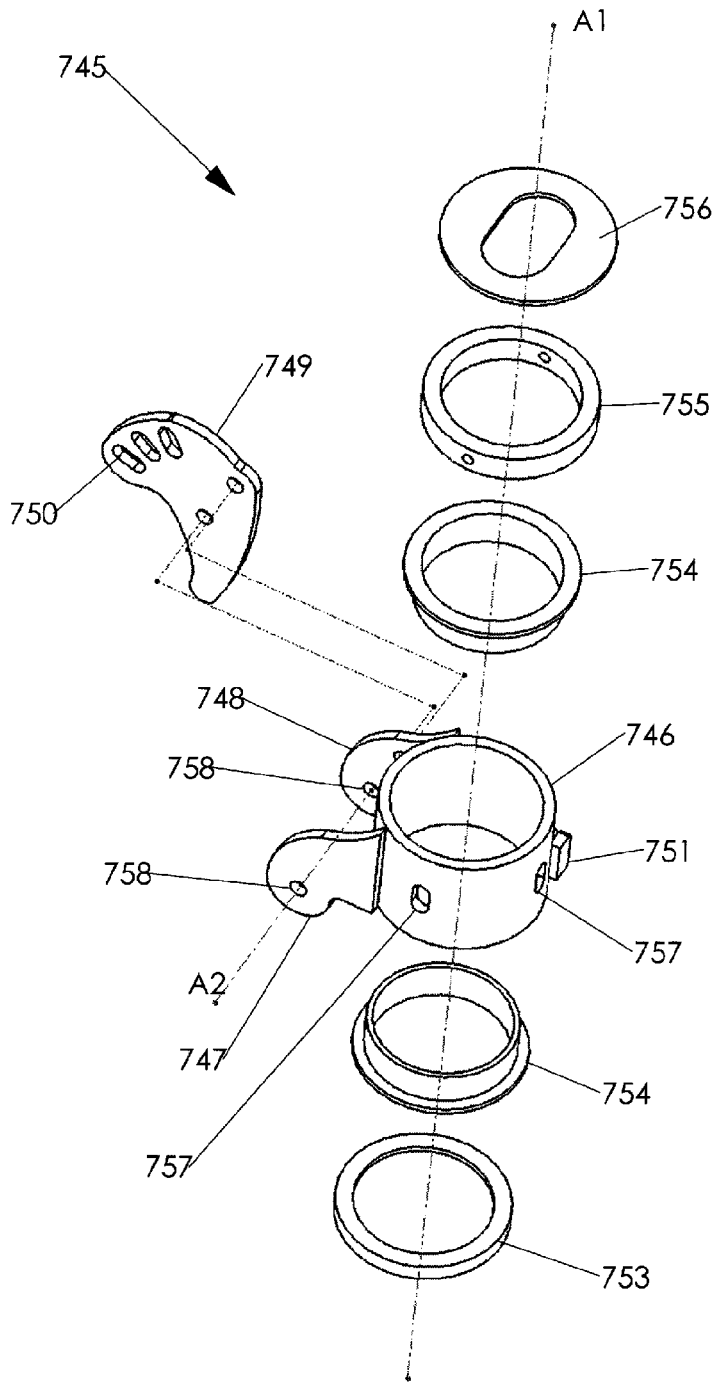
FIG. 42 is an exploded perspective view illustrating the swivel sleeve assembly of the hold down assembly from the left side.

In one embodiment, the seat sub frame 724 also includes a hold down assembly 725. As previously discussed, and as illustrated in FIG. 32, the seat frame assembly 770 provides an L-bracket 776 and a sleeve 775 for the hold down assembly 725 to rest and pivot on. The hold down assembly 725 secures the user into a seated position when performing high pull down exercises. The hold down assembly 725 is adjustable from a storage position into a centered, height adjustable position in front of the back seat assembly 765. The hold down assembly 725 comprises a swivel base assembly 745 and a roller pad assembly 730. The swivel base assembly 745 is pivotally attached to sleeve 775 of the seat frame assembly 770 and rotatable about axis A1 and is now discussed in more detail. As illustrated in FIG. 42, the swivel base assembly 745 comprises a sleeve 746 that is fitted with bushings 754. Connection plates 747 and 748 are attached to sleeve 746. Apertures 758 are formed in connection plates 747 and 748 and provide a pivoting attachment point for the roller pad assembly 730 with an axis of rotation labeled A2. Apertures 750 are formed in adjustment plate 749 which is attached to connection plate 748. Weld cap 753 is positioned underneath bushing 754 and provides a smooth surface for the sleeve 746 along with bushings 754 to rotate on as the swivel base assembly 745 is adjusted. Collar 755 secures sleeve 746 along with bushings 754 onto sleeve 775 of the seat frame assembly 770. Top cap 756 provides an enclosed top for swivel base assembly 745. Bumper plate 751, which is supported by brace 752 (shown in FIG. 31), is attached to sleeve 746 and bumpers against bumper 779 on the seat frame assembly 770 when the hold down assembly 725 is adjusted to a storage position. When the hold down assembly 725 is adjusted to a use position, connection plate 747 bumpers against bumper 778 on the seat frame assembly 770. Locking pin 777 on the seat frame assembly 770 engages apertures 757 in sleeve 746 to secure the hold down assembly in a use or a storage position.

Figure 30:
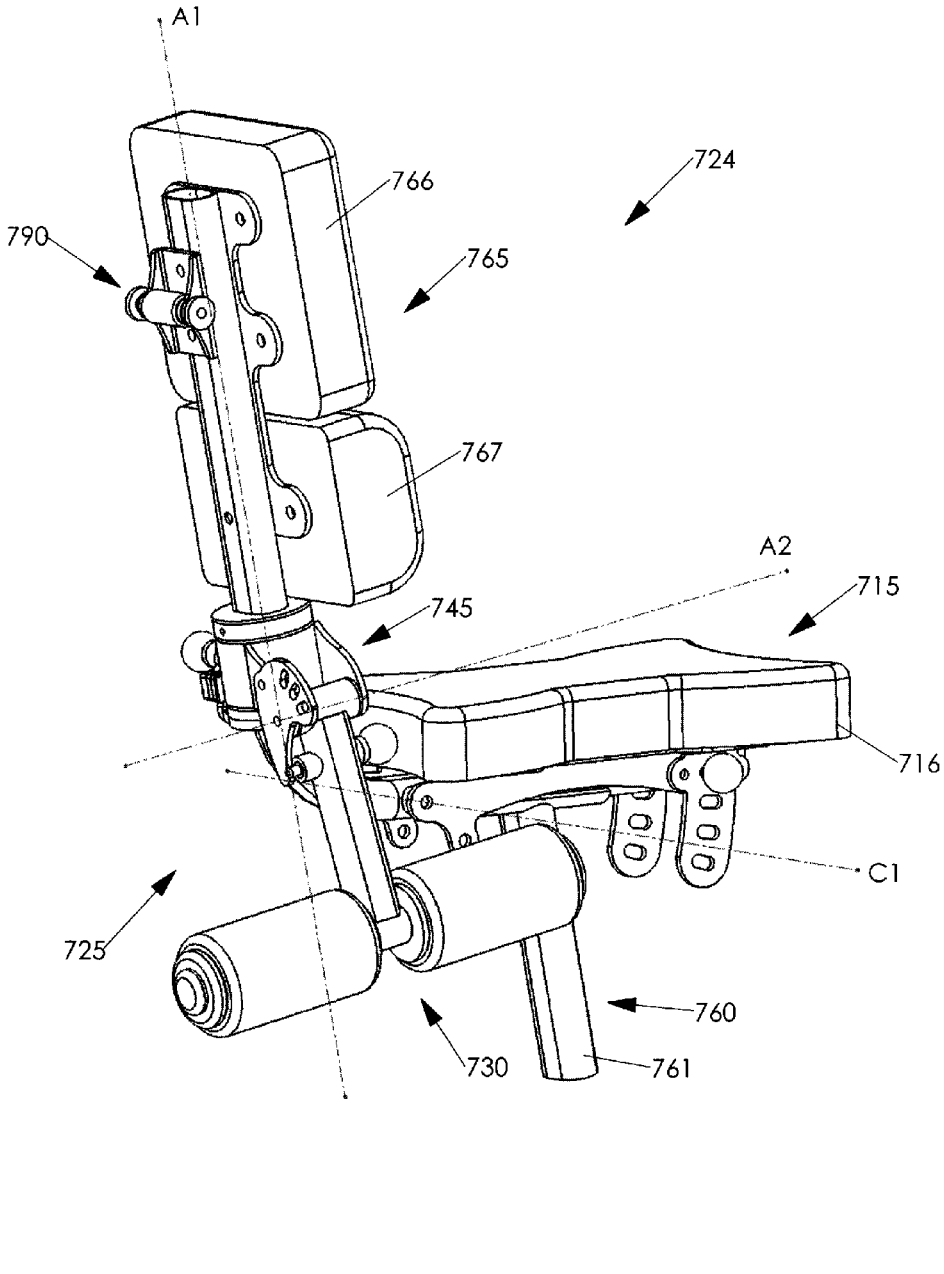
FIG. 30 is a perspective view illustrating the seat sub frame with the hold down roller assembly in the storage position from the right side.
Figure 31:
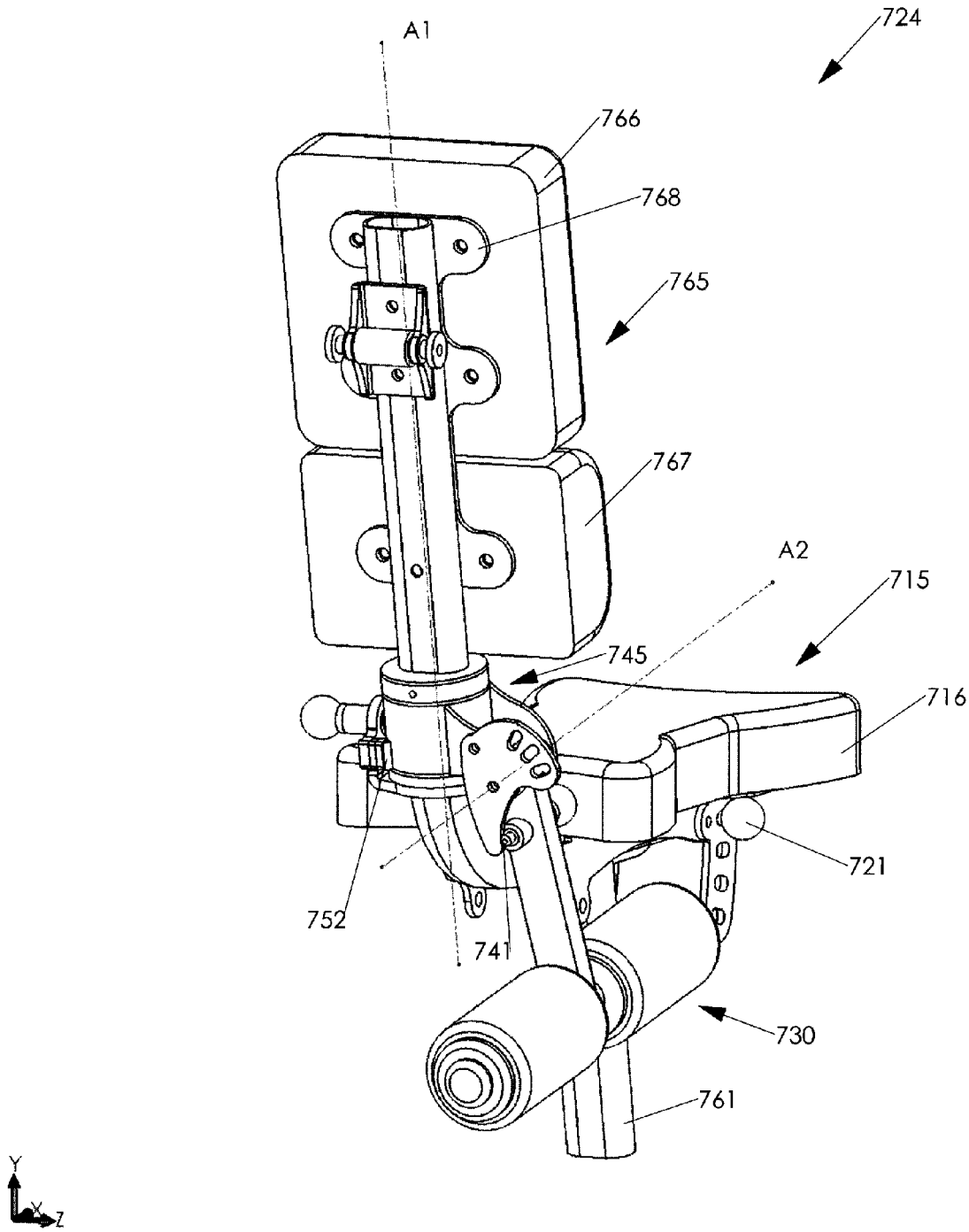
FIG. 31 is a perspective view illustrating the seat sub frame with the hold down roller assembly in the storage position from the back right side.
Figure 43:
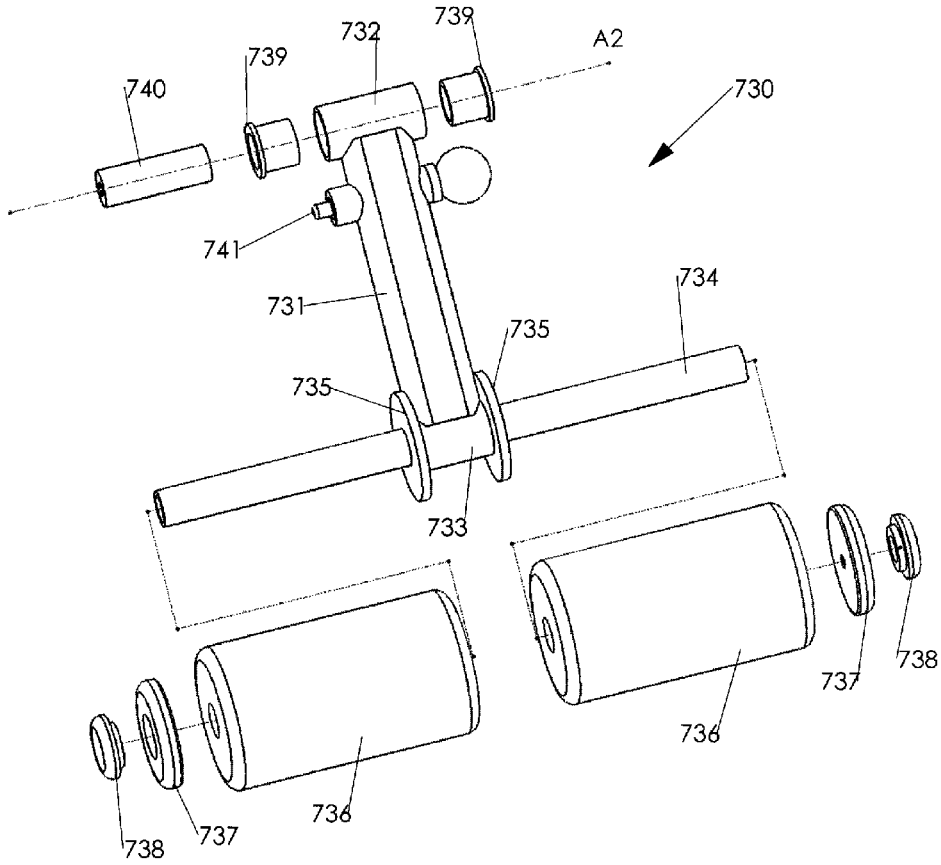
FIG. 43 is an exploded perspective view illustrating the roller assembly of the hold down assembly.
Figure 43:
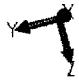

As illustrated in FIG. 32 the roller pad assembly 730 is pivotally attached to the swivel base assembly 745 and is rotatable about axis A2. The roller pad assembly 730 is pivotally attached to provide different height selections during use as well as to provide the ability to pivot downward into a storage position when not in use. As illustrated in FIG. 43, the roller pad assembly 730 comprises a sleeve 732 which is fitted with bushings 739 and axle 740 and is labeled with an axis of rotation A2. One end of hold down tube 731 is attached to sleeve 732 and the other end is attached to housing 733. Washers 735 are attached to the outer ends of housing 733. Roller tube 734 is centered in housing 733. Roller pads 736 fit over roller tube 734 and each outer end is secured with a respective flange cap 737 and a respective end cap 738. A locking pin 741 is attached through hold down tube 731 near sleeve 732 and is received by apertures 750 of adjustment plate 749 of the swivel base assembly 745. Also, as illustrated in FIGS. 30 and 31, locking pin 741 rests against the edge of adjustment plate 749 when the roller pad assembly 730 is in the storage position. To use the hold down assembly 725, the user pivots the roller pad assembly 730 upward about axis A2 out of the storage position and then engages the locking pin 741 into one of the apertures 750 in adjusting plate 749. The user then disengages locking pin 777 of the seat frame assembly 770 and rotates the hold down assembly 725 about axis A1 until the roller pad assembly 730 is in front of the back seat assembly 765. The user then engages locking pin 777 with an aperture 757 of the swivel base assembly 745. The user can adjust the height of the roller pad assembly 730 by unlocking locking pin 741, raising or lowering the roller pad assembly 730 to the desired height, then relocking locking pin 741 into the desired aperture 750 of adjusting plate 749. This will allow the user to perform high pull down exercises while being properly stabilized in a seated position.

Figure 29:
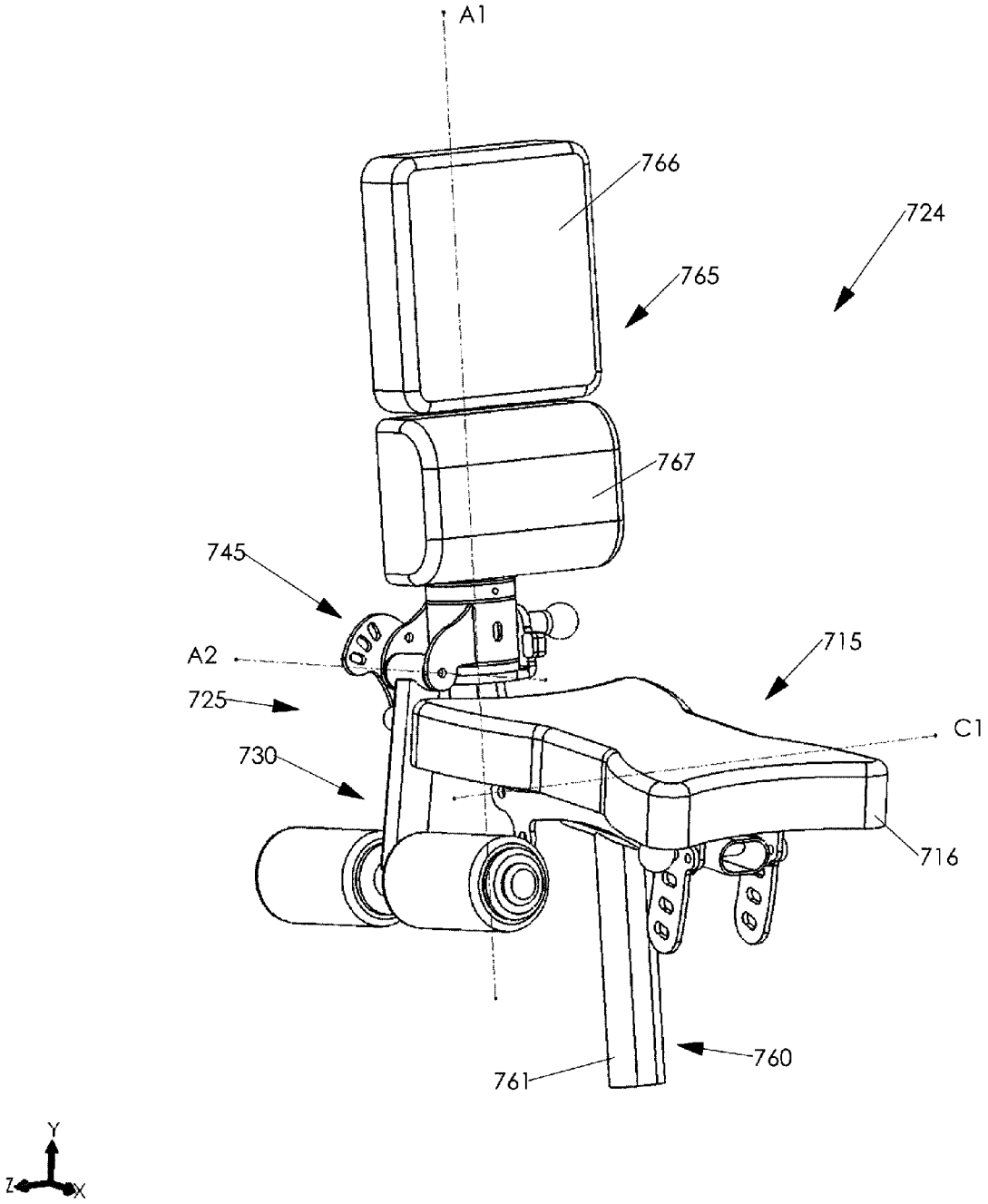
FIG. 29 is a perspective view illustrating the seat sub frame with the hold down roller assembly in the storage position from the front right side.
Figure 39:
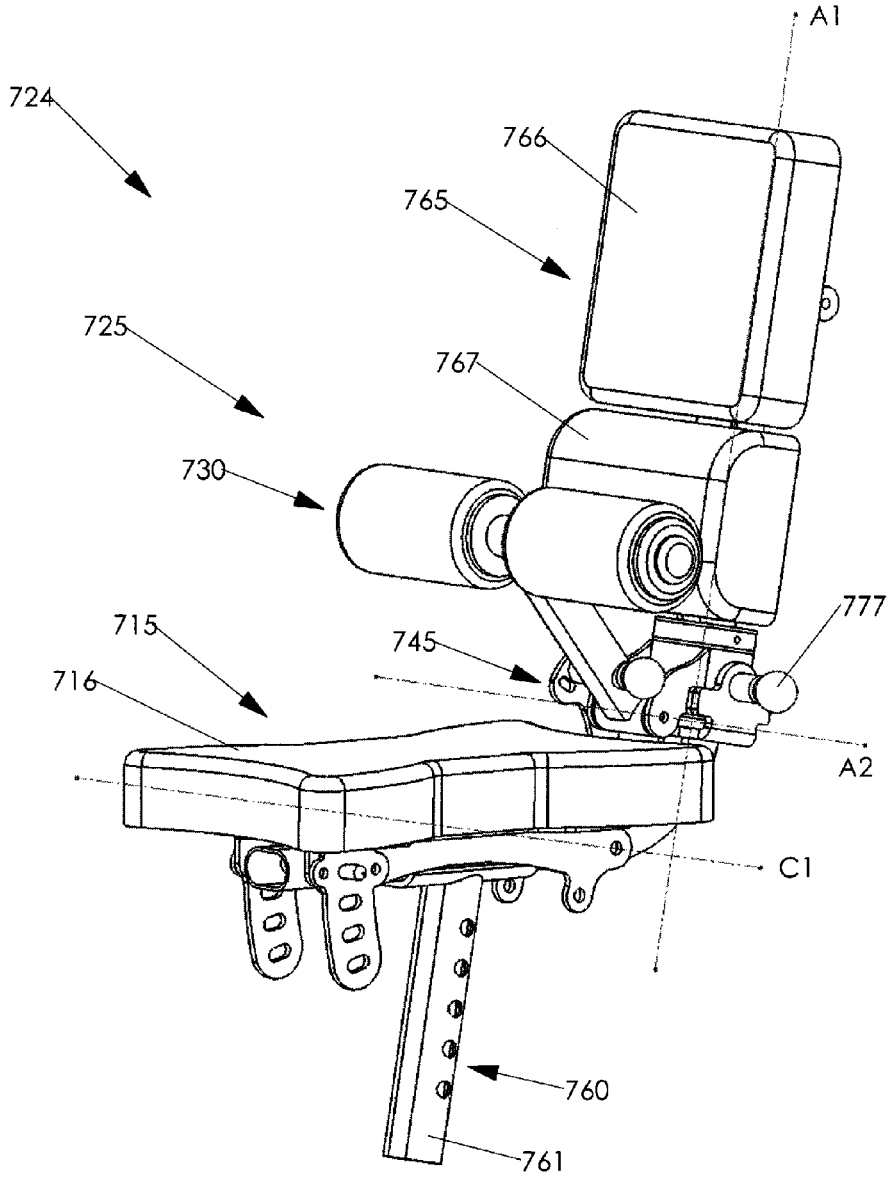
FIG. 39 is a perspective view illustrating the seat sub frame with the hold down roller assembly adjusted in front of the back pad in position for pull down exercises from the front left side.
Figure 39:
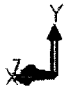
Figure 40:
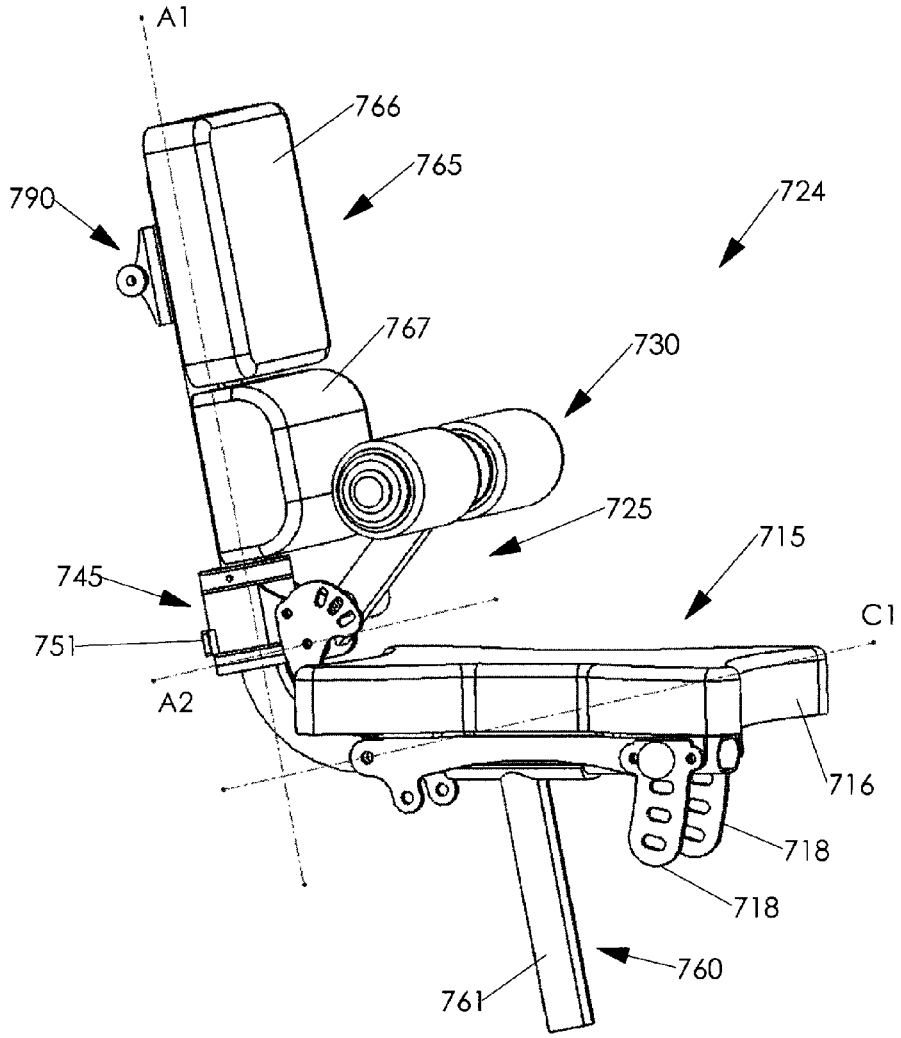
FIG. 40 is a perspective view illustrating the seat sub frame with the hold down roller assembly adjusted in front of the back pad in position for pull down exercises from the front right side.
Figure 40:
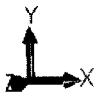
Figure 41:
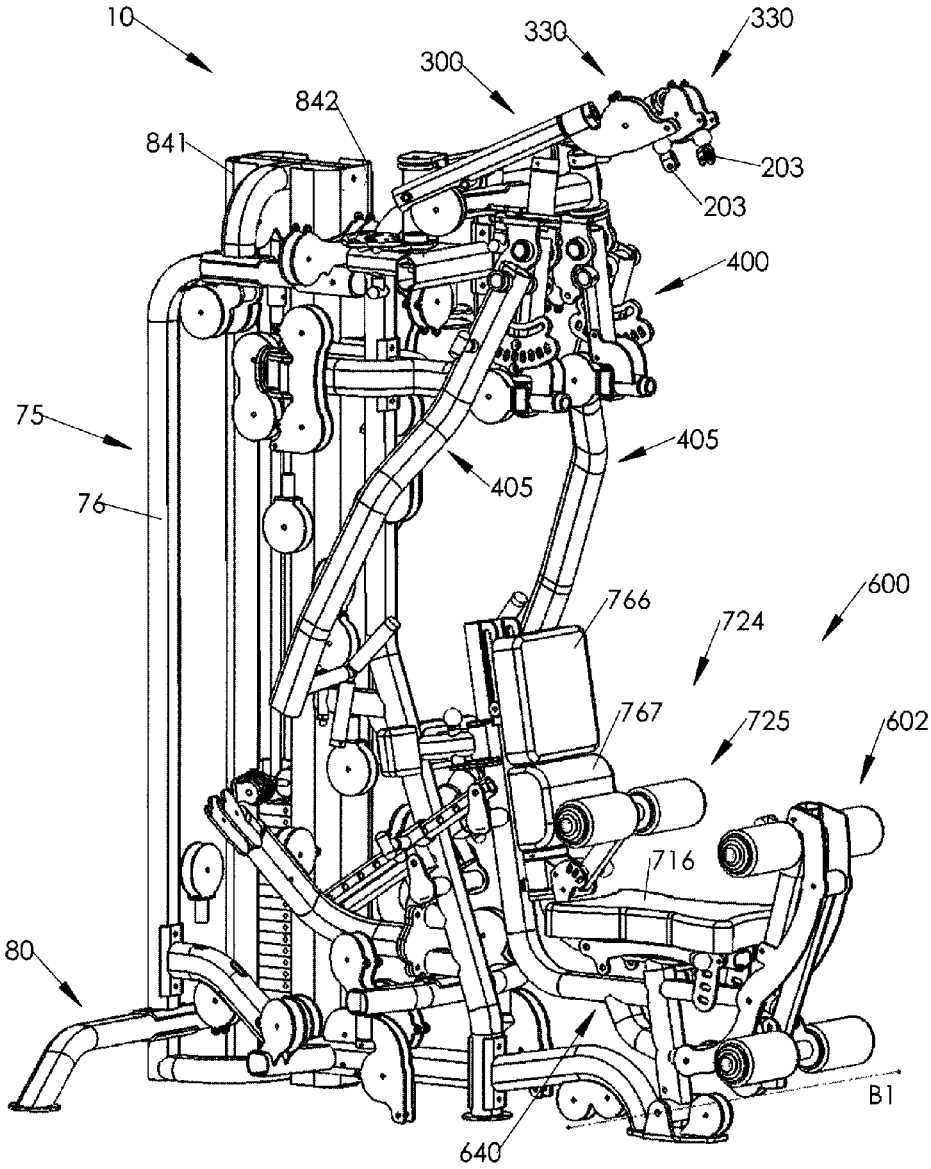
FIG. 41 is a perspective view illustrating the multi-station exercise gym from the front right side without the cables and pulleys wherein the hold down roller assembly is positioned in front of the back pad for pull down exercises, the seat assembly is positioned wherein the bottom seat pad is approximately parallel with the floor, and the width adjustable high pulleys are adjusted for narrow pull downs.
Figure 41:
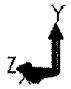

FIGS. 29-31 illustrate a hold down assembly 725 that is adjusted into a stored position. The roller pad assembly 730 is in a lowered position and partially tucked underneath the bottom seat assembly 715. In this position, the hold down assembly 725 does not get in the way of the user or will not interfere with any exercise movement of the user on the multi-station exercise gym 10. FIGS. 39 and 40 illustrate a hold down assembly 725 that is adjusted into a use position. The roller pad assembly 730 is adjusted to a position in front of the back seat assembly 765 wherein a user can place their upper thighs underneath and be secured into a seated position for high pull down exercises. FIG. 41 illustrates a multi-station exercise gym 10 wherein the hold down assembly 725 is adjusted into a use position as previously described, the adjustable width high pulley assembly 300 is adjusted into a narrow width setting for close grip pull down exercises, and the seat assembly 600 is adjusted slightly forward allowing the user to pull down a pair of handles (not shown) attached to straps 203 at a slight angle while being secured at the user's upper thighs into a seated position. The user can pivotally adjust the seat assembly 600 about axis B1 to select at what angle they want to pull downward. The more forward the seat assembly 600 is adjusted, the more of an angle the user will pull down at. As the seat assembly 600 is pivotally adjusted back and forth, the user can also angularly adjust the bottom seat assembly 715 to maintain a relatively parallel position if desired. Since the hold down assembly 725 is attached to the seat assembly 600, the roller pad assembly 730 will always keep proper contact with the users upper thighs at any position the seat assembly 600 is adjusted to. When finished performing high pull down exercises, the user can return the hold down assembly 725 back into the storage position. Those skilled in the art would appreciate that an exercise machine that did not have a pivoting seat assembly could still have an adjustable hold down assembly attached to a frame member and provide the same benefits of having hold down rollers that could be positioned in front of a back seat during use, then adjusted to a storage position out of the way of other exercises when not in use.

Figure 44:
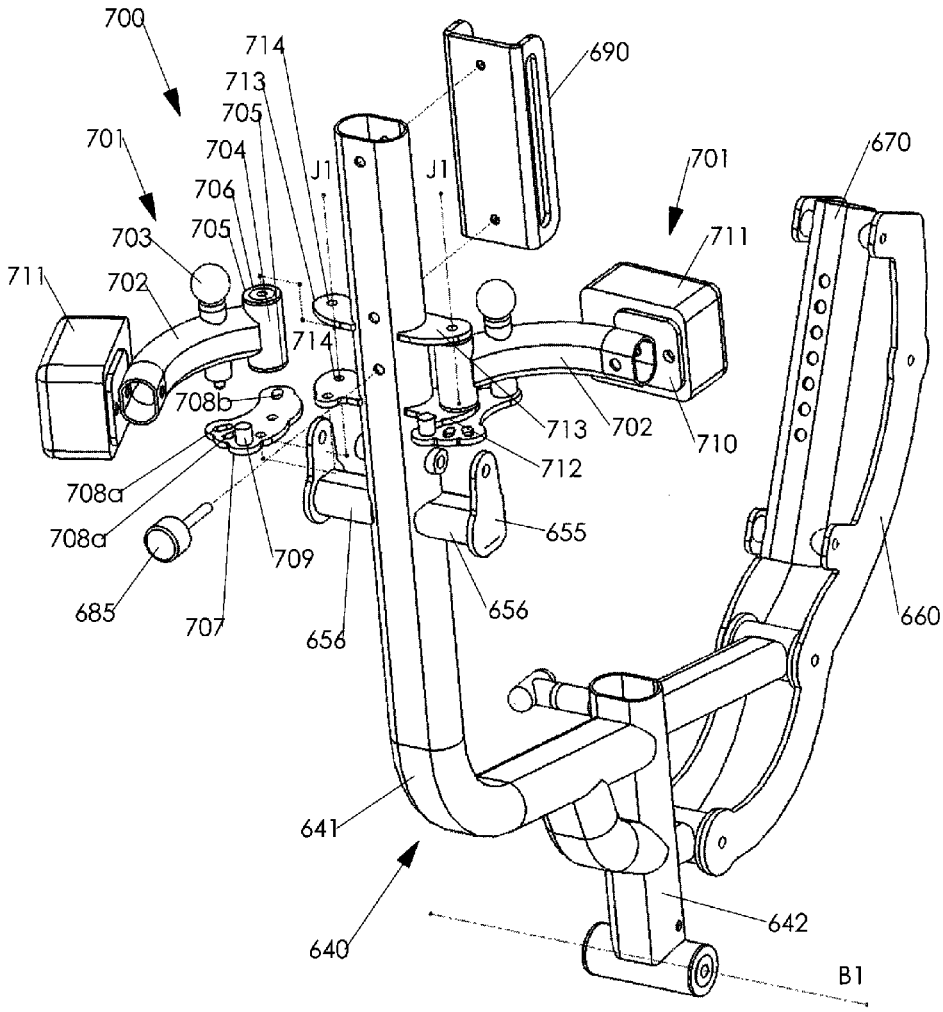
FIG. 44 is an exploded perspective view illustrating the seat main frame and the arm pad assemblies from the back right side.

In one embodiment, the seat main frame 640 also includes a bicep curl pad assembly 700. The bicep curl assembly 700 secures the users upper arms in a stable position as they perform seated bicep curls. As illustrated in FIG. 44, the bicep curl pad assembly 700 comprises a pair of arm pad assemblies 701 which are pivotally attached to the seat main frame 640 wherein a respective arm pad assembly 701 is rotatable about axis J1. Each respective arm pad assembly 701 is adjustable from a storage position into a use position wherein the arm pads are relatively adjacent to the outsides of the back seat assembly 765. Each respective arm pad assembly 701 comprises a sleeve 704 which is fitted with bushings 705, axle 706, and is pivotally attached with seat main frame 640 and is rotatable about a respective axis J1. Pivot tube 702 is attached at one end to sleeve 704 and is attached to a pad plate 710 on the other end. Arm pad 711 is secured to pad plate 710 and provides support to the user's upper arms. Locking pin 703 is attached to pivot tube 702 near sleeve 704. Adjustment plate 707 is attached to lower hinge plate 712 of seat main frame 640 and has apertures 708*a* and 708*b* formed therein which will receive locking pin 703. Bumper 709 is attached to adjustment plate 707 and bumpers locking pin 703 when the arm pad assemblies are adjusted to the inner most storage position. To adjust an arm pad assembly 701 from the storage position to the use position, the user unlocks locking pin 703 and pivots the arm pad assembly 701 forward and relocks the locking pin 703 into aperture 708*b*. The user does the reverse process to adjust the arm pad assembly 701 back into a storage position wherein locking pin 703 relocks into an aperture 708*a*. Those skilled in the art would appreciate that multiple storage apertures 708*a* could be used to vary the storage positions for the arm pad assemblies 701 as well as multiple use apertures 708*b* could be used to vary the angle of the arm pad assemblies 701 during use. Also, those skilled in the art would appreciate that an exercise machine that did not have a pivoting seat assembly could still have adjustable arm pad assemblies 701 attached to a frame member and provide the same benefits of arm pad assemblies 701 that could be positioned to the outsides of a back seat during use, then adjusted to a storage position out of the way of other exercises when not in use.

Figure 45:
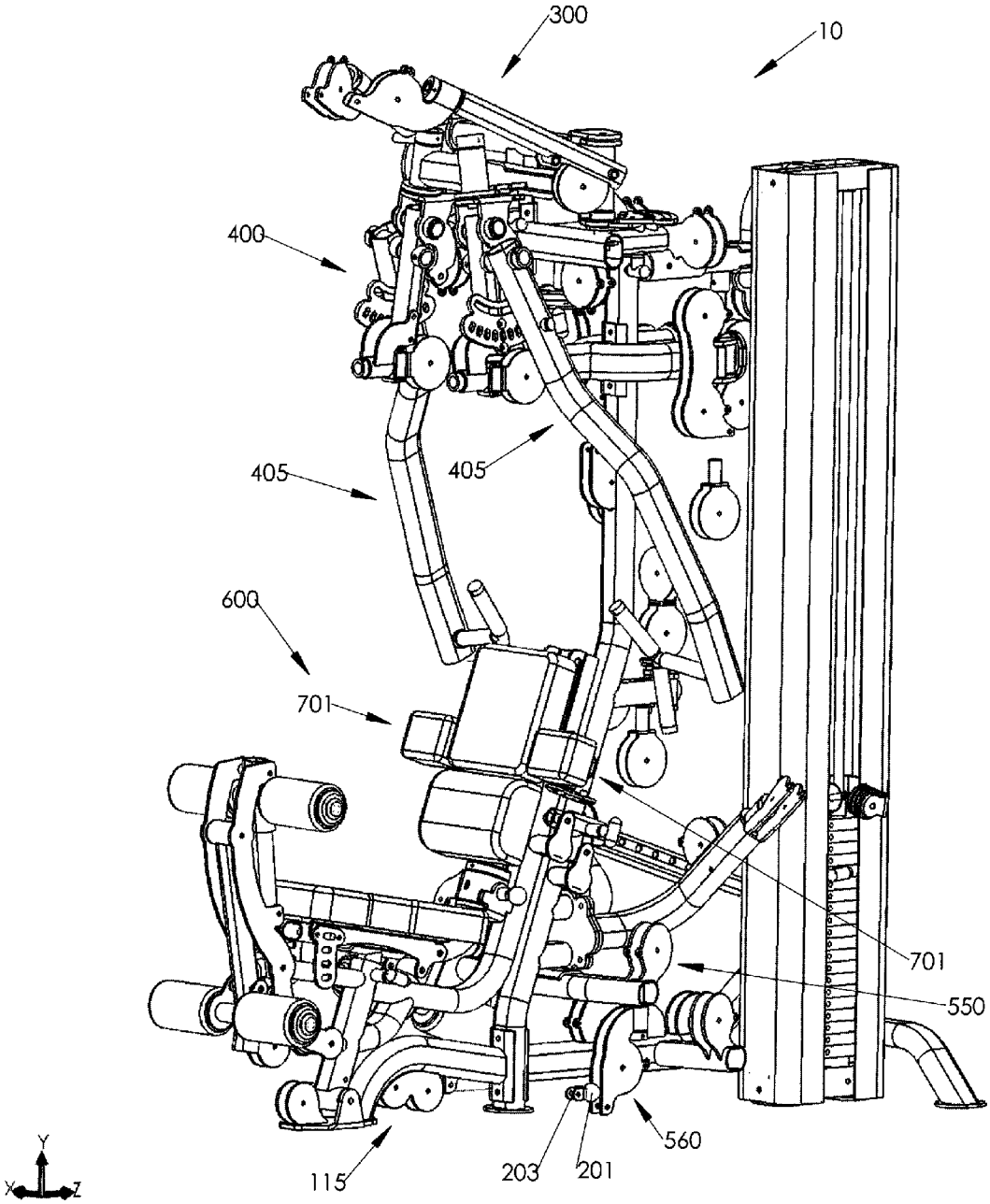
FIG. 45 is a perspective view illustrating the multi-station exercise gym from the front left side without the cables and pulleys wherein the arm pad assemblies are adjusted to the out position for seated bicep curl exercises.

FIG. 45 illustrates a multi-station exercise machine 10 wherein the arm pad assemblies 701 are adjusted into a use position. In use, after making the desired height and angular adjustments to the seat assembly 600 as previously discussed and after selecting the desired resistance amount which will be discussed later, the user would sit down facing forward and grasp a left, right, or both handles (not shown) that are attached to the straps 203 (right strap 203 is not shown) of the low pulley assembly 550. As previously discussed, the low pulley assembly 550 provides two swivel pulley assemblies 560 that are interconnected with cable system 200 which allows the user to press or pull from one or both sides independently or at the same time. The user would then brace their upper arms against the arm pad assemblies 701 and then curl their arms upward one at a time or together, whichever was desired. The user would then extend one or both arms downward to finish the repetition. Stabilizing the upper arms during seated bicep curls allows the user to isolate the bicep muscles. FIGS. 46-50 illustrate a multi-station exercise gym 10 wherein the arm pad assemblies 701 are adjusted into the storage position and the seat assembly 600 and the path adjustable arm assembly 400 are adjusted into various positions for various exercises. When in the storage position, the arm pad assemblies 701 are out of the way of all of the exercise stations on the multi-station exercise gym 10 and do not interfere with any exercise movement performed. If the arm pad assemblies 701 were fixed in a stationary use position wherein the arm pads were relatively outward and adjacent to the back seat assembly 765, they would interfere with almost all pressing and pulling exercise movements.

FIGS. 46-50 illustrate multi-station exercise gym 10 wherein the lever arm assemblies 405 of the path adjustable arm assembly 400 along with the seat assembly 600 are adjusted to perform specific pressing and pulling exercises. Numerous different pressing and pulling exercises can be performed because as seat assembly 600 pivots back and forth about axis B1 as previously described, the orientation between the seat assembly 600 and the X1 axes of exercise of the adjustable path arm assembly 400 changes. This alters the travel path of the arm assemblies 405 in relation to the seat assembly 600, where the user is sitting. Also, because the arm assemblies 405 are pivotally adjustable about axes X3, the handle assemblies 412 can be positioned within comfortable reach of the user for any position the seat assembly 600 is adjusted to.

Figure 46:
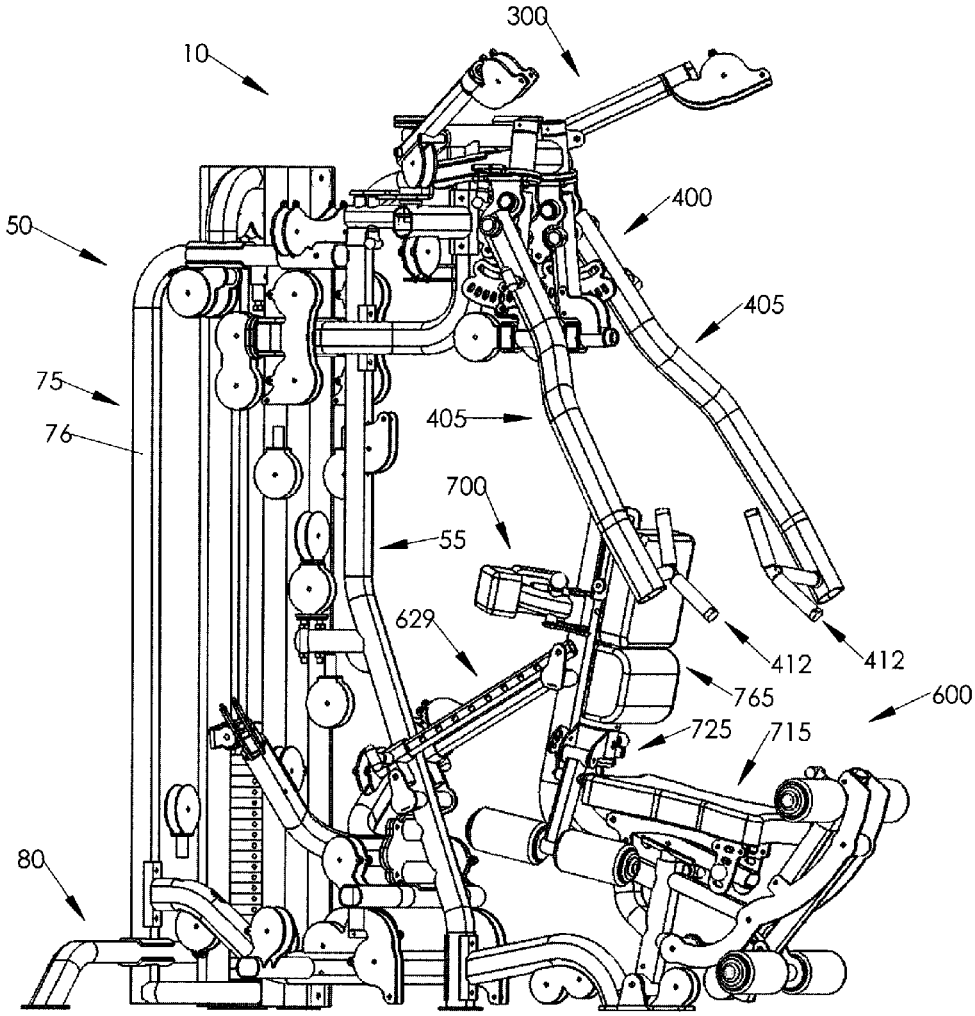
FIG. 46 is a perspective view illustrating the multi-station exercise gym from the front right side without the cables and pulleys wherein the seat assembly and exercise arms are adjusted to a shoulder press position.
Figure 46:
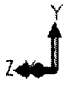

As illustrated in FIG. 46, the seat assembly 600 is adjusted wherein the back seat assembly 765 is approximately 10 degrees forward of vertical. This puts the X1 axes of exercise substantially behind the back seat assembly 765 of the seat assembly 600. This would cause an upward motion of the arm assemblies 405 as the user sits facing forward on seat assembly 600 and presses the handle assemblies 412. Therefore, in FIG. 46, the multi-station exercise gym 10 is adjusted for performing shoulder presses. The lever arm assemblies 405 of the path adjustable arm assembly 400 are adjusted to wherein the handle assemblies 412 are within comfortable starting reach. The bottom seat assembly 715 is angularly adjusted to an upper position so the user sits in a comfortable 90 degree or slightly open position. Because the hold down assembly 725 and the bicep curl pad assembly 700 are in their respective storage positions, the user is able to comfortably sit in the seat assembly 600 and perform exercise without interference during the movement. To perform shoulder presses, the user sits down facing forward on seat assembly 600 and grasps the handle assemblies 412 and presses as the arm assemblies 405 follow an upward path.

Figure 47:
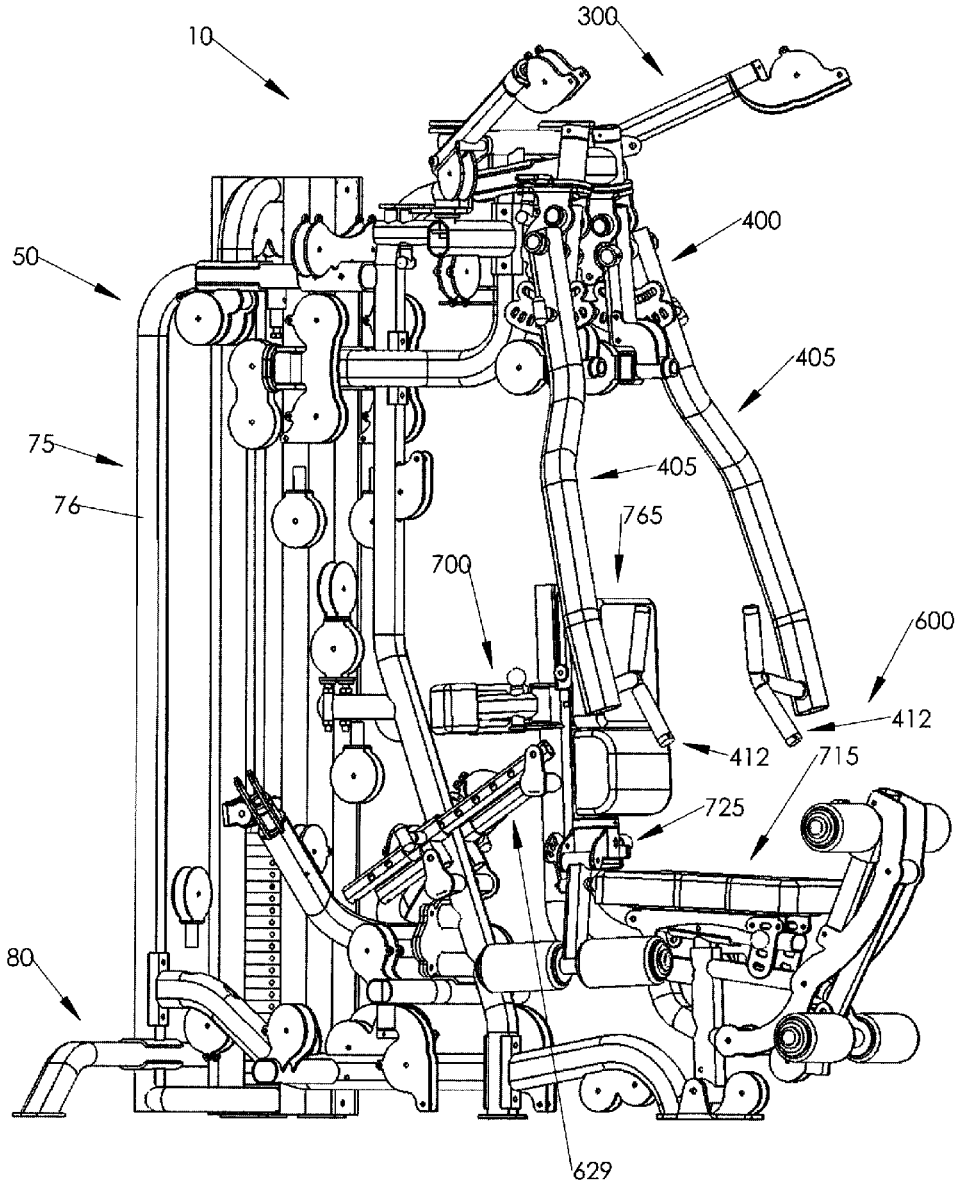
FIG. 47 is a perspective view illustrating the multi-station exercise gym from the front right side without the cables and pulleys wherein the seat assembly and exercise arms are adjusted to an incline press position.
Figure 47:
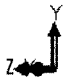

As illustrated in FIG. 47, the seat assembly 600 is adjusted wherein the back seat assembly 725 is approximately vertical. This puts the X1 axes of exercise relatively over top of the back seat assembly 765 of the seat assembly 600. This would cause an inclining motion of the arm assemblies 405 as the user sits facing forward on seat assembly 600 and presses the handle assemblies 412. Therefore, in FIG. 47, the multi-station exercise gym 10 is adjusted for performing incline chest presses. The lever arm assemblies 405 of the path adjustable arm assembly 400 are adjusted to wherein the handle assemblies 412 are within comfortable starting reach. The bottom seat assembly 715 is angularly adjusted to a lower position so the user sits in a comfortable 90 degree or slightly open position. Because the hold down assembly 725 and the bicep curl pad assembly 700 are in their respective storage positions, the user is able to comfortably sit in the seat assembly 600 and perform exercise without interference during the movement. To perform incline presses, the user sits down facing forward on seat assembly 600 and grasps the handle assemblies 412 and presses as the arm assemblies 405 follow an inclining path.

Figure 48:
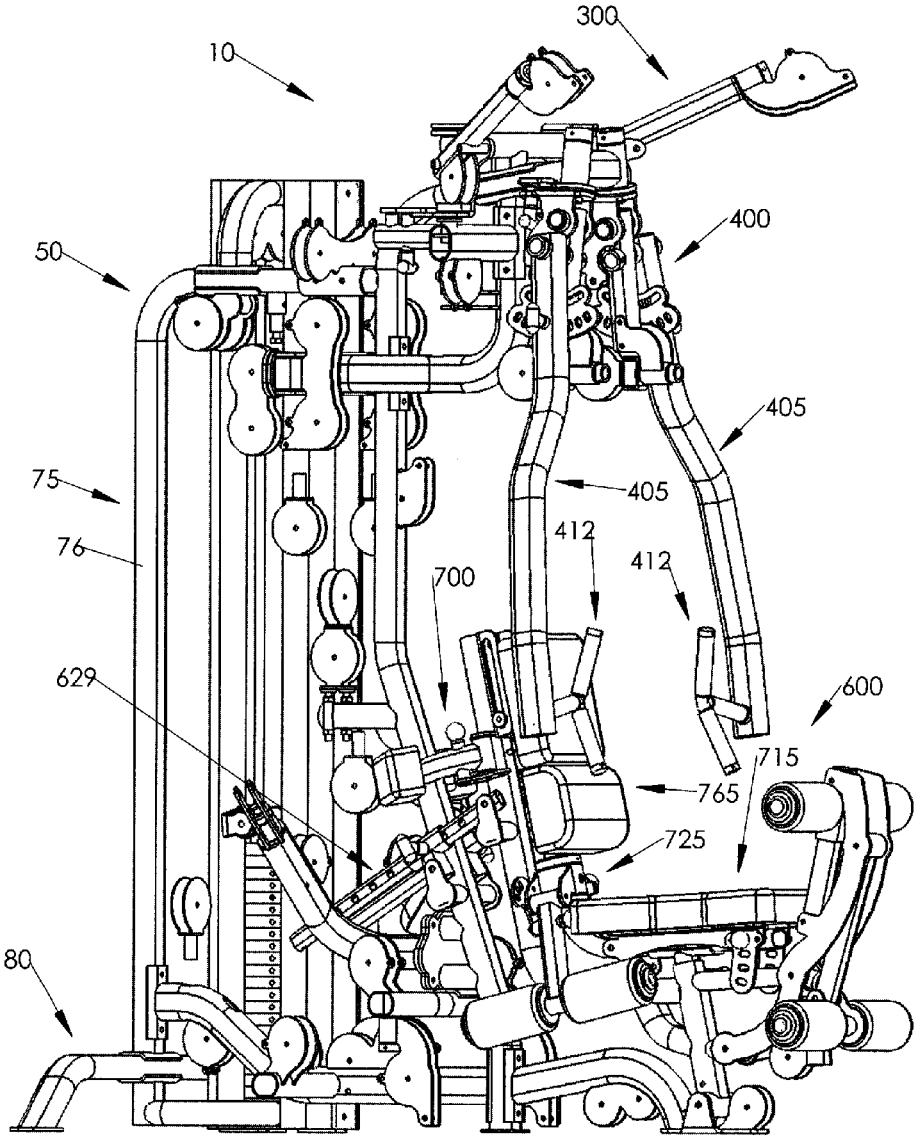
FIG. 48 is a perspective view illustrating the multi-station exercise gym from the front right side without the cables and pulleys wherein the seat assembly and exercise arms are adjusted to a chest press position.
Figure 48:
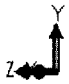

As illustrated in FIG. 48, the seat assembly 600 is adjusted wherein the back seat assembly 765 is approximately 10 degrees short of vertical. This puts the X1 axes of exercise slightly in front of the back seat assembly 765 of the seat assembly 600. This would cause an outward motion of the arm assemblies 405 as the user sits facing forward on seat assembly 600 and presses the handle assemblies 412. Therefore, in FIG. 48, the multi-station exercise gym 10 is adjusted for performing neutral chest presses. The lever arm assemblies 405 of the path adjustable arm assembly 400 are adjusted to wherein the handle assemblies 412 are within comfortable starting reach. The bottom seat assembly 715 is angularly adjusted to a lower position so the user sits in a comfortable 90 degree or slightly open position. Because the hold down assembly 725 and the bicep curl pad assembly 700 are in their respective storage positions, the user is able to comfortably sit in the seat assembly 600 and perform exercise without interference during the movement. To perform neutral chest presses, the user sits down facing forward on seat assembly 600 and grasps the handle assemblies 412 and presses as the arm assemblies 405 follow an outward path.

Figure 49:
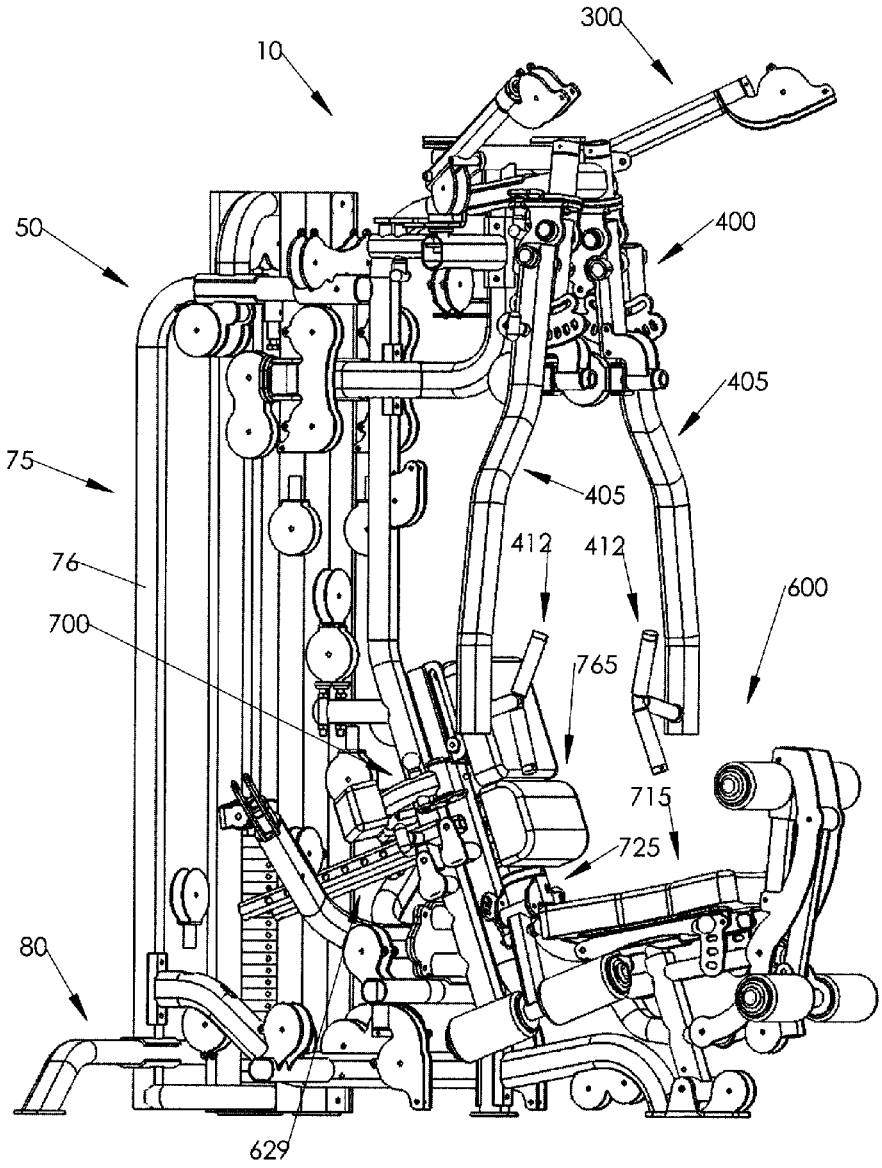
FIG. 49 is a perspective view illustrating the multi-station exercise gym from the front right side without the cables and pulleys wherein the seat assembly and exercise arms are adjusted to a decline press position.
Figure 49:
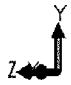

As illustrated in FIG. 49, the seat assembly 600 is adjusted wherein the back seat assembly 765 is approximately 20 degrees short of vertical. This puts the X1 axes of exercise substantially in front of the back seat assembly 765 of the seat assembly 600. This would cause a declining motion of the arm assemblies 405 as the user sits facing forward on seat assembly 600 and presses the handle assemblies 412. Therefore, in FIG. 49, the multi-station exercise gym 10 is adjusted for performing decline chest presses. The lever arm assemblies 405 of the path adjustable arm assembly 400 are adjusted to wherein the handle assemblies 412 are within comfortable starting reach. The bottom seat assembly 715 is angularly adjusted to a lower position so the user sits in a comfortable 90 degree or slightly open position. Because the hold down assembly 725 and the bicep curl pad assembly 700 are in their respective storage positions, the user is able to comfortably sit in the seat assembly 600 and perform exercise without interference during the movement. To perform decline chest presses, the user sits down facing forward on seat assembly 600 and grasps the handle assemblies 412 and presses as the arm assemblies 405 follow a declining path.

Figure 50:
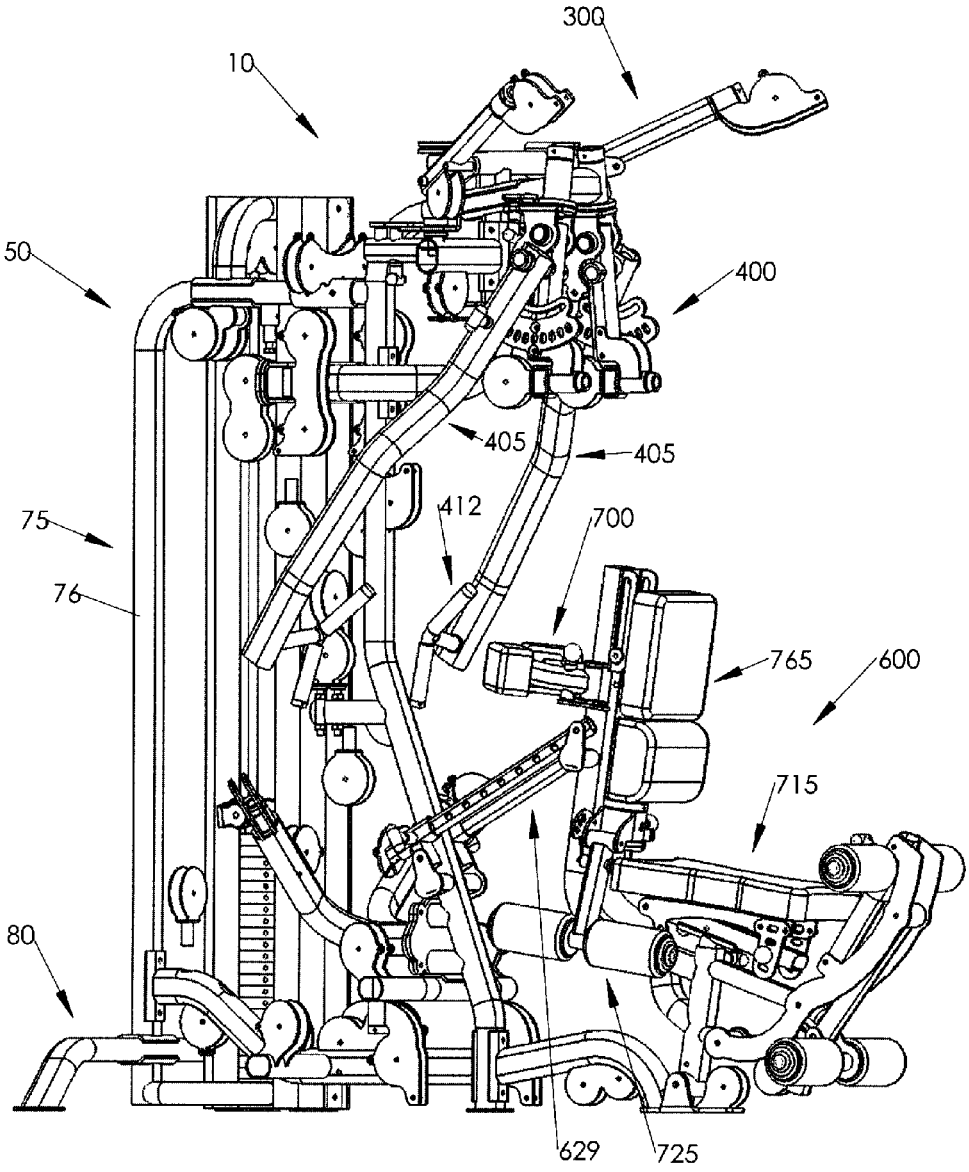
FIG. 50 is a perspective view illustrating the multi-station exercise gym from the front right side without the cables and pulleys wherein the seat assembly and exercise arms are adjusted to a mid row position.
Figure 50:
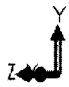

As illustrated in FIG. 50, the seat assembly 600 is adjusted wherein the back seat assembly 765 is approximately 10 degrees forward of vertical. This puts the X1 axes of exercise substantially behind the back seat assembly 765 of the seat assembly 600. This would cause an upward motion of the arm assemblies 405 as the user sits facing forward on seat assembly 600 and presses the handle assemblies 412. However, in this FIG. 50, the arm assemblies 405 are adjusted towards the back of the multi-station exercise gym 10, therefore it is adjusted for performing mid row pulling exercises. Therefore, because the user sits down on seat assembly 600 facing towards the back and their chest is supported on the back seat assembly 765, the X1 axes of exercise are positioned in front of the back seat assembly 765 in relation to the front of the user. This would cause a declining and inward motion of the arm assemblies 405 as the user sits facing backward on seat assembly 600 and pulls the hand assemblies 412. As illustrated in FIG. 50, the lever arm assemblies 405 of the path adjustable arm assembly 400 are adjusted to wherein the handle assemblies 412 are within comfortable starting reach. The bottom seat assembly 715 is angularly adjusted to an upper position so the user sits in a comfortable 90 degree or slightly open position. Because the hold down assembly 725 and the bicep curl pad assembly 700 are in their respective storage positions, the user is able to comfortably sit in the seat assembly 600 and perform exercise without interference during the movement. To perform mid row pulling exercises, the user sits down facing backward on seat assembly 600 and grasps the handle assemblies 412 and pulls as the arm assemblies 405 follow a declining and inward path.

Figure 51:
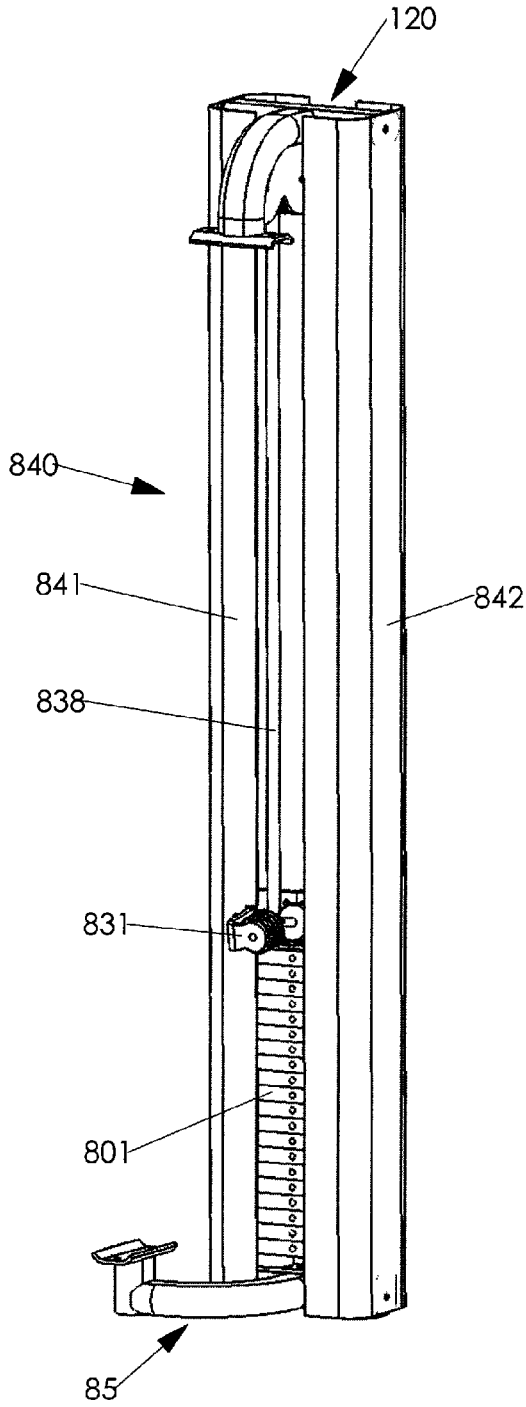
FIG. 51 is a perspective view illustrating a portion of the frame, the weight stack shrouds, the weight stack, the guide rods, and one embodiment of the incremental weight system.
Figure 51:
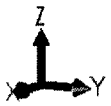
Figure 53:
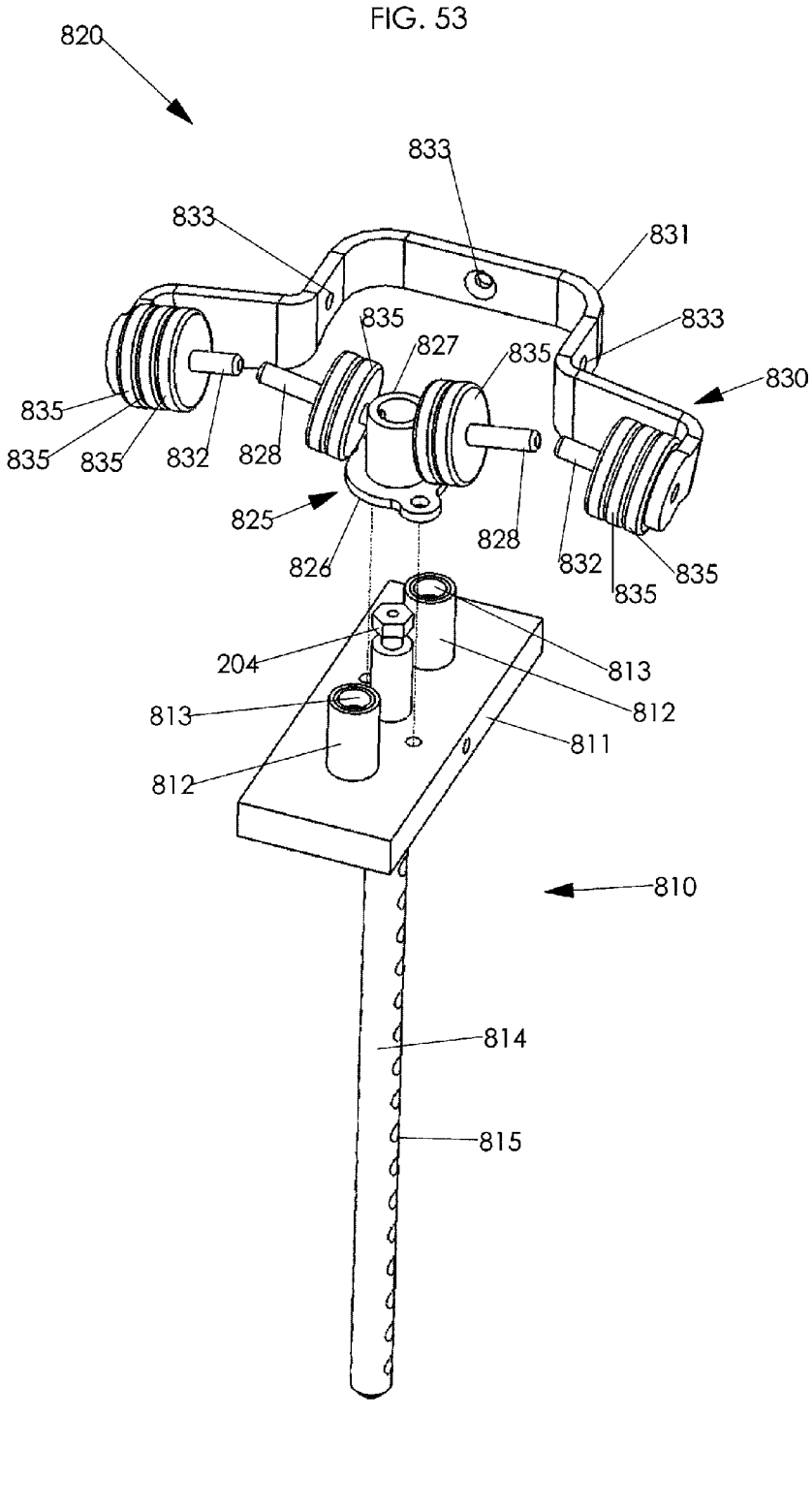
FIG. 53 is an exploded perspective view illustrating one embodiment of the incremental weight system and the top plate assembly of the weight stack.

In one embodiment, the resistance element for the multi-station gym 10 is a weight stack. FIGS. 51-53 illustrate a weight stack 800, weight stack guide rods 838, incremental weight system 820, weight stack shroud assembly 840, and a portion of frame 50. The weight stack 800 provides the resistance for all the stations of the multi-station gym 10. The weight stack 800 comprises a top plate assembly 810, individual weight plates 801, and weight pin 803. The top plate assembly 810 comprises top plate 811, sleeves 812, bushings 813, and selector shaft 814. The top plate assembly 810 fits on top of the individual weight plates 801. The weight stack 800 rests on bumpers 805 which sit on the weight stack bottom assembly 85. The weight stack 800 is retained by the guide rods 838 which are retained by the weight stack bottom assembly 85 on the bottom and the guide rod top assembly 120 on the top. The user selects the amount of resistance desired by inserting weight pin 803 into a selected aperture 802 of the weight plates 801 which goes through a respective aperture 815 of the selector shaft 814. Bushings 813 of the top plate assembly 810 journal guide rods 838 as the weight stack 800 slides up and down during exercise movements on multi-station exercise gym 10. As previously discussed, one bolt 204 of cable assembly 215 of the main cable sector 210 connects the weight stack 800 to the cable and pulley system 200.

The incremental weight system 820 provides auxiliary weights that can be added to the weight stack 800, therefore providing the user the ability to select smaller incremental changes in the amount of resistance for exercise performed. The incremental weight system 820 comprises a weight storage assembly 830, which is attached to the weight stack shroud assembly 840, and a weight stack mounting assembly 825, which is attached to the top of the weight stack 800. The weight storage assembly 830 stores the auxiliary weights 835 on both sides of the weight stack 800 wherein the user can slide equal amounts of auxiliary weights 835 onto the weight stack mounting assembly 825. This will minimize friction as the weight stack slides up and down during exercise. In one embodiment, the weight storage assembly 830 comprises a bracket 831 that is bent into a shape wherein storage pins 832 are attached on opposite sides and are generally facing each other. The storage pins 832 are for holding auxiliary weights 835 and are angled slightly upward. The bent shape of bracket 831 matches the bent shape of weight stack shroud 841. The apertures 833 of the weight storage assembly 830 line up with the apertures 843 of the weight stack shroud 841 wherein the weight storage assembly 830 is attached to the inside of the weight stack shroud 841. The cost to manufacture an incremental weight system is greatly reduced by attaching the stored auxiliary weights directly to the weight stack shroud 841. Those skilled in the art would appreciate that different shaped brackets could be made to be attached to one or both of the weight stack shrouds. Also, more than one auxiliary weight storage holder could be attached to one or more weight stack shroud.

The weight stack mounting assembly 825, as previously discussed, is attached to the top of the weight stack 800 and provides means to accept auxiliary weights on opposite sides of the weight stack 800 in order to balance the resistance load during exercise movements. In one embodiment, the weight stack mounting assembly 825 comprises a sleeve 827 that slides over selector shaft 814. A base plate 826 is attached to the bottom of sleeve 827 and is attached to the top of top plate 811. Mounting pins 828 are attached on opposite sides of sleeve 827. The mounting pins 828 are angled slightly upward and receive the auxiliary weights 835 when the extra weight is added to the weight stack 800. When the weight stack 800 is in the rest position, the storage pins 832 on the weight storage assembly 830 line up with the mounting pins 828 on the weight stack mounting assembly 825. Prior to exercising, the user can slide auxiliary weights 835 back and forth from the weight storage assembly 830 to the weight stack mounting assembly 825 or vice versa. Because equal amounts of auxiliary weights 835 can be mounted on both sides of the weight stack 800 and because there is not a secondary tracking system for the auxiliary weights to follow, friction is minimized.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An exercise machine comprising:

a main support frame;

at least one resistance element to provide resistance for performing exercise;

an adjustable seat assembly for supporting a user during exercise in both forward facing and rearward facing positions, said seat assembly including a seat bottom and a seat back pivotally attached to said main support frame so as to pivot about a common axis, said seat bottom and seat back being adjustable as a unit to multiple fixed positions between a rearwardly inclined position to a forwardly inclined position;

a seat adjustment mechanism to adjust said seat assembly to a desired position, said seat adjustment mechanism including a locking mechanism to lock said seat assembly in said fixed positions;

a first exercise station including a leg exercise arm for performing leg extension and leg curl exercises pivotally mounted to said seat assembly and rotatable about a leg exercise arm pivot axis and connected by a cable system to said resistance element wherein said resistance element resists rotation of said leg exercise arm, said leg exercise arm pivot axis adjustable to multiple fixed positions by adjusting said seat assembly; and a second exercise station connected by said cable system to said resistance element, wherein said second exercise station is engageable by said user to perform exercise while seated on said seat assembly in forwardly and rearwardly facing positions with the required range of motion, and wherein said resistance element displaces during said forward facing and said rearward facing exercise.

2. The exercise machine of claim 1 wherein said seat assembly comprises a seat main frame and a seat sub frame adjustably mounted to said seat main frame, said seat sub frame including said seat bottom and said seat back.

3. The exercise machine of claim 2 wherein said seat bottom is pivotally mounted to said seat sub frame.

4. The exercise machine of claim 1 wherein said seat assembly pivots away from said main support frame when said seat assembly is adjusted forward.

5. The exercise machine of claim 1 wherein one exercise station comprises a pressing and pulling exercise arm station and wherein pivotally adjusting said seat assembly alters the angular orientation and the distance of said seat assembly in relation to said pressing and pulling exercise arm station.

6. The exercise machine of claim 5 wherein said seat assembly is pivotally adjustable to a generally rearwardly inclined first position for performing downward presses and outward presses, to a generally vertical second position for performing inclined presses, and to a generally forwardly inclined third position for performing upward presses; all with the user facing forward.

7. The exercise machine of claim 5 wherein said seat assembly is pivotally adjustable to a generally forwardly inclined position for performing inward pulls with a full range of motion with the user facing rearward.

8. The exercise machine of claim 1 wherein one exercise station comprises a high pull down exercise station and wherein pivotally adjusting said seat assembly alters the angular orientation and distance of said seat assembly in relation to said high pull down exercise station.

9. The exercise machine of claim 8 wherein said seat assembly is pivotally adjustable to a first position for performing pulling exercises in a forwardly facing position and adjustable to a second position for performing pulling exercises in a rearwardly facing position.

10. The exercise machine of claim 8 wherein said seat assembly is pivotally adjustable to a first position for performing high pull down exercise at a first pulling angle and pivotally adjustable to a second position for performing high pull down exercise at a second pulling angle different than said first pulling angle.

11. The exercise machine of claim 8 wherein said high pull down exercise station includes two arm extensions pivotally mounted to said frame so as to each pivot in lateral directions, a respective locking mechanism to lock each arm extension into multiple fixed positions, a pulley movably mounted at the distal end of each said arm extension, two cable ends within said cable system partially wrapping around and extending beyond respective said pulleys, and a pull handle connected to each said cable end, wherein laterally adjusting said arm extensions varies the lateral distance between said pull handles, and wherein said pull handles are pulled in user defined paths during exercise.

12. The exercise machine of claim 11 wherein said seat assembly is pivotally adjustable to a first position for performing pulling exercises in a forwardly facing position and adjustable to a second position for performing pulling exercises in a rearwardly facing position.

13. The exercise machine of claim 11 wherein said seat assembly is pivotally adjustable to a first position for performing high pull down exercise at a first pulling angle and pivotally adjustable to a second position for performing high pull down exercise at a second pulling angle different than said first pulling angle.

14. The exercise machine of claim 11 wherein said pull handles are laterally adjustable to respective positions greater than two feet in distance apart from one another for performing standing cable cross exercises in a forwardly facing position and wherein said seat assembly is pivotally adjustable to a position for supporting the user's backside.

15. The exercise machine of claim 1 wherein one exercise station comprises a mid pulley assembly including two swiveling outer pulleys mounted to said frame, two cable ends within said cable system partially wrapping around and extending beyond respective said pulleys, and a pull handle connected to each said cable end for pressing and pulling in a user defined paths during exercise, and wherein pivotally adjusting said seat assembly alters the angular orientation and the distance of said seat assembly in relation to said mid pulley assembly.

16. The exercise machine of claim 15 wherein said seat assembly is pivotally adjustable to a generally rearwardly inclined position for performing pressing exercises while the user sits on said seat assembly facing forward.

17. The exercise machine of claim 15 wherein said seat assembly is pivotally adjustable to a generally forwardly inclined position for performing pulling exercises while the user sits on said seat assembly facing rearward.

18. The exercise machine of claim 1 wherein one exercise station comprises a low pulley assembly including two swiveling low pulleys mounted to said frame, two cable ends within said cable system partially wrapping around and extending beyond respective said pulleys, and a pull handle connected to each said cable end for pressing and pulling in user defined paths during exercise, and wherein pivotally adjusting said seat assembly alters the angular orientation and the distance of said seat assembly in relation to said low pulley assembly.

19. The exercise machine of claim 1 wherein said seat adjustment mechanism comprises:

two sleeve assemblies pivotally attached to said main support frame;

respective locking pins attached to respective said sleeve assemblies; and two tube assemblies with apertures formed therein pivotally attached to said seat assembly and slidingly adjustable into respective said sleeve assemblies.

20. An exercise machine comprising:

a main support frame;

at least one resistance element to provide resistance for performing exercise;

a cable system connecting at least one exercise station to said resistance element;

an exercise station including two handles connected to said cable system for pulling to perform bicep curl exercises mounted to said main support frame, said resistance element displaced when said handles are pulled;

an exercise station including two handles connected to said cable system to perform chest press exercise or back row pulling exercise mounted to said main support frame, said resistance element displaced when said handles are pressed or pulled;

an adjustable seat assembly including a seat bottom and a seat back for supporting a user during said exercise, said seat assembly pivotally mounted to said frame wherein said seat bottom and said seat back are adjustable as a unit to multiple fixed positions along a curved path;

at least one locking mechanism to lock said seat assembly into said multiple fixed positions;

a left and a right arm pad assembly pivotally mounted to, said seat assembly behind said seat back, each said arm pad assembly including an arm pad for supporting said user's respective arm during bicep curl exercise;

at least one locking mechanism to lock said left and right arm pad assemblies into multiple fixed positions; and wherein each said arm pad assembly is adjustable between a first position wherein said arm pad is disposed behind said seat back to allow a clear path for said user's arms while grasping said handles during chest press or back row exercise, and a second position wherein said arm pad is disposed generally along a respective side of said seat back for supporting said user's respective arm during bicep curl exercise, and wherein said seat assembly and said arm pads can be adjusted together as a unit outward along a curved path to said multiple fixed positions to vary the distance between said arm pads and said handles of said bicep curl station to alter the pulling angle during arm supported bicep curl exercises.

21. An exercise machine comprising:

a main support frame;

at least one resistance element to provide resistance for performing exercise;

a cable system connecting at least two exercise stations to said resistance element;

a first exercise station including at least one handle or bar connected to said cable system for pulling to perform pull down exercises mounted to said main support frame, said resistance element displaced when said at least one handle or said bar is pulled;

a seat bottom and a seat back for supporting a user during exercise;

a second exercise station connected to said cable system and mounted to said main support frame for performing a second exercise, said seat bottom and said seat back for supporting said user during said second exercise, said resistance element displaced during exercise by said user at said second exercise station;

a hold down assembly pivotally mounted adjacent to said seat bottom and said seat back and rotatable about two axes, said hold down assembly including at least one leg pad for supporting a user's upper legs during pull down exercises, said at least one leg pad adjustable laterally and vertically between a first position disposed below said seat bottom to allow a user to sit on and obtain support from said seat bottom and said seat back while performing exercise with said second exercise station, the length of said at least one leg pad disposed generally perpendicular with the face of said seat back in said first position, and a second position disposed above said seat bottom and in front of said seat back to engage said user's upper legs to prevent said user from lifting upward during pull down exercises, the said length of said at least one leg pad disposed generally parallel with said face of said seat back in said second position; and a locking mechanism to prevent upward travel of said at least one leg pad when said at least one leg pad is in said second position.

22. The exercise machine of claim 21 further including a second locking mechanism to prevent lateral travel of said at least one leg pad when said at least one pad is in said second position.

23. The exercise machine of claim 21 further including an adjustable seat assembly pivotally mounted to said main support frame, said seat assembly including said seat bottom and said seat back, and wherein said hold down assembly is pivotally mounted to said seat assembly adjacent to said seat bottom and said seat back.

24. The exercise machine of claim 23 further including a second locking mechanism to prevent lateral travel of said at least one leg pad when said at least one pad is in said second position.

25. An exercise machine comprising:

a main support frame;

at least one resistance element to provide resistance for performing exercise;

a press arm assembly for performing chest press exercises, said press arm assembly including a press arm pivotally mounted to said main support frame, said press arm including a handle for pressing;

a width adjustable high pull down station for performing pull down exercises, said width adjustable high pull down station including a first arm extension and a second arm extension pivotally mounted to said main support frame so as to each pivot in lateral directions, a respective locking mechanism to lock each arm extension into multiple fixed positions, a first pulley and a second pulley mounted to respective swivel pulley assemblies, each said swivel pulley assembly pivotally mounted at the distal end of a respective said arm extension, and two high pull handles;

a seat assembly including a seat bottom and a seat back for supporting a user during exercise, said seat assembly mounted below said press arm assembly and said width adjustable high pull down station wherein said seat assembly supports said user during said high pull down and said chest press exercises;

a cable system comprising one or more cables, said cable system including a first cable end partially wrapping around and extending beyond said first pulley on said first arm extension and connected to a first said high pull handle, and a second cable end partially wrapping around and extending beyond said second pulley on said second arm extension and connected to a second said high pull handle, and wherein said cable system connects said high pull handles and said press arm to said resistance element, and wherein pulling said high pull handles and pressing said press arm handle displaces said resistance element; and wherein said main support frame includes a front pole assembly wherein said first arm extension is pivotally mounted to said main support frame to the left of said front pole assembly and said second arm extension is pivotally mounted to said main support frame to the right of said front pole assembly, said first arm extension and said second arm extension mounted at equal distance from said front pole assembly to equally balance said width adjustable high pull down station to prevent tilting of said exercise machine during use.

26. The exercise machine of claim 25 wherein said cable system includes a first cable wherein each end of said first cable is connected to a respective said pull handle.

27. The exercise machine of claim 25 wherein the bottom pivot point of each respective said arm extension is below the top section of said front pole assembly and wherein the top pivot point of each respective said arm extension is above the top section of said front pole assembly to minimize the stress on said main support frame caused by the added leverage of said arm extensions.

28. The exercise machine of claim 25 wherein said seat assembly is pivotally mounted to said main support frame.

29. An exercise machine comprising:

a main support frame;

at least one resistance element to provide resistance for performing exercise;

a mid pulley assembly for performing chest press exercises, said mid pulley assembly mounted to said main support frame and including a first pulley and a second pulley attached to respective middle swivel pulley assemblies, each said middle swivel pulley assembly pivotally mounted to said mid pulley assembly, and two mid pull handles;

a width adjustable high pull down station for performing pull down exercises, said width adjustable high pull down station including a first arm extension and a second arm extension pivotally mounted to said main support frame so as to pivot in lateral directions, a respective locking mechanism to lock each arm extension into multiple fixed positions, a third pulley and a fourth pulley mounted to respective high swivel pulley assemblies, each said high swivel pulley assembly pivotally mounted at the distal end of to a respective said arm extension, and two high pull handles;

a seat assembly including a seat bottom and a seat back for supporting a user during exercise, said seat assembly mounted below said press arm assembly and said width adjustable high pull down station wherein said seat assembly supports said user during said high pull down and said chest press exercises;

a cable system comprising two or more cables, said cable system including a first cable end partially wrapping around and extending beyond said first pulley on said mid pulley assembly and connected to a first said mid pull handle, a second cable end partially wrapping around and extending beyond said second pulley on said mid pulley assembly and connected to a second said mid pull handle, a third cable end partially wrapping around and extending beyond said third pulley on said first arm extension and connected to a first said high pull handle, and a fourth cable end partially wrapping around and extending beyond said fourth pulley on said second arm extension and connected to a second said high pull handle, and wherein said cable system connects said mid pull handles and said high pull handles to said resistance element, and wherein pulling said high pull handles and pressing said mid pull handles displaces said resistance element; and wherein said main support frame includes a front pole assembly wherein said first arm extension is pivotally mounted to said main support frame to the left of said front pole assembly and said second arm extension is pivotally mounted to said main support frame to the right of said front pole assembly, said first arm extension and said second arm extension mounted at equal distance from said front pole assembly to equally balance said width adjustable high pull down station to prevent tilting of said exercise machine during use.

30. The exercise machine of claim 29 wherein said cable system includes a first cable wherein each end of said first cable is connected to a respective said high pull handle.

31. The exercise machine of claim 29 wherein said seat assembly is pivotally mounted to said main support frame.

32. The exercise machine of claim 29 wherein the bottom pivot point of each respective said arm extension is below the top section of said front pole assembly and wherein the top pivot point of each respective said arm extension is above the top section of said front pole assembly to minimize the stress on said main support frame caused by the added leverage of said arm extensions.

* * * * *